US012649087B2

(12) United States Patent
Kim et al.

(10) Patent No.: US 12,649,087 B2
(45) Date of Patent: Jun. 9, 2026

(54) EXERCISE BIKE

(71) Applicant: LG Electronics Inc., Seoul (KR)

(72) Inventors: Min Seok Kim, Seoul (KR); Sunggyu Koh, Seoul (KR); Jai Whan Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 107 days.

(21) Appl. No.: 18/838,771

(22) PCT Filed: Sep. 23, 2022

(86) PCT No.: PCT/KR2022/014274
§ 371 (c)(1),
(2) Date: Aug. 15, 2024

(87) PCT Pub. No.: WO2023/219212
PCT Pub. Date: Nov. 16, 2023

(65) Prior Publication Data

US 2025/0152998 A1 May 15, 2025

(30) Foreign Application Priority Data

May 9, 2022 (KR) ..... 10-2022-0056410

(51) Int. Cl.
*A63B 23/04* (2006.01)
*A63B 21/00* (2006.01)

(52) U.S. Cl.
CPC .... *A63B 23/0476* (2013.01); *A63B 21/00069* (2013.01); *A63B 21/00076* (2013.01);
(Continued)

(58) Field of Classification Search
CPC ..... A63B 23/0476; A63B 21/00069; A63B 21/00076; A63B 21/00192;
(Continued)

(56) References Cited

U.S. PATENT DOCUMENTS 5,938,570 A * 8/1999 Maresh ..... A63B 22/001 482/57
6,652,425 B1 * 11/2003 Martin ..... A63B 21/154 482/57
(Continued)

FOREIGN PATENT DOCUMENTS

CN 201248993 Y 6/2009
CN 204395314 U 6/2015
(Continued)

*Primary Examiner* — Garrett K Atkinson
(74) *Attorney, Agent, or Firm* — Birch, Stewart, Kolasch & Birch, LLP

(57) ABSTRACT

An exercise bike according to the present disclosure comprises a base part being placed on an installation surface, a support frame part having a lower portion that is fixed to the base part and an upper portion that extends to an upper side of the base part and supports a handle and a seat, a disc part connecting to a rotation support shaft that passes through the support frame part, a pedal being detachably disposed at the disc part, a resistance adjusting part receiving a rotation of the disc part through a belt member, being supported by the support frame part and adjusting resistance at a time when the pedal is rotated by magnetic force, and a housing part being disposed at the upper side of the base part in a state.

20 Claims, 30 Drawing Sheets

(52) U.S. Cl.
CPC .... *A63B 21/00192* (2013.01); *A63B 21/4034* (2015.10); *A63B 2225/093* (2013.01)

(58) Field of Classification Search
CPC ..... A63B 21/4034; A63B 2225/093; A63B 2024/0093; A63B 21/0052; A63B 21/0056; A63B 24/0087; A63B 22/0605
See application file for complete search history.

(56) References Cited

U.S. PATENT DOCUMENTS

| | | | | |
|---|---|---|---|---|
| 7,166,067 | B2 * | 1/2007 | Talish | A63B 21/00196 482/148 |
| 9,839,807 | B2 | 12/2017 | Golesh | |
| 9,919,182 | B2 | 3/2018 | Golesh | |
| 10,112,067 | B2 | 10/2018 | Golesh | |
| 10,799,755 | B2 | 10/2020 | Cristofori et al. | |
| 2003/0139264 | A1 * | 7/2003 | Kuo | A63B 24/00 482/57 |
| 2008/0214971 | A1 * | 9/2008 | Talish | A63B 22/0012 601/23 |
| 2016/0263416 | A1 | 9/2016 | Golesh | |
| 2016/0263417 | A1 | 9/2016 | Golesh | |
| 2018/0036586 | A1 | 2/2018 | Cristofori et al. | |
| 2018/0207468 | A1 * | 7/2018 | Golesh | A63B 22/0605 |
| 2020/0353310 | A1 * | 11/2020 | Bissonnette | A63B 22/0005 |
| 2021/0077856 | A1 | 3/2021 | Hawkins, III et al. | |

FOREIGN PATENT DOCUMENTS

| | | | |
|---|---|---|---|
| KR | 10-2016-0044915 | A | 4/2016 |
| WO | WO 2022/055263 | A1 | 3/2022 |

* cited by examiner

[Fig. 1]
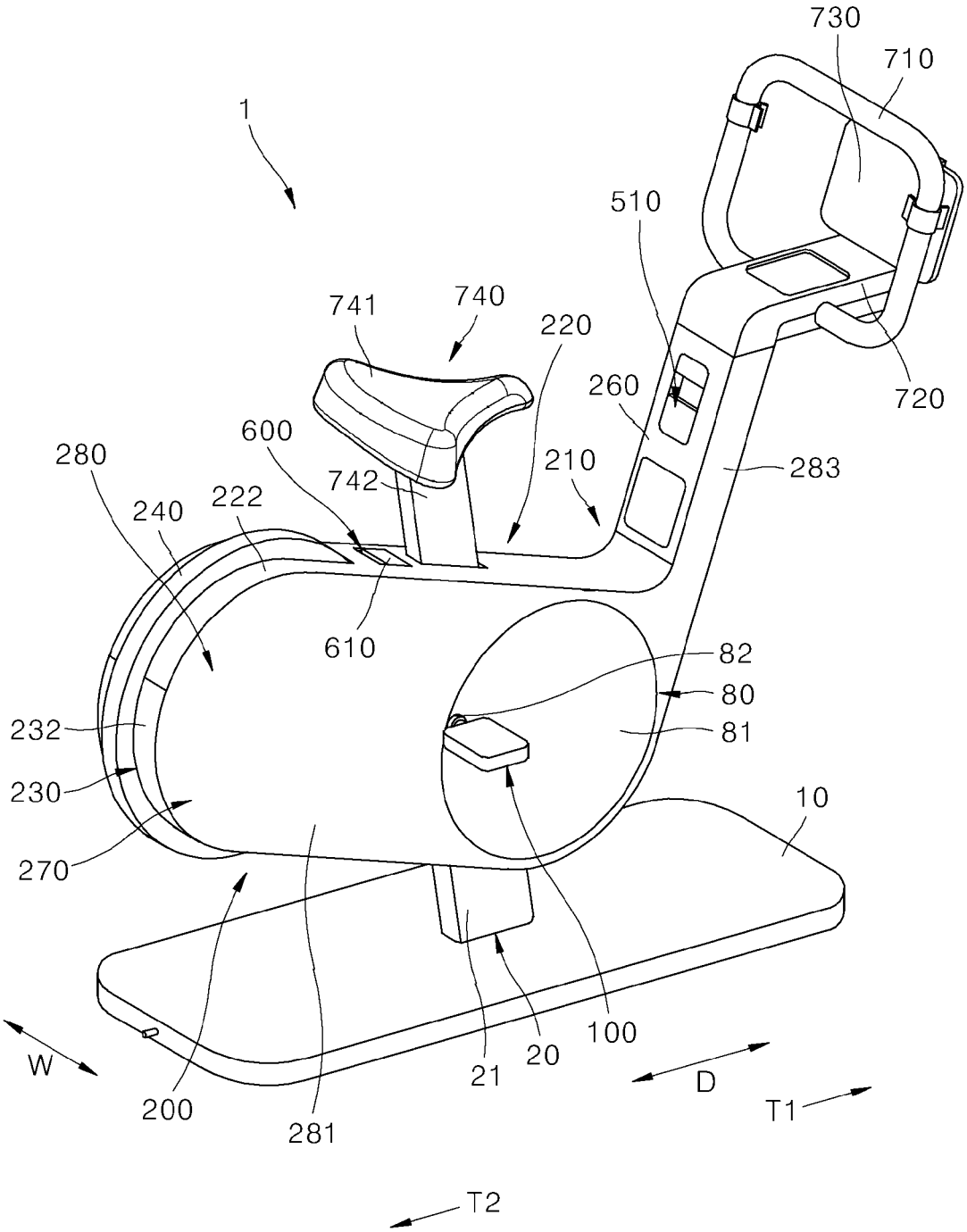

[Fig. 2]
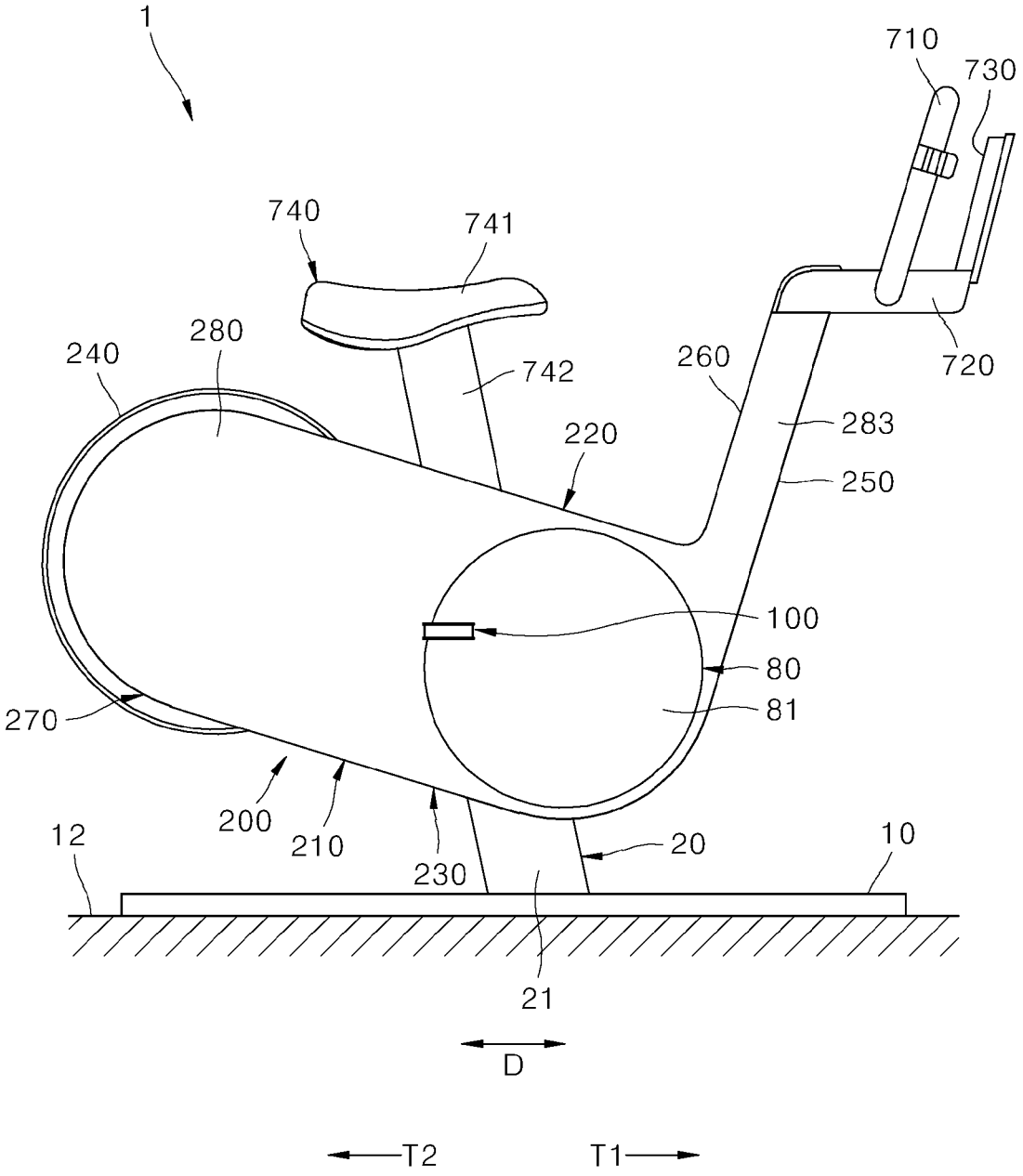

[Fig. 3]
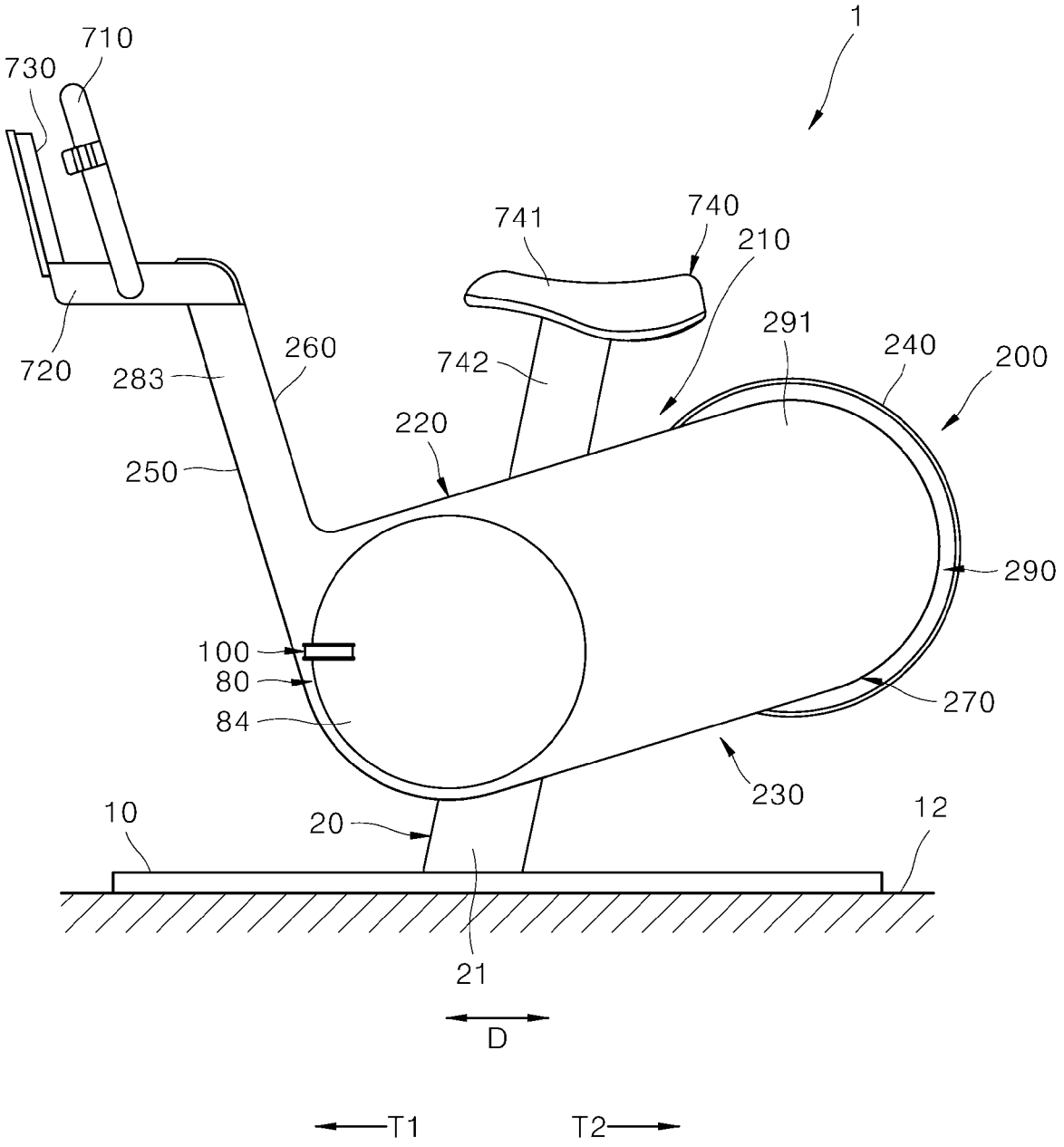

[Fig. 4]
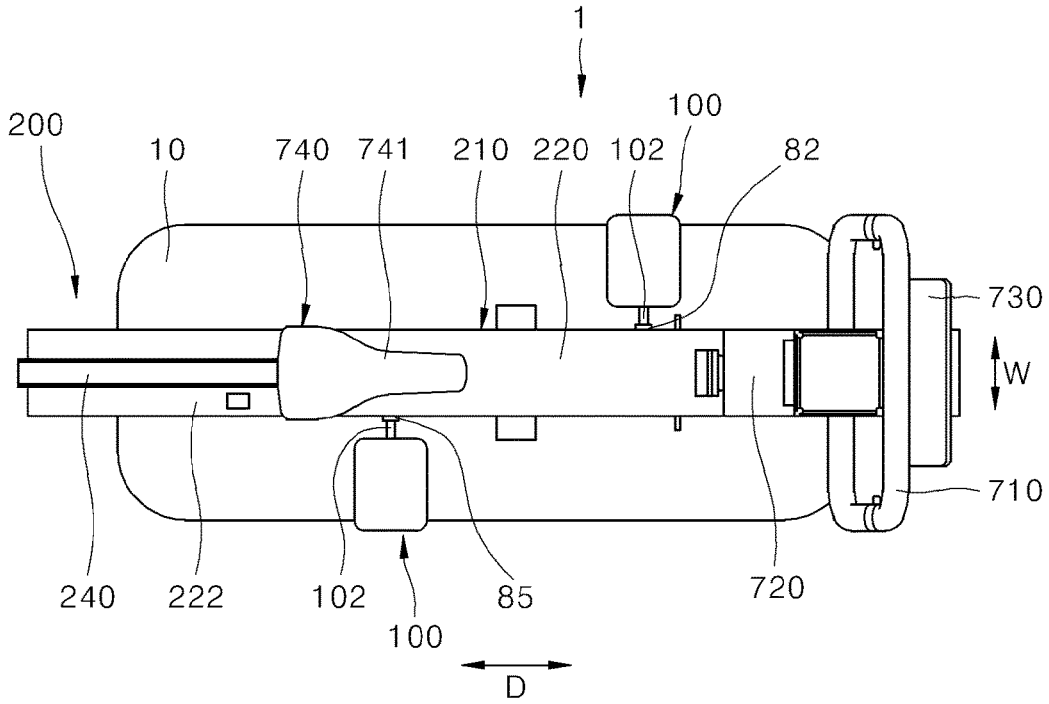
[Fig. 5]
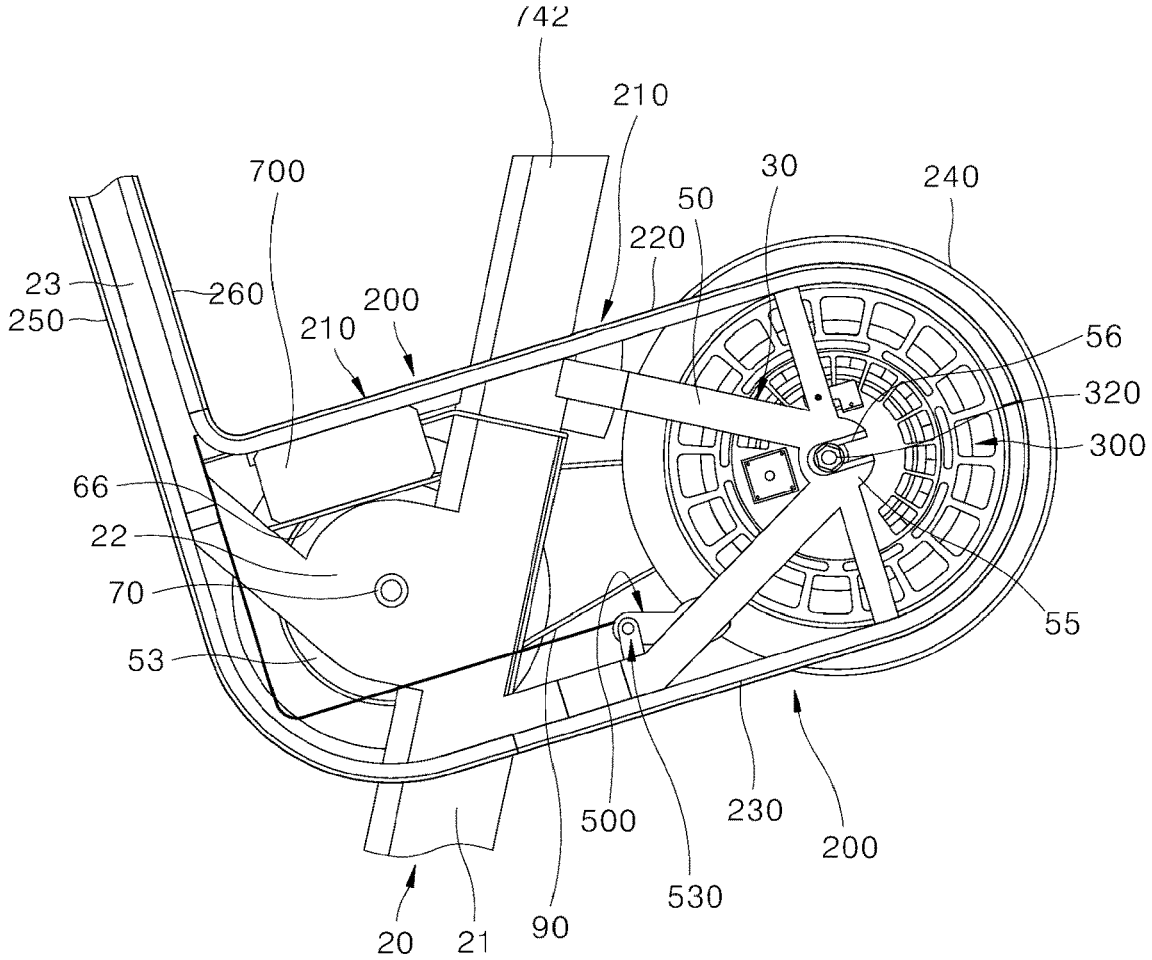

[Fig. 6]
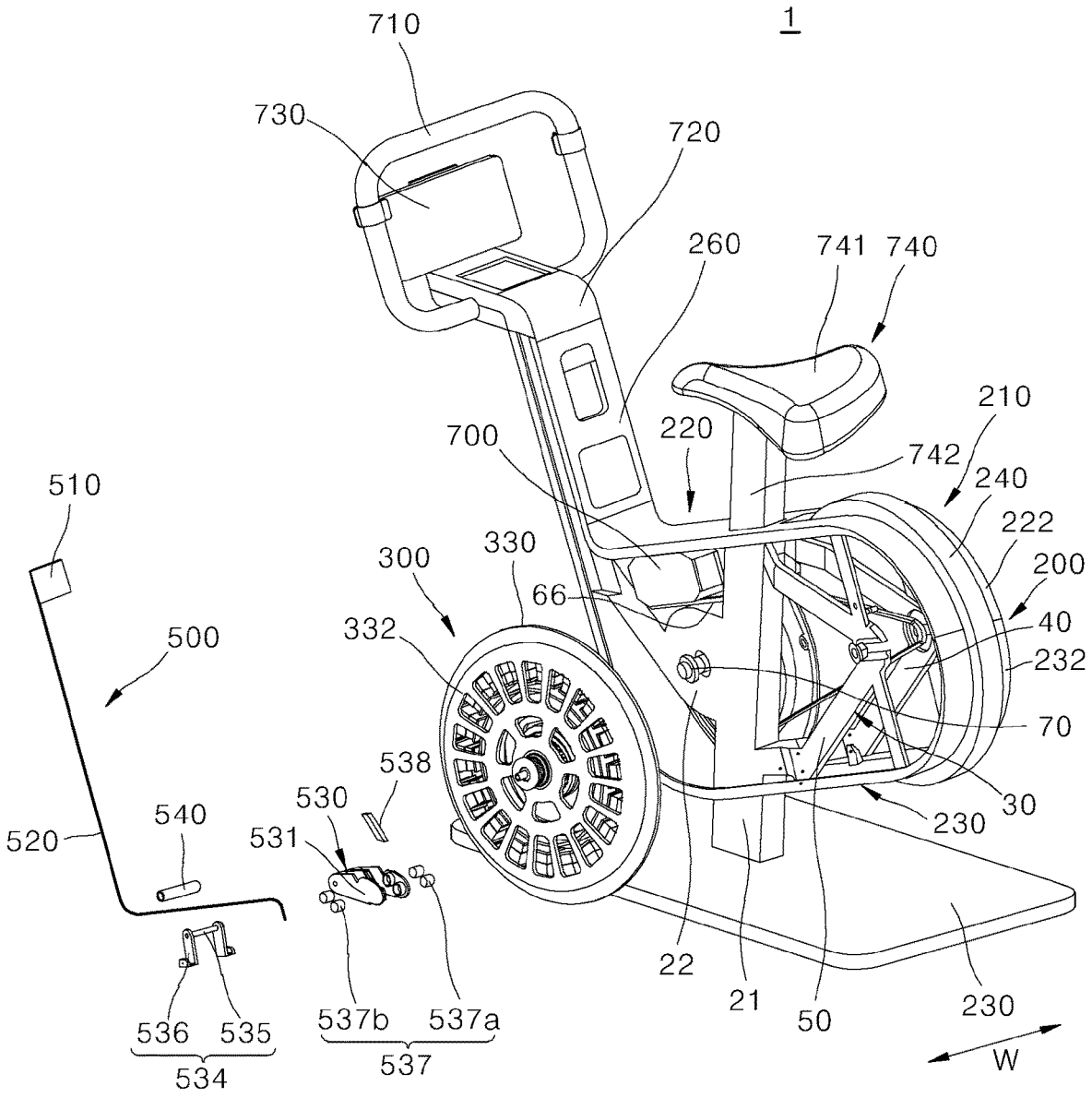

[Fig. 7]
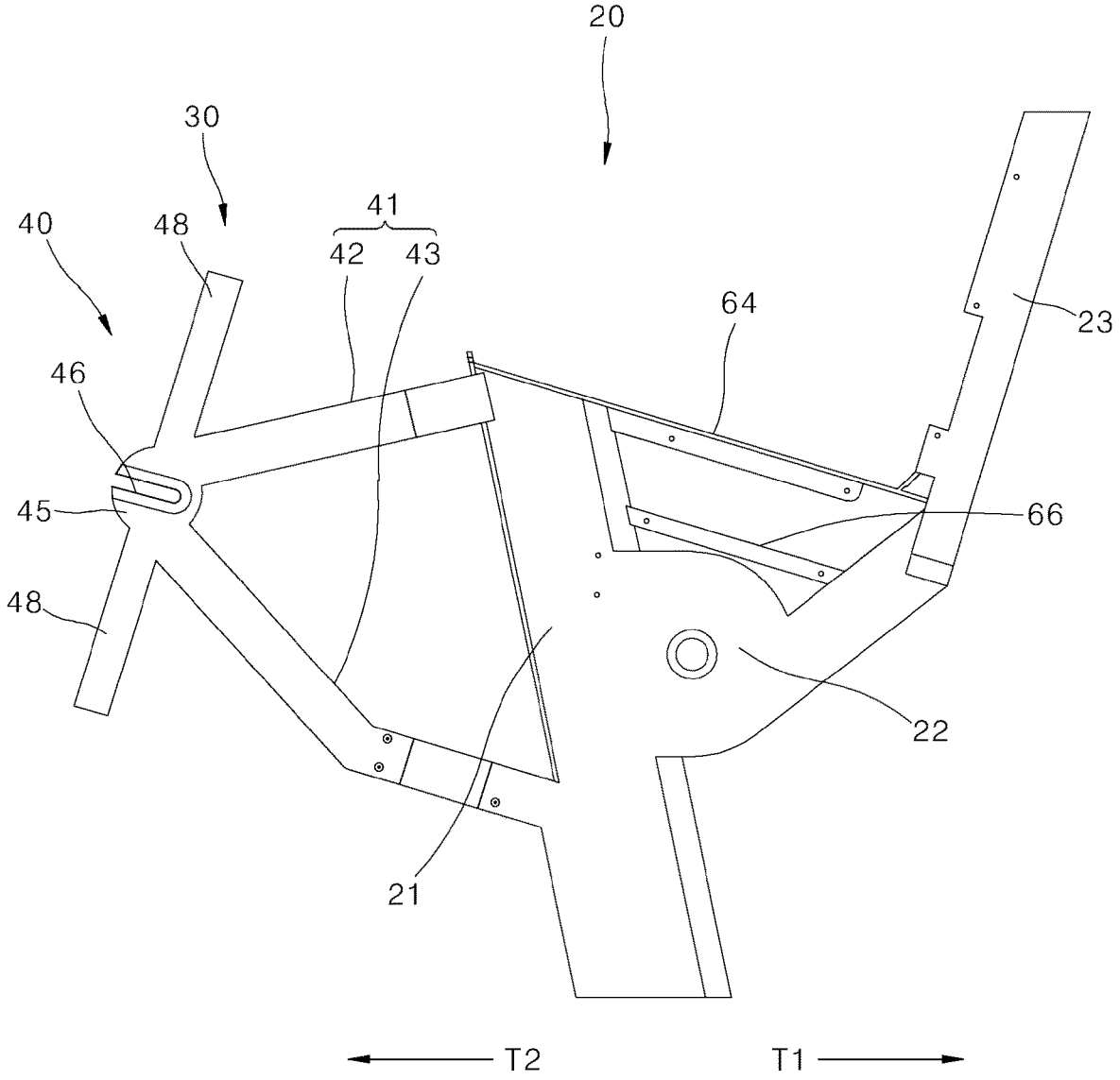

[Fig. 8]
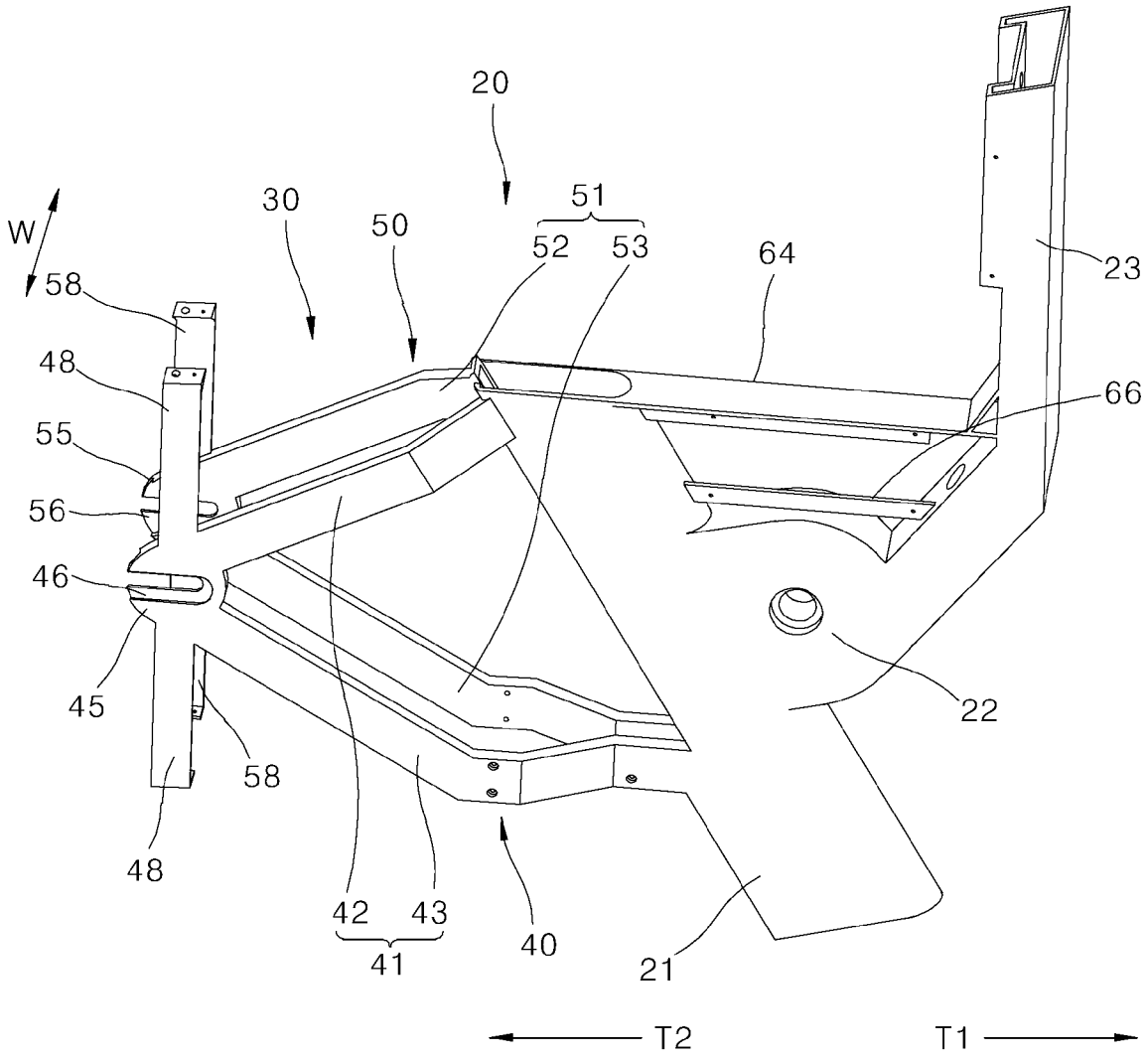

[Fig. 9]
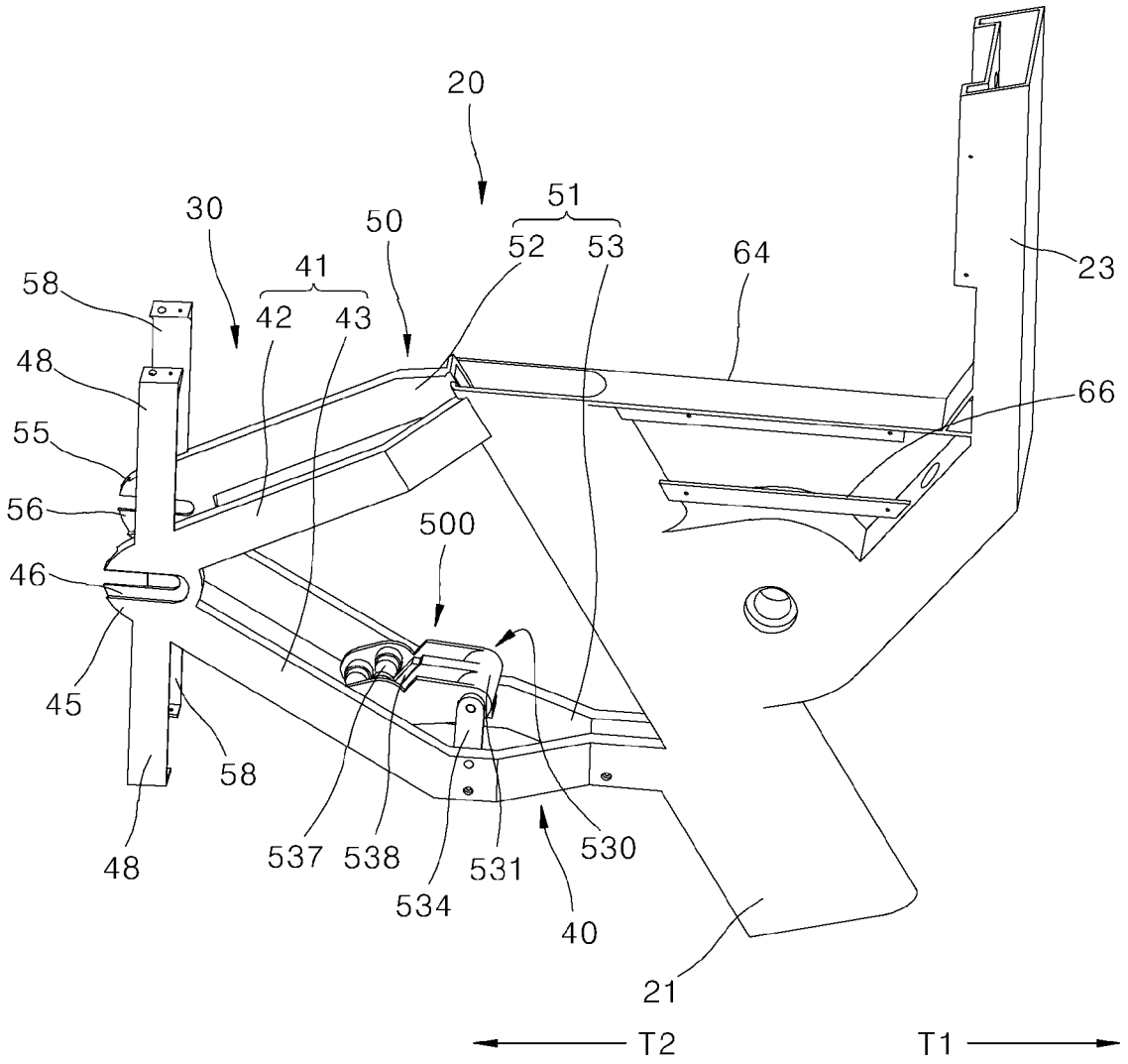

[Fig. 10]
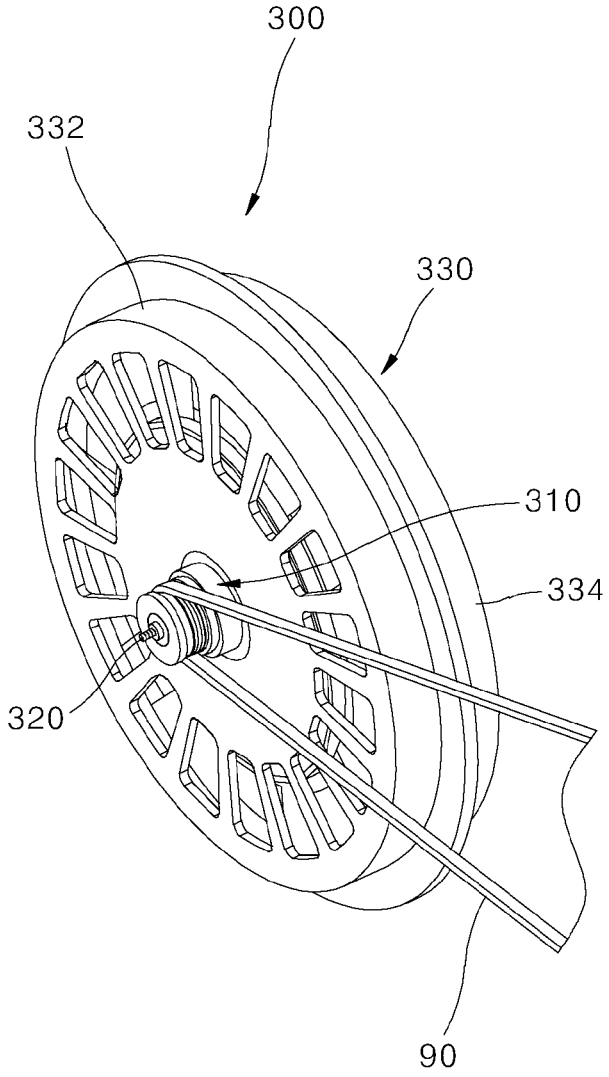

[Fig. 11]
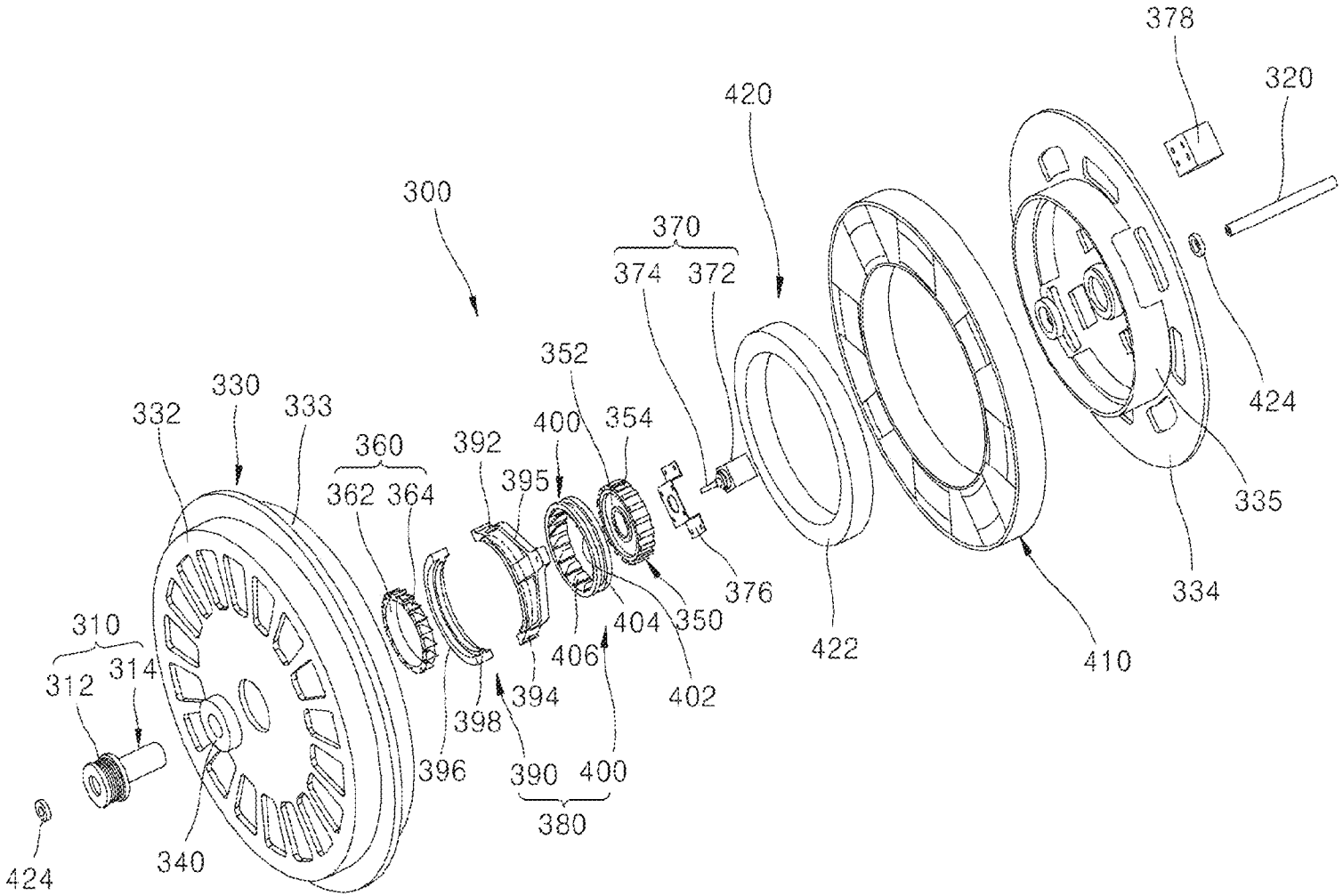

[Fig. 12]
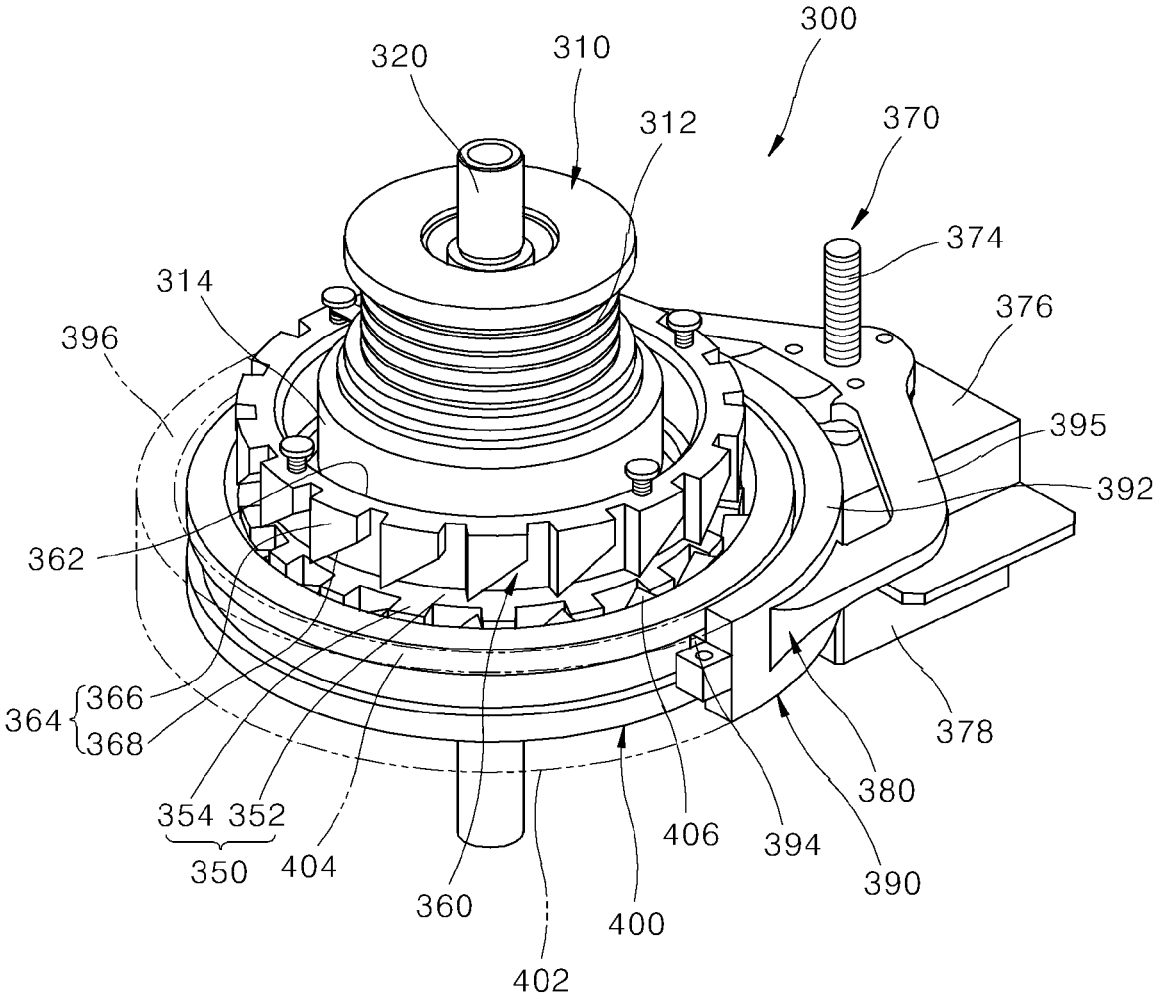

[Fig. 13]
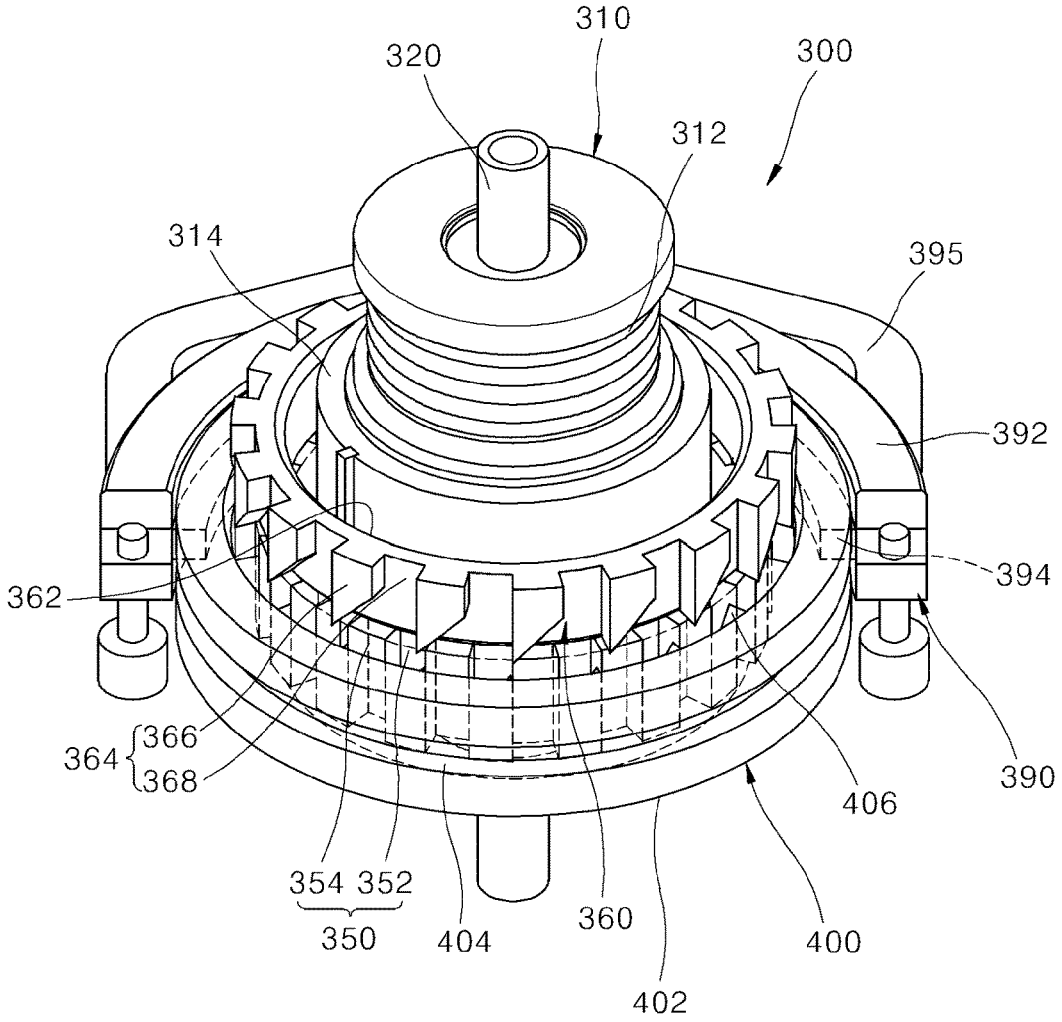
[Fig. 14]
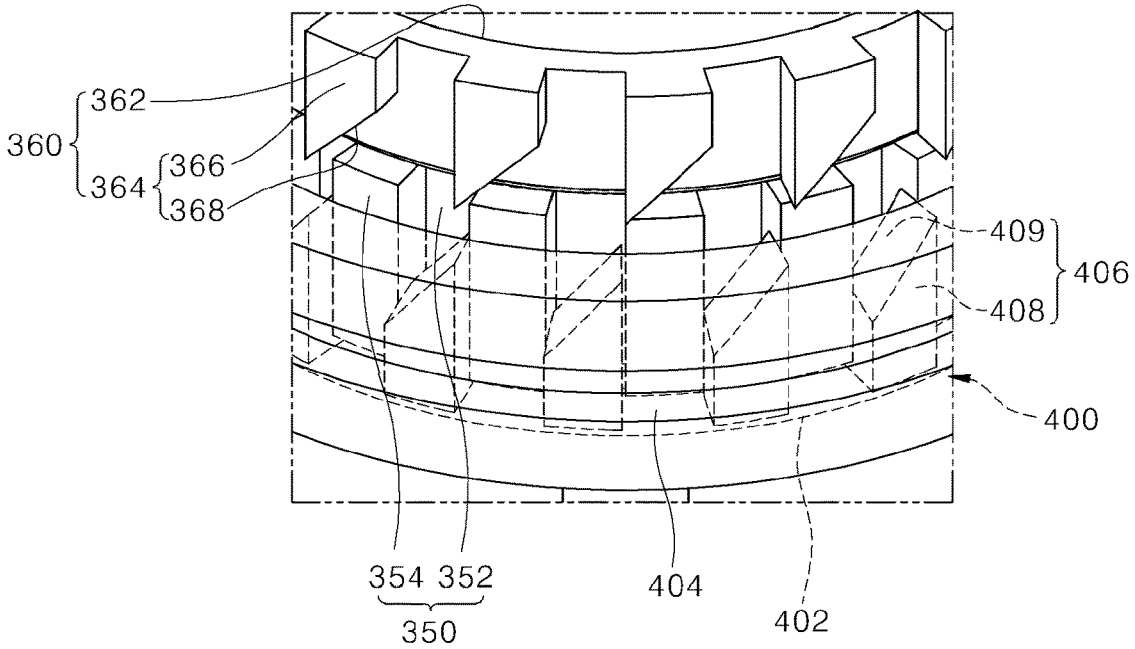

[Fig. 15]
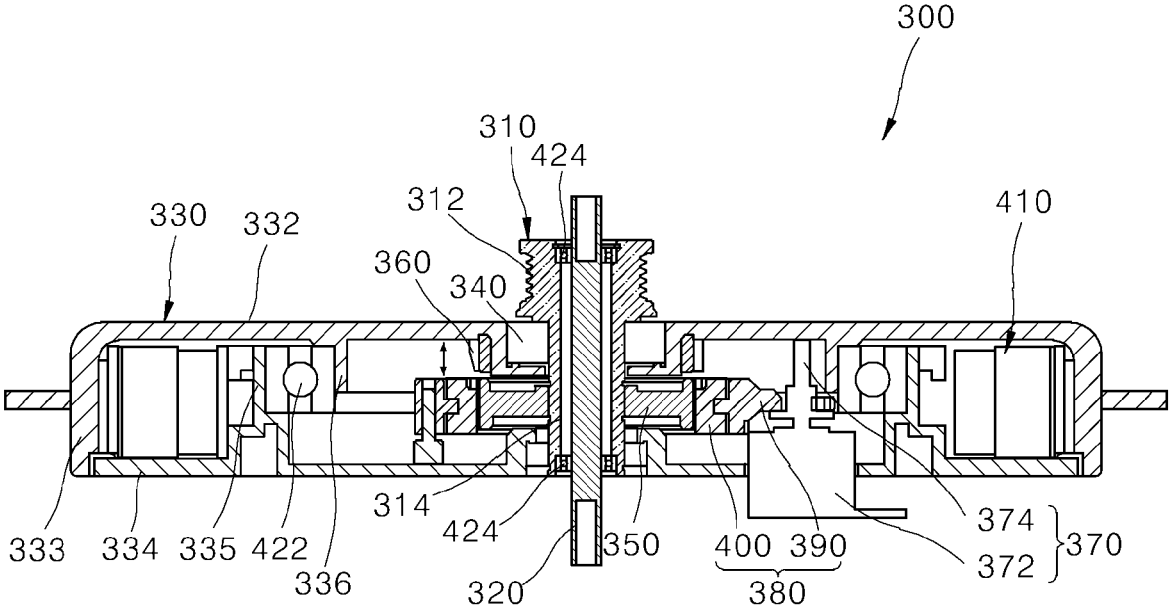
[Fig. 16]
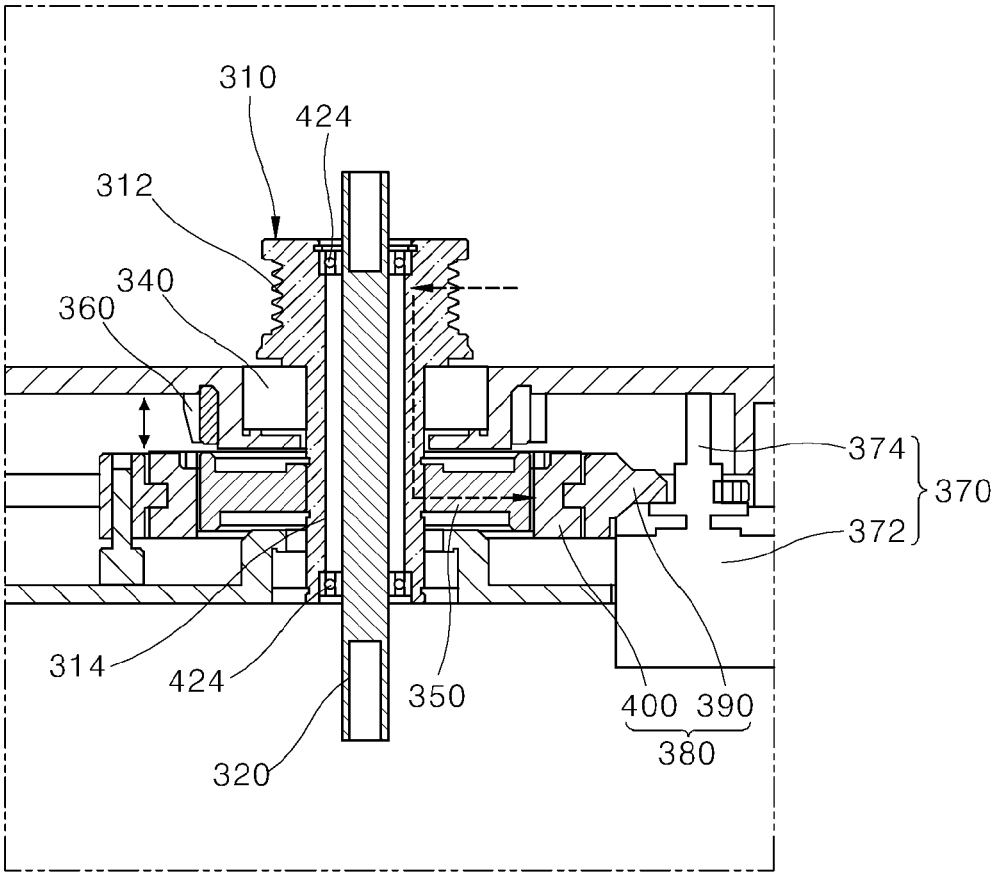

[Fig. 17]
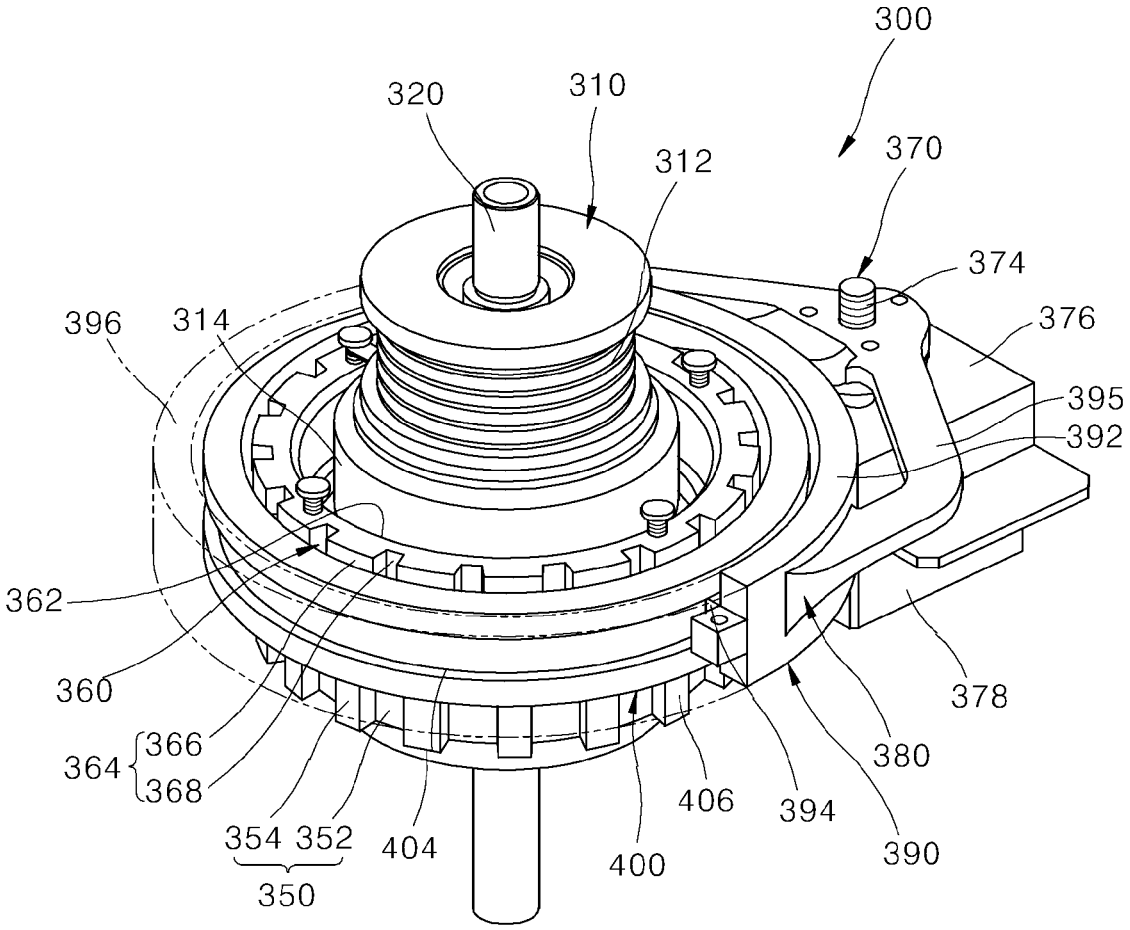

[Fig. 18]
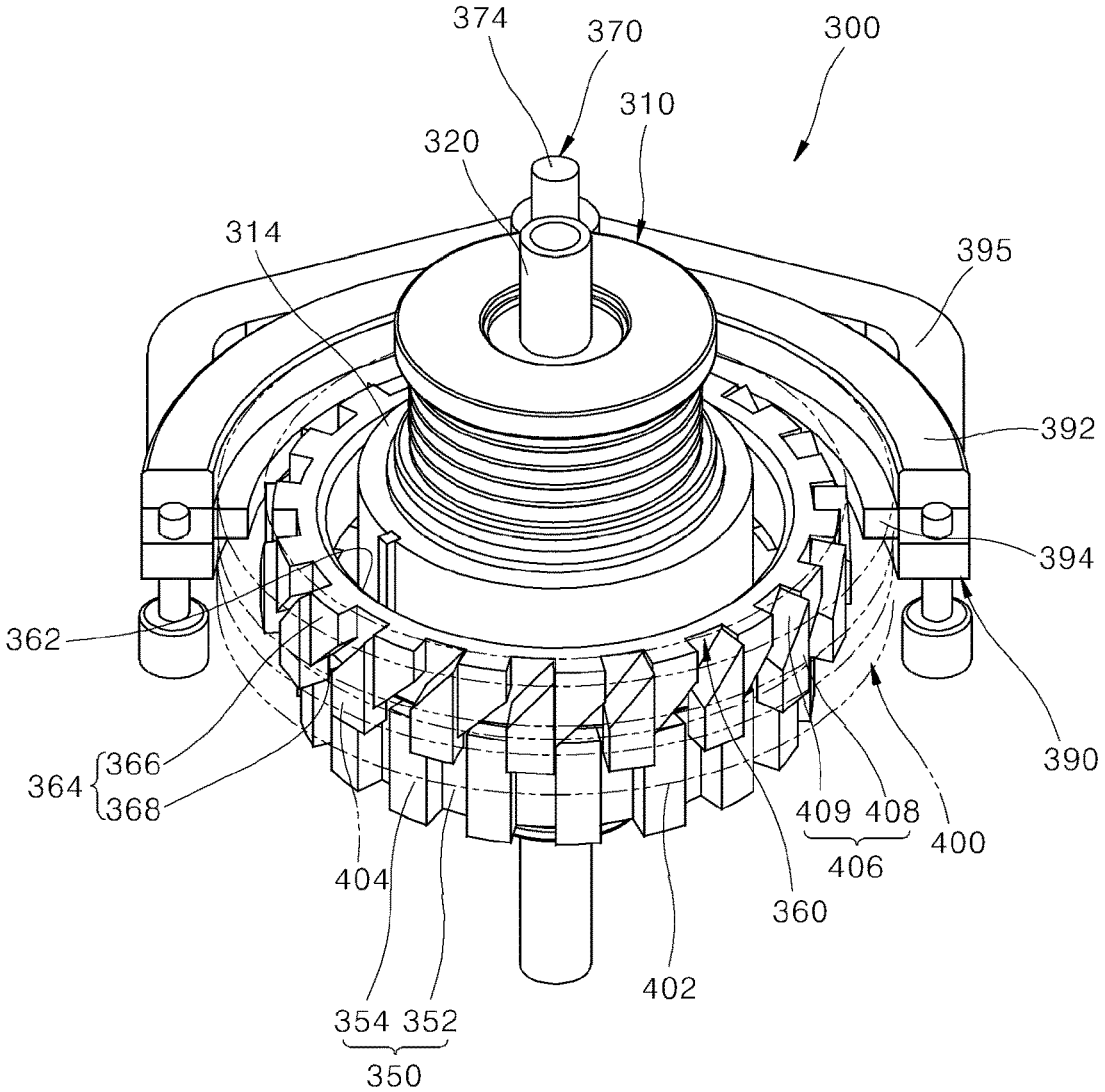
[Fig. 19]
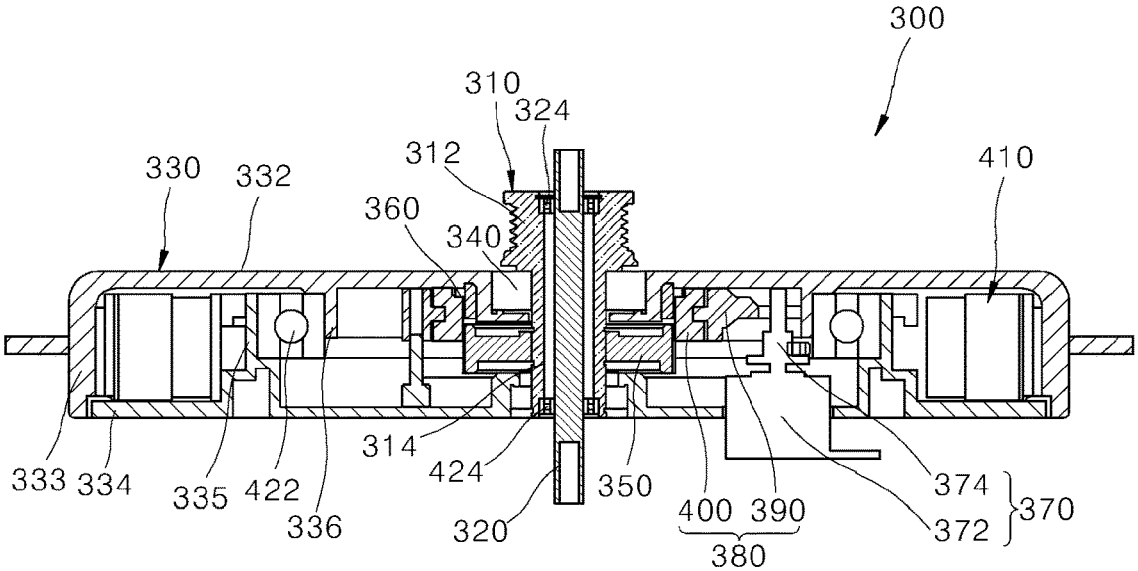

[Fig. 20]
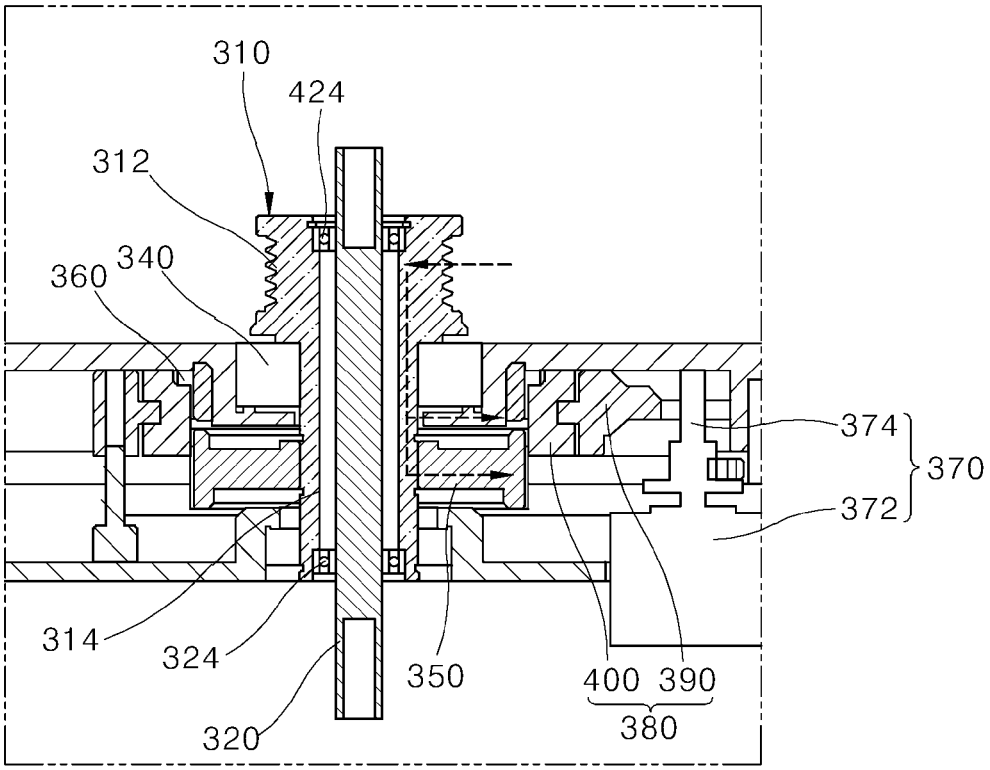

[Fig. 21]
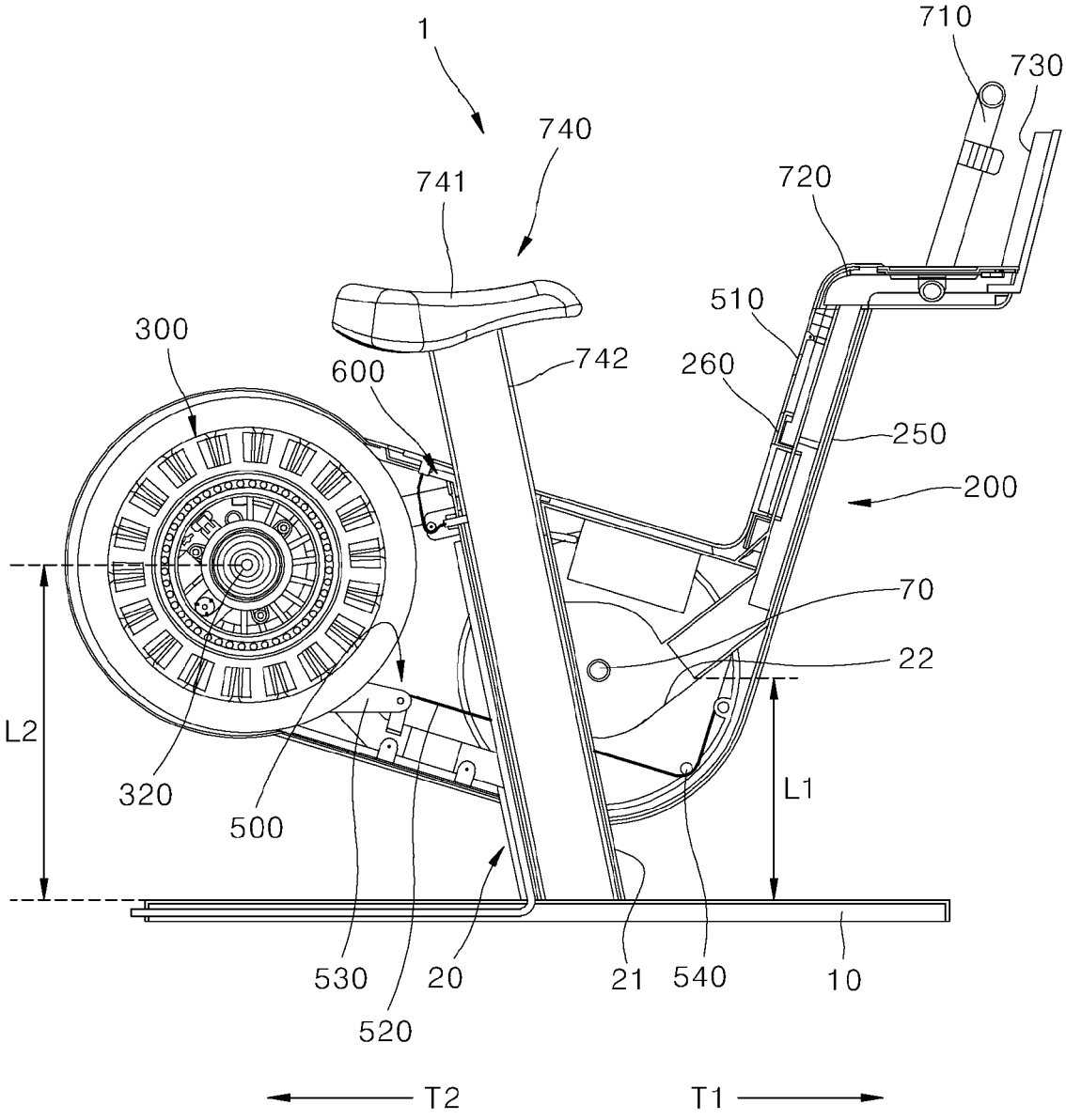

[Fig. 22]
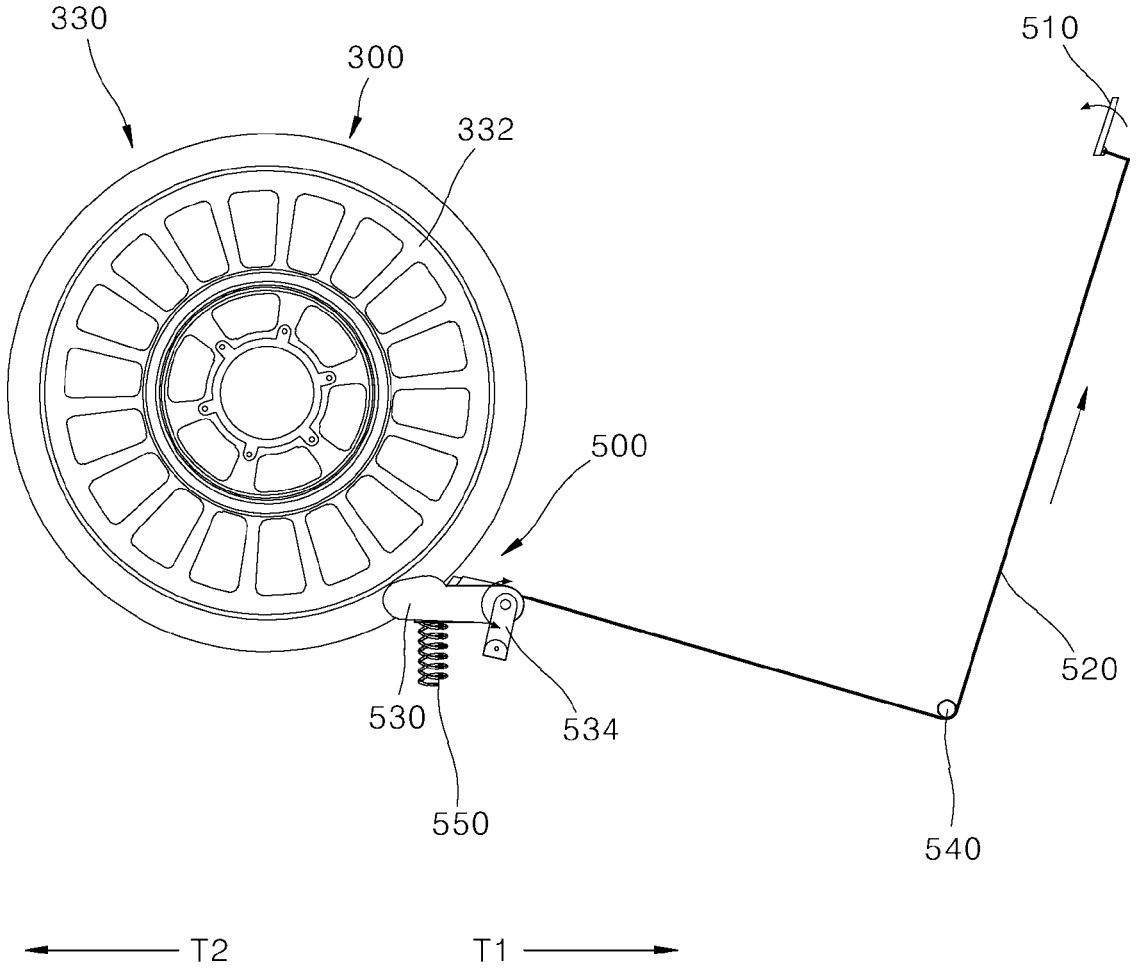

[Fig. 23]
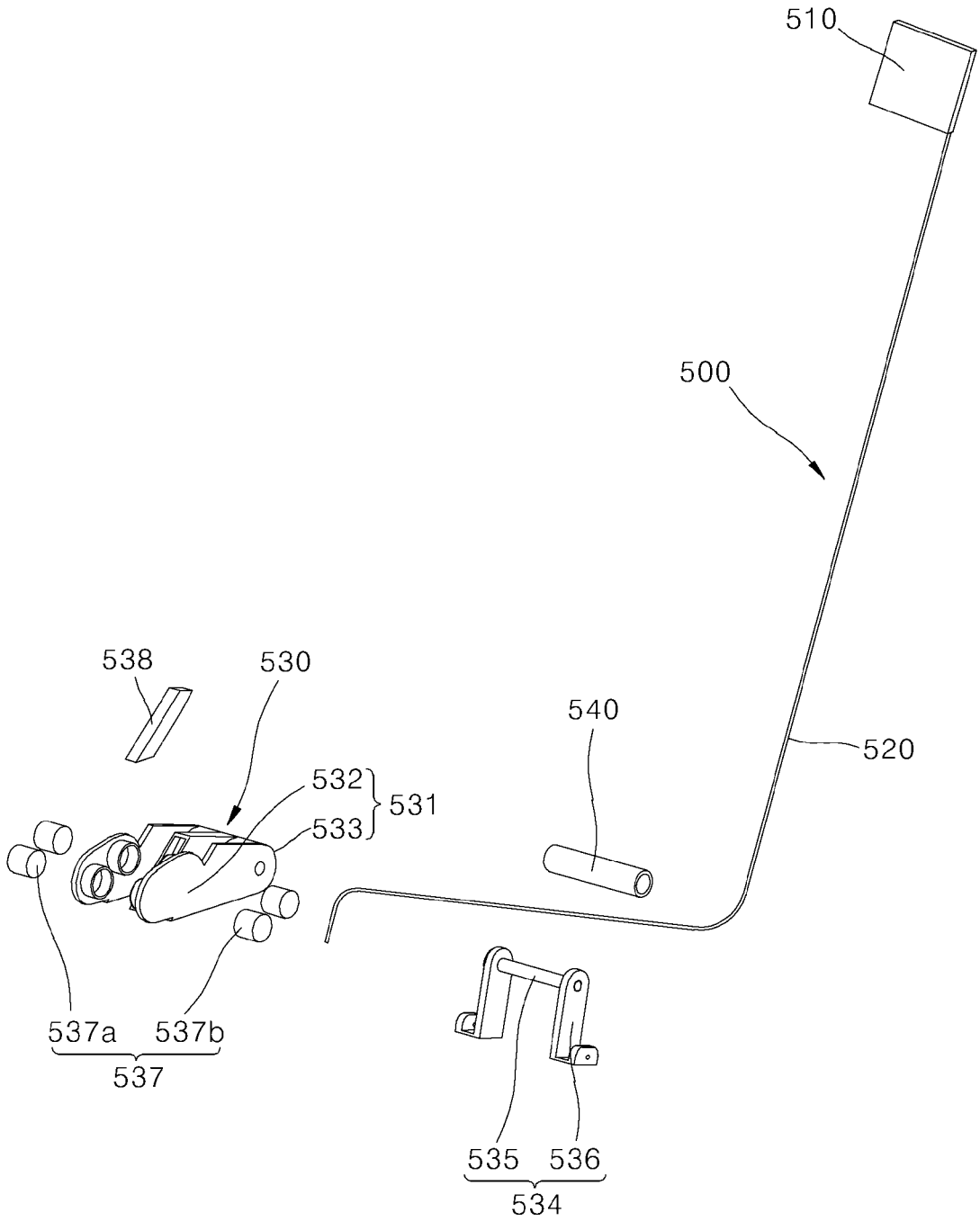

[Fig. 24]
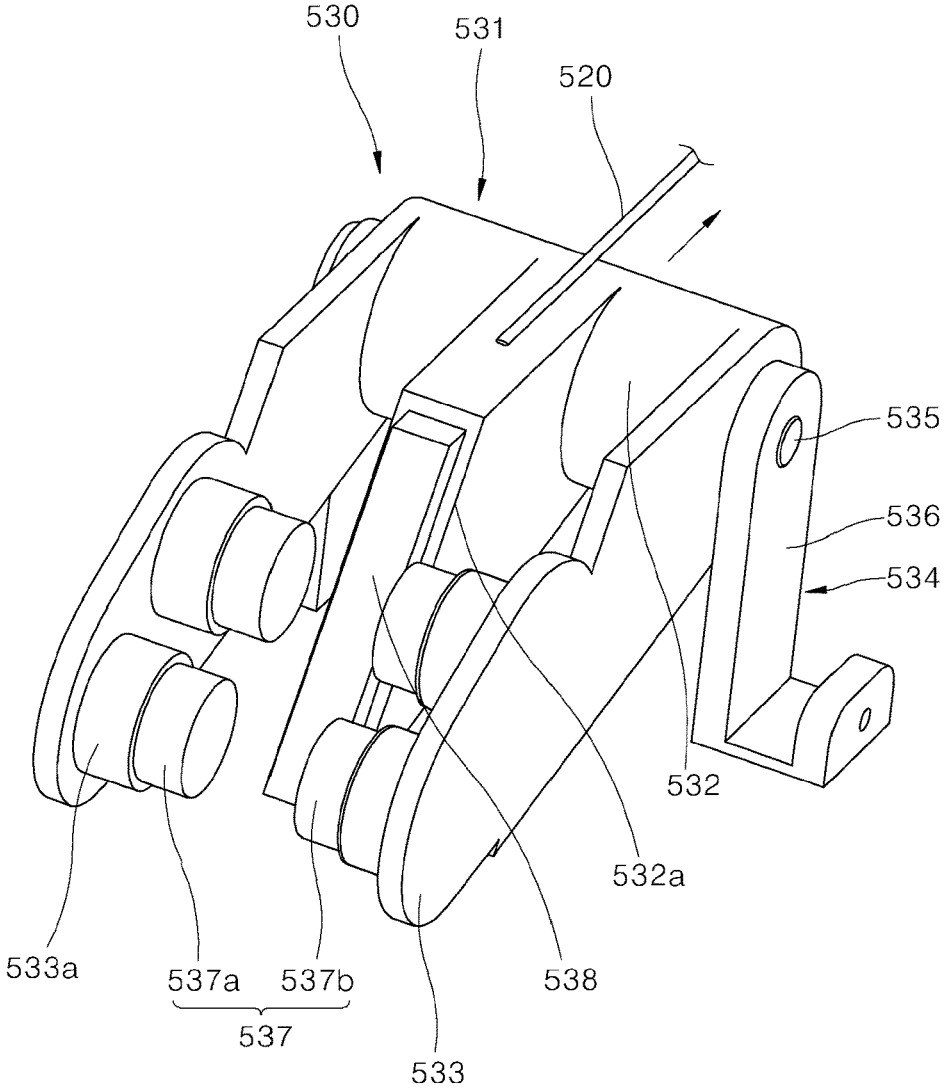
[Fig. 25]
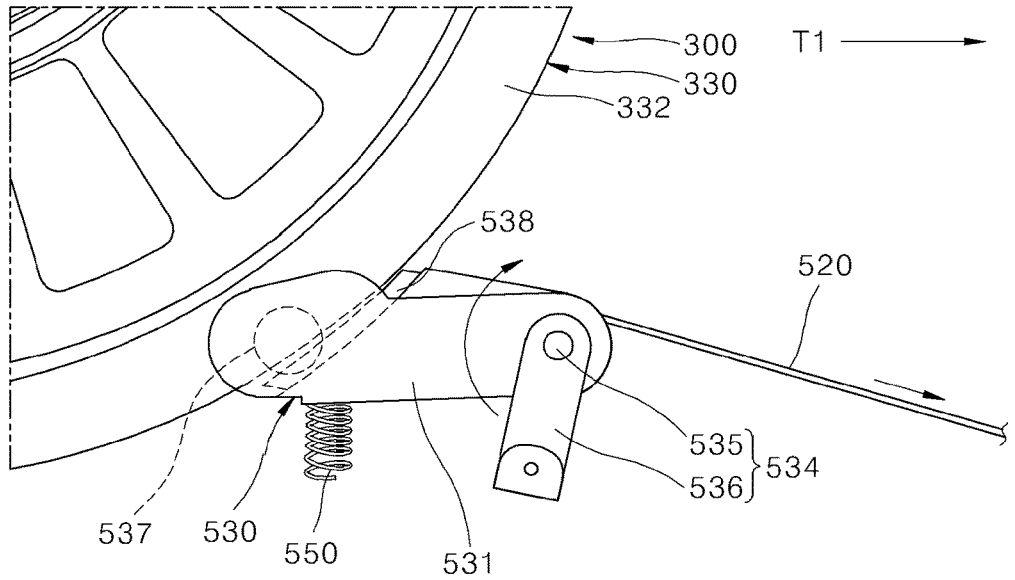

[Fig. 26]
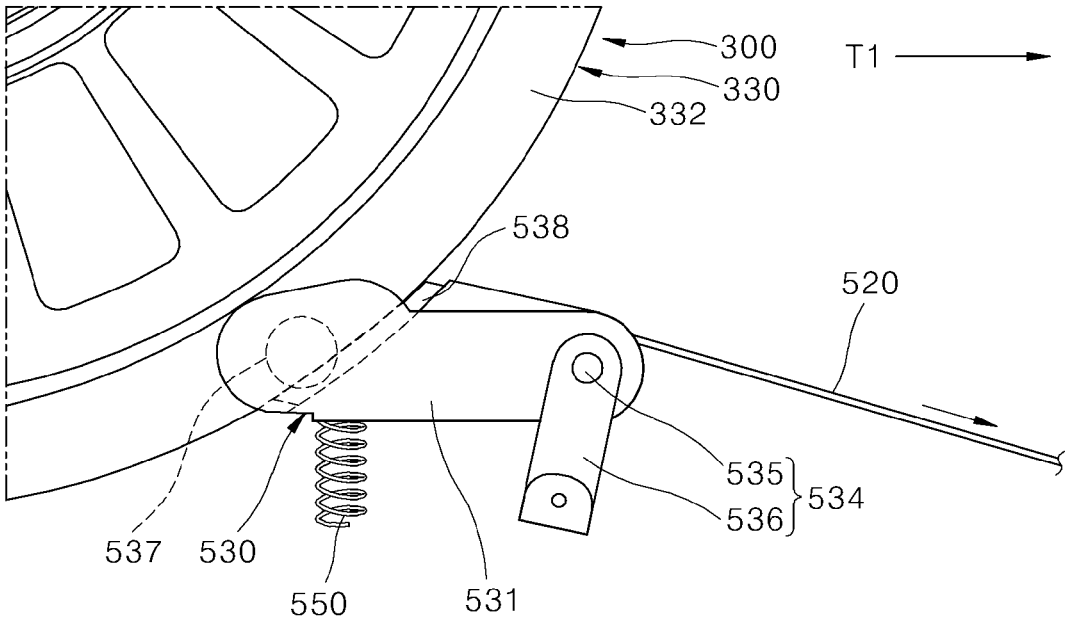

[Fig. 27]
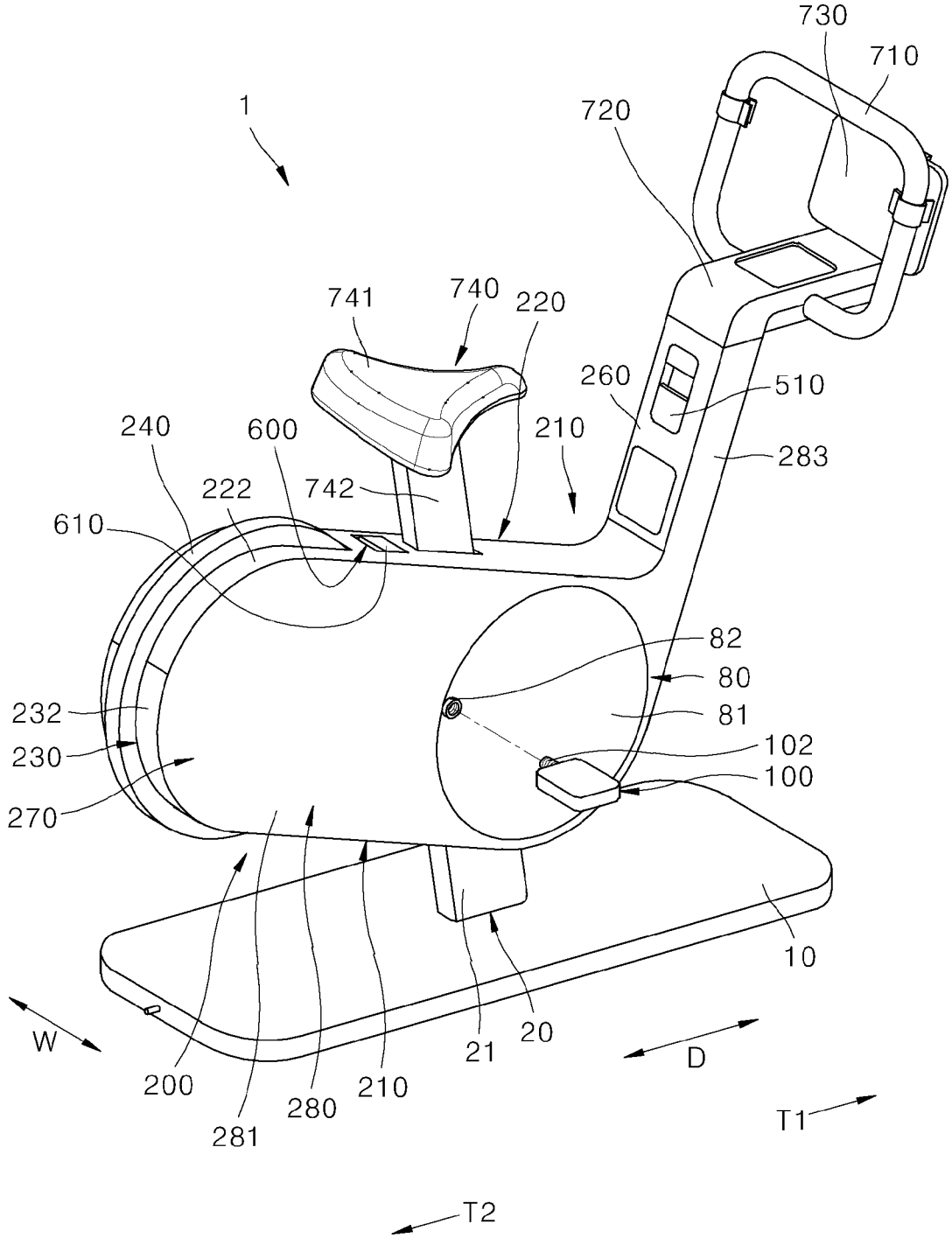

[Fig. 28]
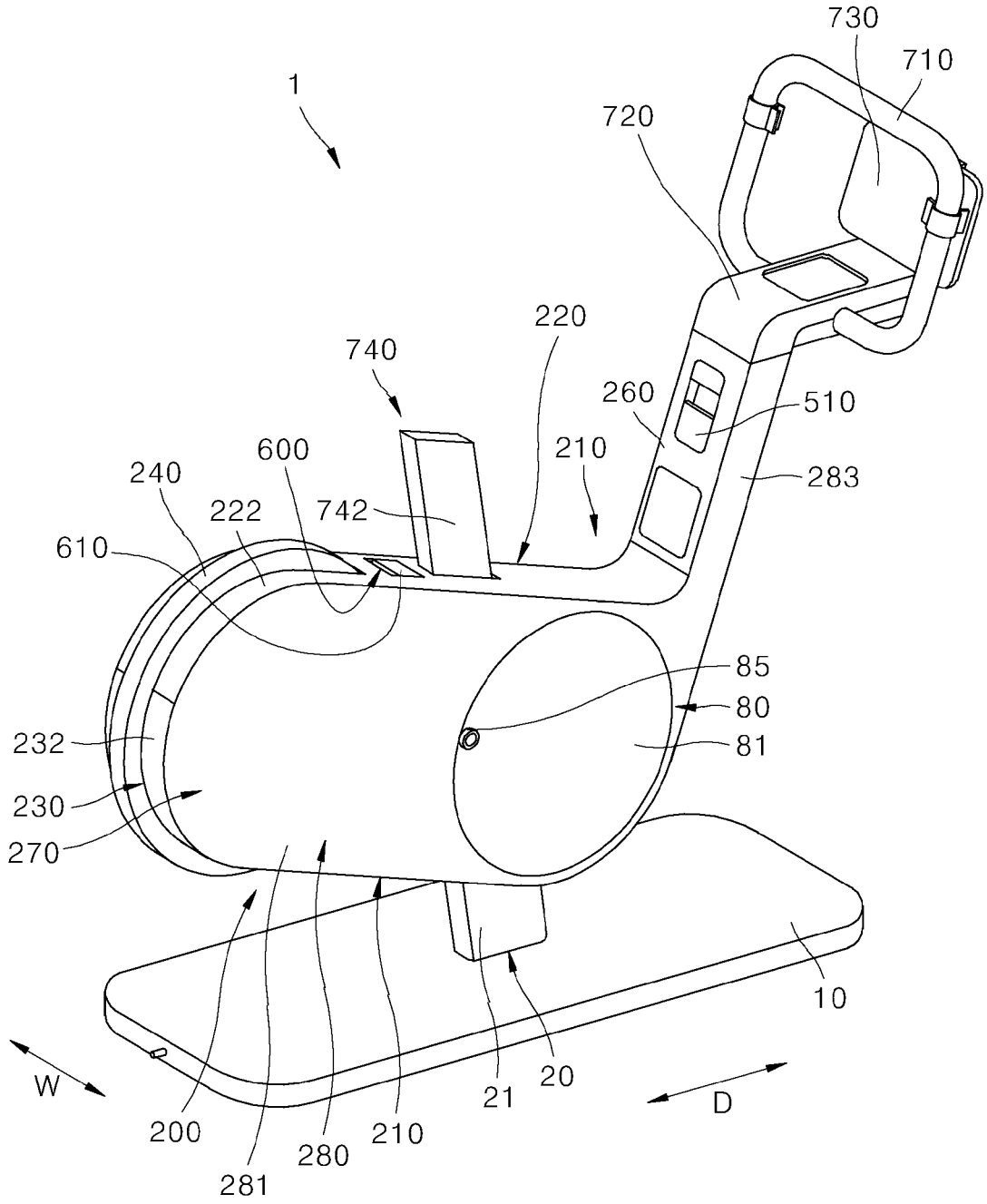

[Fig. 29]
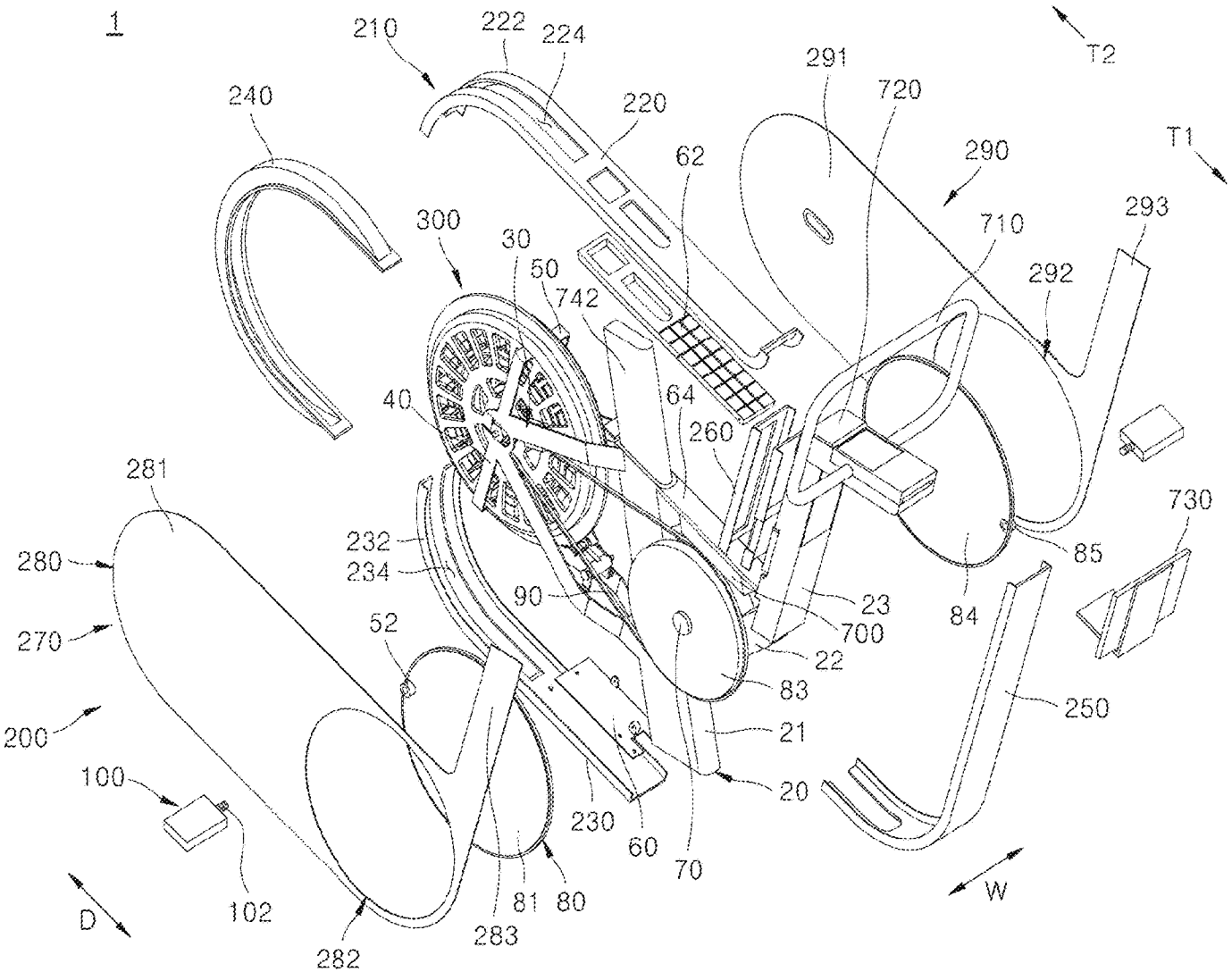

[Fig. 30]
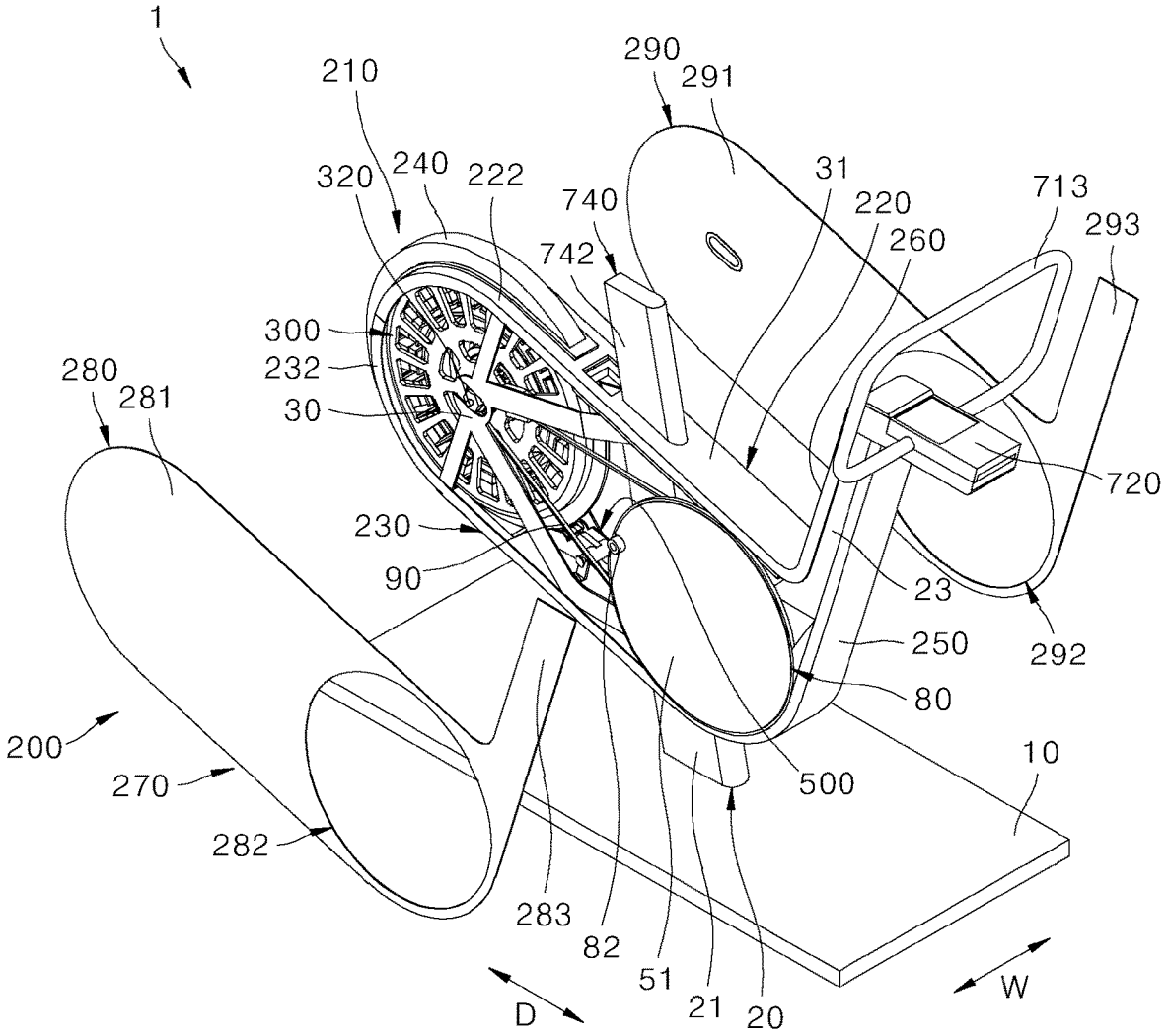

[Fig. 31]
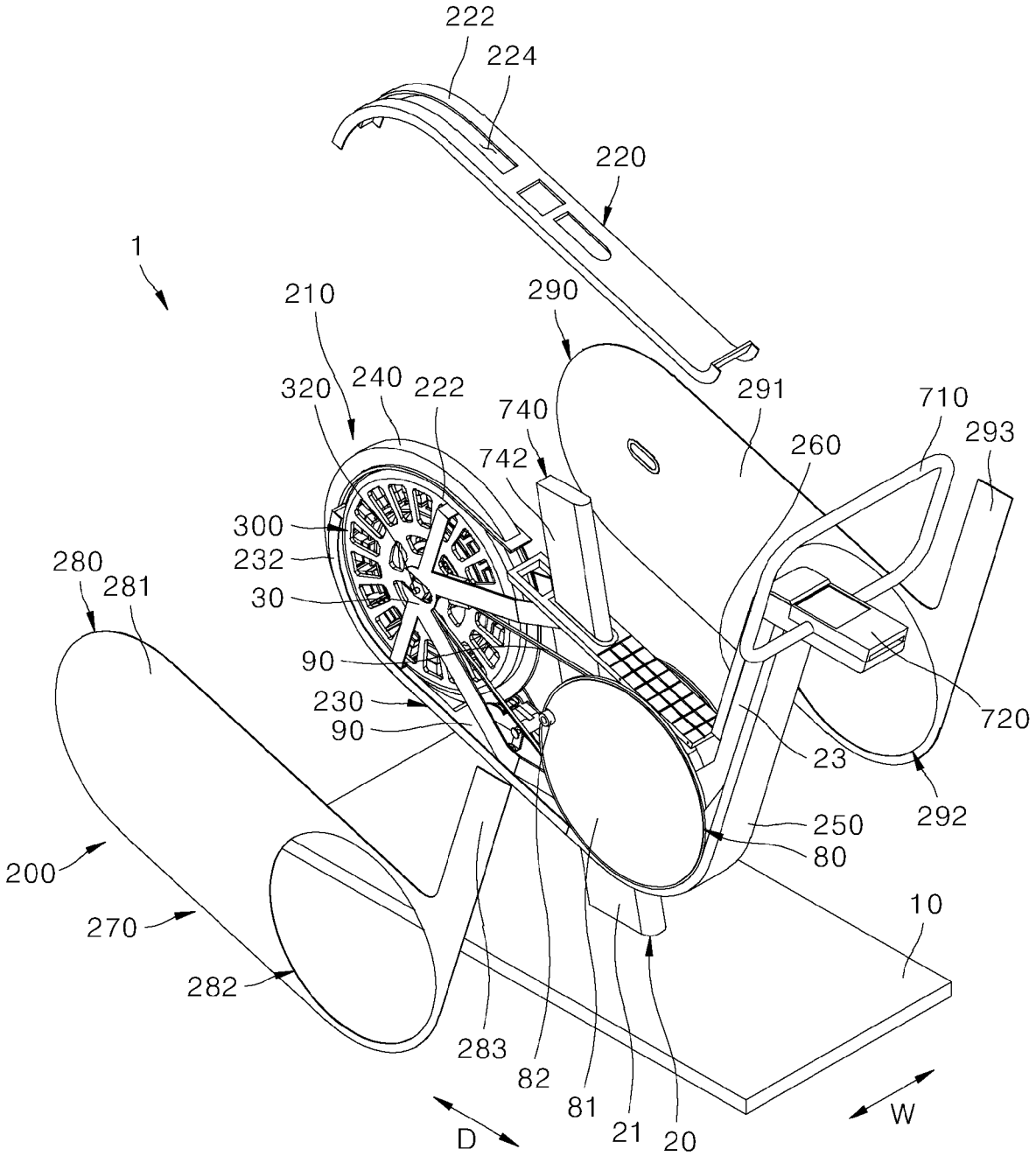

[Fig. 32]
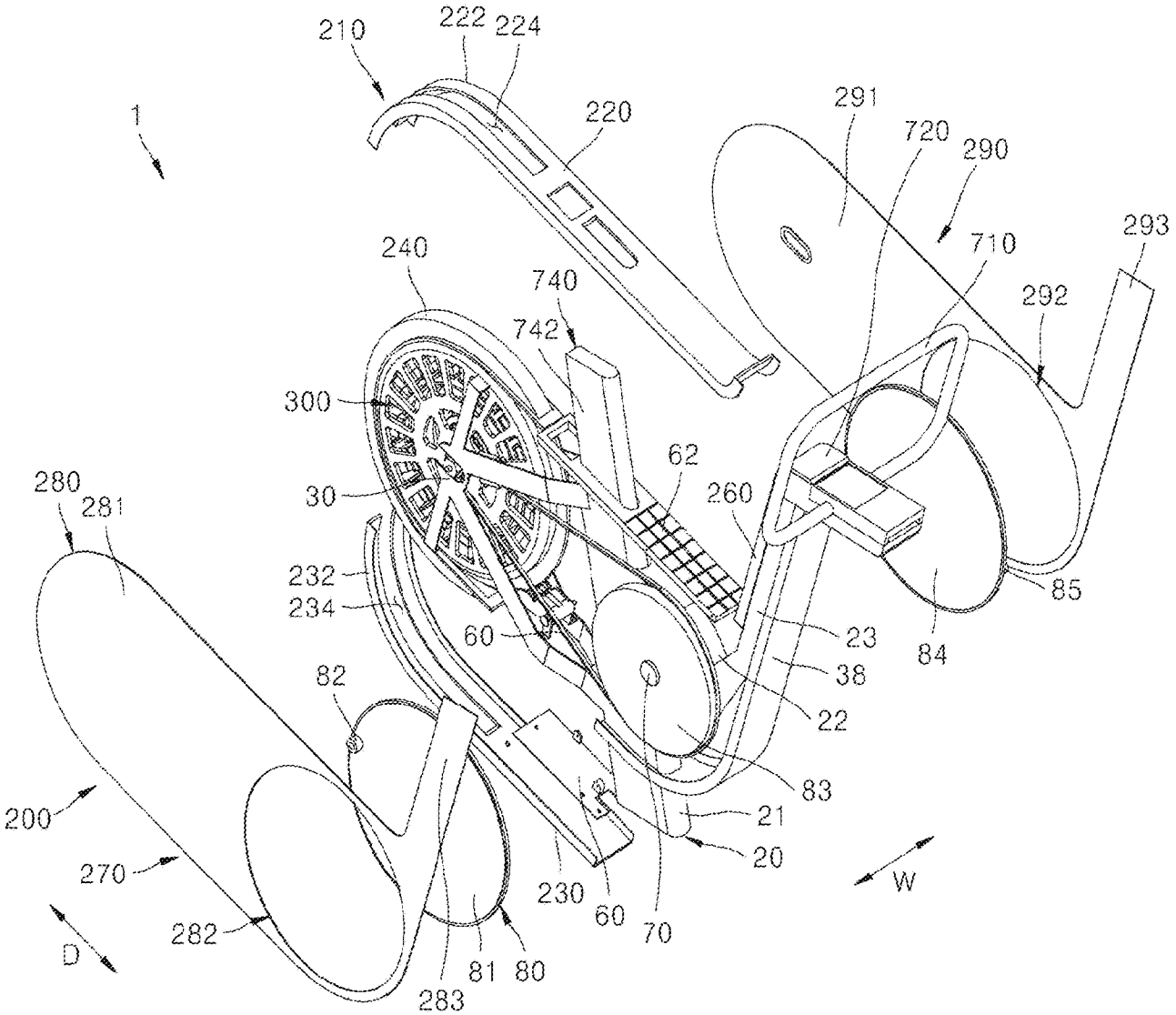

[Fig. 33]
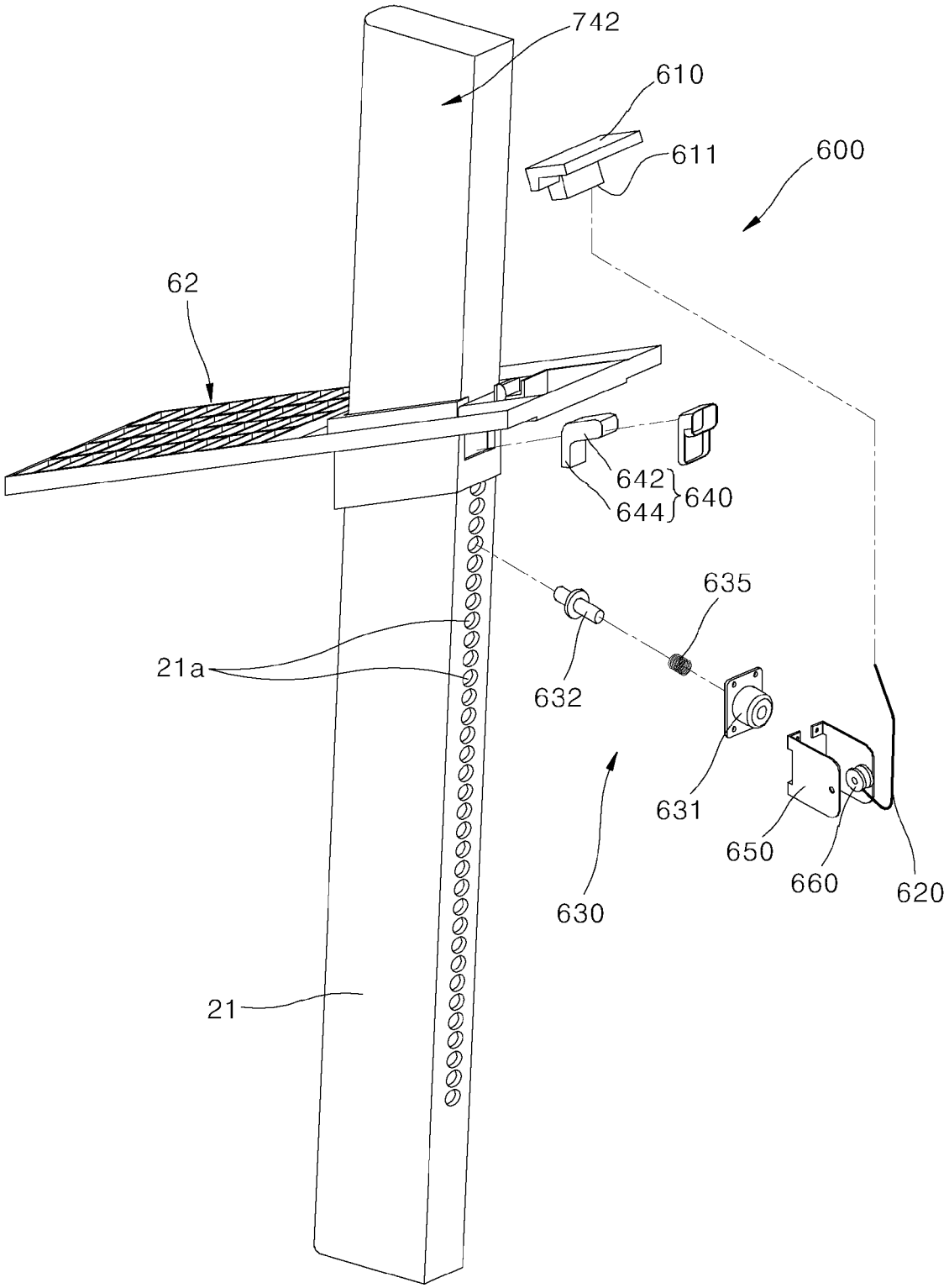

[Fig. 34]
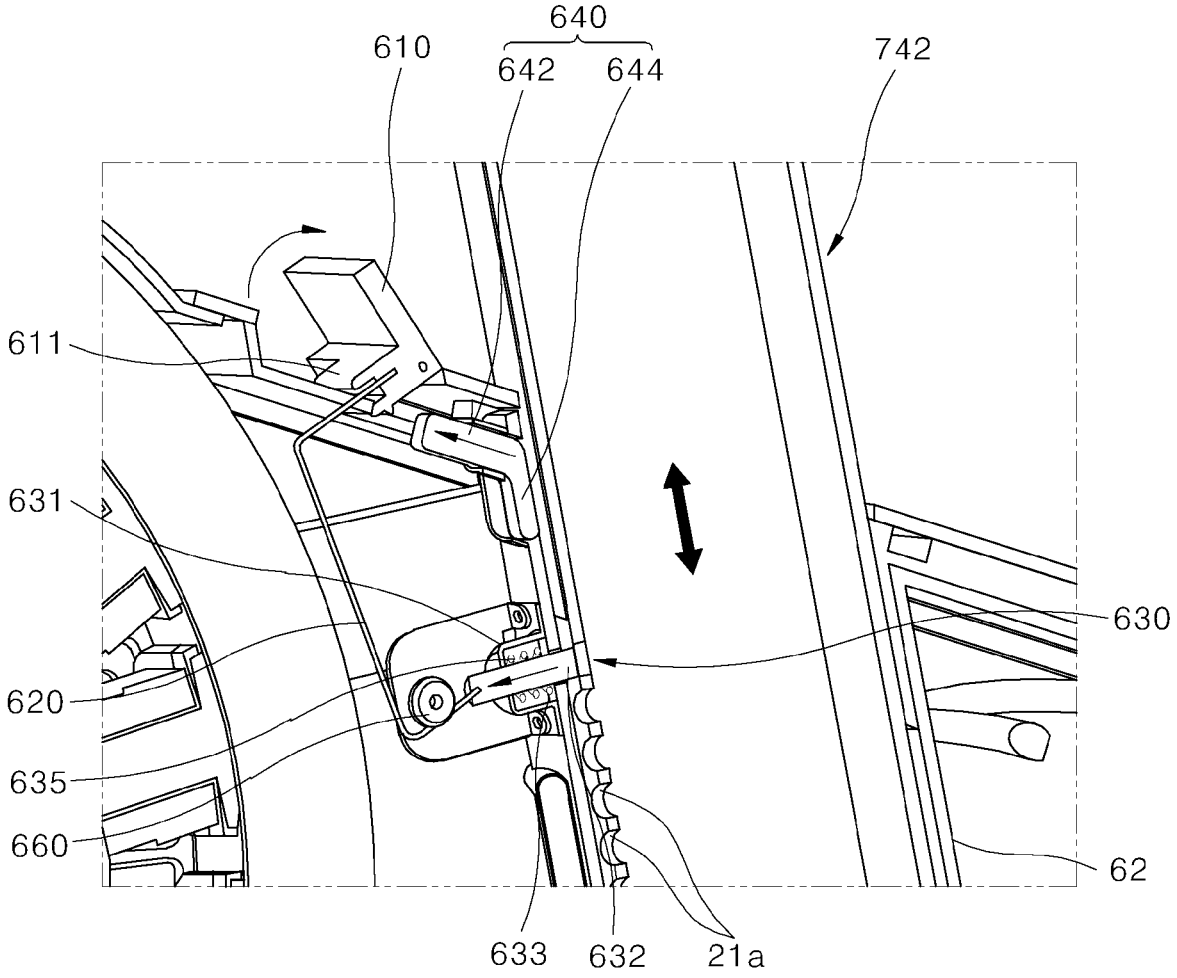

[Fig. 35]
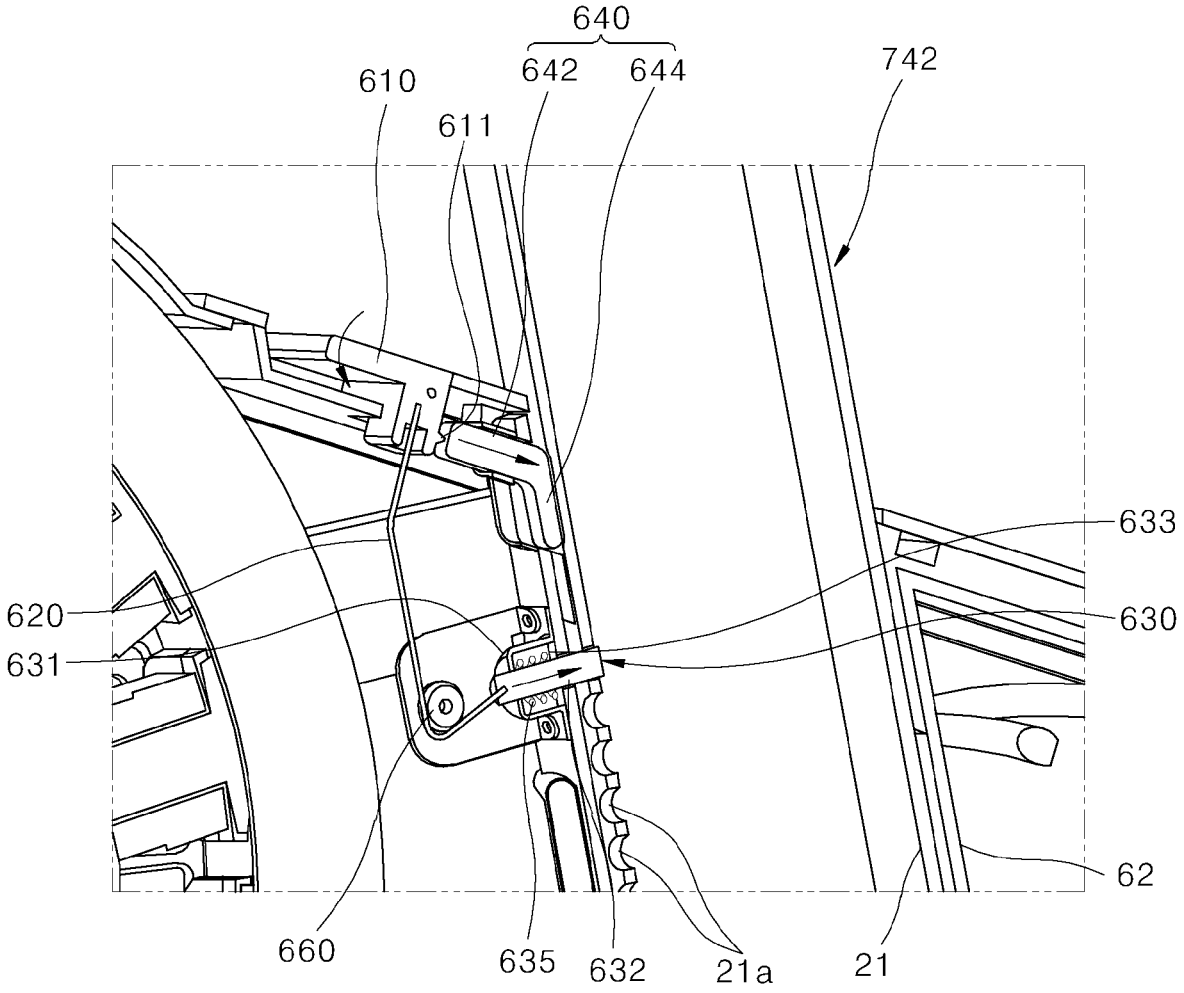

EXERCISE BIKE

CROSS REFERENCE TO RELATED APPLICATIONS

This application is the National Phase of PCT International Application No. PCT/KR2022/014274, filed on Sep. 23, 2022, which claims priority under 35 U.S.C. 119 (a) to Patent Application No. 10-2022-0056410, filed in the Republic of Korea on May 9, 2022, all of which are hereby expressly incorporated by reference into the present application.

TECHNICAL FIELD

Disclosed herein is an exercise bike, and in particular, an exercise bike in which a resistance adjusting part is disposed at the rear of a pedal and stably held by a frame part.

BACKGROUND ART

Aerobic training machines such as weight lifting equipment and cardio equipment are widely used as indoor exercise equipment for developing muscular strength.

Aerobic training machines are categorized into treadmills on which users walk or run on the track, exercise bikes that allow users to push the pedals, to build leg muscles and enable cardiovascular exercise, and steppers that produce the effect of stair climbing, and the like.

An exercise bike can be installed in a designated place, and as a user pushes the pedals, the pedals can rotate and the user can exercise. Exercise bikes can fall into spin bikes for spinning exercise, and an indoor bike that allows a user to push the pedals forward to rotate the wheels like a bike.

An indoor training bicycle device is disclosed in prior art document 1 (US Patent Publication No. US 2021-0077856 A1) and is an indoor space-fixed training bicycle device. The indoor training bicycle device includes a tilting/pivoting mechanism that determines a direction of the indoor bicycle device to simulate a downward movement or an upward movement.

Since the indoor bicycle device according to prior art document 1 can include a frame component that assists with the leftward and rightward movements of the indoor training device during travel, the side-to-side swing of an outdoor bike can be simulated under the same travel conditions.

However, in the indoor training bicycle device according to prior art document 1, a wheel part is exposed outward, imposing the risk of an accident. Additionally, according to prior art document 1, a crank arm, connecting to a pedal and rotating, is exposed outward, imposing the risk of an accident such as a jamming accident and the like.

Additionally, according to prior art document 1, a fly wheel corresponding to the wheel part and a motor assembly are installed in the state of floating in the air, and the fly wheel and the motor assembly are disposed only at the rear of a center post, making the structure unstable. Thus, in prior art document 1, since an additional structure to support the fly wheel and the motor assembly is not provided, the fly wheel is not held stably, and reliability in operation and durability of the indoor training bicycle device deteriorate.

Further, according to prior art document 1, a non-free wheel mode where the wheel part rotates together with the pedal depending on the forward rotation and the reverse rotation of the pedal, and a free wheel mode where the wheel part rotates only at a time of the forward rotation of the pedal do not switch automatically, causing inconvenience to the user, and causing the user to purchase bikes operating respectively in the non-free wheel mode and the free wheel mode and increasing installation costs.

Further, according to prior art document 1, since a rotation support shaft serving as the rotation center of the pedal is installed in a way that passes through a post extending in the up-down direction, the durability of the post deteriorates. In prior art document 1, stress transferred to the post through the rotation support shaft is delivered to the post around the rotation support shaft, making it difficult to distribute the stress, accumulating fatigue around the post where the rotation support shaft is installed and casing a fatigue fracture.

A bicycle for health is disclosed in prior art document 2 (KR Patent Publication No. 10-2016-0044915 A), and provided with a frame part and a pedal part connecting to the frame part rotatably. According to prior art document 2, the bicycle for health includes a rotation load applying part being supported by the frame part, connecting to the pedal part and applying a rotation load in relation to the pedal part's rotation, and a protective vent cover being supported by the frame part, shielding the rotation load applying part and having an air leaking part through which inner air leaks.

However, in prior art document 2, a crank arm, connecting to a pedal and rotating, is exposed outward, imposing the risk of an accident such as a jamming accident and the like. Additionally, prior art document 2 does not present a frame structure supporting a rotating wheel part and a casing at the same time. Thus, an additional support structure fixing the wheel part and the casing is required, causing an increase in manufacturing costs.

Further, according to prior art document 2, the casing surrounding the wheel part and a disc part is installed in contact with a supporter, making it difficult to clean the lower portion of the casing and manage and repair the casing.

Furthermore, according to prior art document 2, a non-free wheel mode where the wheel part rotates together with the pedal depending on the forward rotation and the reverse rotation of the pedal, and a free wheel mode where the wheel part rotates only at a time of the forward rotation of the pedal do not switch automatically, causing inconvenience to the user, and causing the user to purchase bikes operating respectively in the non-free wheel mode and the free wheel mode and increasing installation costs.

DISCLOSURE OF INVENTION

Technical Problem

The objective of the present disclosure is to provide an exercise bike that causes no difficulty in cleaning the lower portion of a casing and managing and repairing the casing, since the casing surrounding a wheel part and a disc part is disposed close to the ground surface, in the state of being contacting a supporter.

The objective of the present disclosure is to provide an exercise bike in which a wheel part and a disc part are disposed to float above the ground surface in the state where the disc part comprising the wheel part and a pedal is supported by a single support structure.

The objective of the present disclosure is to provide an exercise bike in which a wheel part rotating based on the operation of a pedal is prevented from being exposed outward.

The objective of the present disclosure is to provide an exercise bike in which a crank arm, connection to a pedal and rotating, is prevented from being exposed outward.

The objective of the present disclosure is to provide an exercise bike in which the mode of the exercise bike automatically changes to a non-free wheel mode where a wheel part rotates together with a pedal depending on a forward rotation and a reverse rotation of the pedal, and a free wheel mode where the wheel part rotates only at a time of a forward rotation of the pedal.

The objective of the present disclosure is to provide an exercise bike in which since a rotation support shaft serving as the rotation center of a pedal does not pass through a pillar extending in the up-down direction, the durability of the pillar improves.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Solution to Problem

In an exercise bike according to the present disclosure, a resistance adjusting part corresponding to a wheel, and a disc part connecting to the resistance adjusting part through a belt member are installed in the state of floating over a base part.

Specifically, a support frame part is supported by a pos having a single pillar shape, the resistance adjusting part and the disc part are rotatably disposed at the support frame part, and a housing part forming the exterior of the exercise bike is spaced from the base part and disposed at the upper side of the base part.

In the exercise bike according to the present disclosure, the resistance adjusting part, the disc part and a seat are supported by the support frame part.

Specifically, since the support frame part comprised of a single component supports the seat, a rotation support shaft disposed at the rotation center of the disc part, and the resistance adjusting part, the disc part and the resistance adjusting part are installed in the state of floating over an installation surface.

In the exercise bike according to the present disclosure, the resistance adjusting part rotating based on the operation of a pedal is not exposed outward.

Specifically, since a wheel cover part bending along a circular arc shape is disposed outside the resistance adjusting part serving as a wheel, the rotating resistance adjusting part is not exposed outward.

In the exercise bike according to the present disclosure, a crank arm, connecting to the pedal and rotating, is not exposed outward.

Specifically, the crank arm is removed, the pedal directly connects to a first outer disc and a second outer disc, and the plate-shaped disc part rotates together with the pedal.

In the exercise bike according to the present disclosure, a non-free wheel mode and a free wheel mode switch automatically.

Specifically, the non-free wheel mode in which a rotation case rotates forward based on the operation of a driving part provided at the resistance adjusting part, and the free wheel mode in which the rotation case rotates only forward based on the operation of the driving part switch automatically.

In the exercise bike according to the present disclosure, since the rotation support shaft serving as the rotation center of the pedal is disposed at an extension frame protruding to the outside of a post, the durability of the post may improve. Stress transferred through the rotation support shaft is easily distributed to the post through the extension frame, and the fatigue accumulation of the post decreases, suppressing deterioration of the durability of the post, caused by a fatigue fracture.

An exercise bike according to the present disclosure includes a base part, a support frame part, a disc part, a pedal, a resistance adjusting part and a housing part.

The base part has a plate shape and surface-contacts an installation surface.

A lower portion of the support frame part is fixed to the base part and an upper portion of the support frame part extends to an upper side of the base part and supports a handle and a seat. The support frame part includes a post, an extension frame, a first frame and a second frame. Additionally, the support frame part may further include any one of an upper frame, a lower frame, a reinforcing frame and a holding bracket.

The post extends to the upper side of the base part and has a pillar shape. The post connects to a saddle pillar provided at the seat and supports a lower portion of the saddle pillar. A lower portion of the post is fixed to the base part, and an upper portion of the post extends upward at a slant in a second direction. Additionally, the post is disposed between a rotation support shaft and a shaft that is provided at a rotation center of the resistance adjusting part. Under the assumption that a distance between the shaft and the base part is L2 and that a distance between the rotation support shaft and the base part is L1, L2 is greater than L1.

The extension frame extends in a first direction of the post and supports the rotation support shaft rotatably.

The first frame extends to an upper side of the extension frame and supports the handle.

The second frame extends in a second direction of the post and supports the resistance adjusting part. The second frame includes a first inner frame and a second inner frame.

The first inner frame extends from the post, is disposed at one side in a widthwise direction of the resistance adjusting part and supports one side of the shaft that is provided at the rotation center of the resistance adjusting part. The first inner frame includes a first support bar extending from the post that is disposed inside the housing part, in the second direction, a first connection body connecting to the first support bar and being provided with a first guide hole for inserting one side of the shaft, and a first fixing bracket extending to an upper side and a lower side of the first connection body and being fixed to an inside of the housing part.

The second inner frame extends from the post, is disposed at the other side in the widthwise direction of the resistance adjusting part and supports the other side of the shaft. The second inner frame includes a second support bar extending from the post that is disposed inside the housing part, in the second direction, a second connection body connecting to the second support bar and being provided with a second guide hole for inserting the other side of the shaft, and a second fixing bracket extending to an upper side and a lower side of the second connection body and being fixed to an inside of the housing part.

The disc part connects to the rotation support shaft that passes through the support frame part. The disc part includes a first outer disc, a second outer disc and a first inner disc.

The first outer disc connects to one side of the rotation support shaft and is inserted into a first mounting hole part that is provided at the housing part, in a state where the pedal is detachably installed. The first inner disc is fixed to an inside of the first outer disc and has an outer surface having a belt member transferring power to the resistance adjusting part. The second outer disc connects to the other side of the rotation support shaft, and is inserted into a second mounting hole part that is provided at the housing part, in a state where the pedal is detachably installed.

The resistance adjusting part receives a rotation of the disc part through a belt member, is supported by the support frame part, and adjusts resistance at a time when the pedal is rotated by magnetic force. The resistance adjusting part includes a rotation gear part, a shaft, a case part, a clutch bearing, a clutch hub, a clutch gear, a driving part, a movement gear part, a stator, and a bearing part.

The rotation gear part connects to the belt member and rotates, and has a gear along an outer circumference thereof. The case part supports the rotation gear part rotatably. The clutch bearing is disposed between the rotation gear part and the case part, and as the rotation gear part rotates forward, transfers power to the case part.

The clutch hub is fixed to an outside of the rotation gear part, and rotates together with the rotation gear part. The clutch hub includes a hub body a center of which is aligned with a center of a rotation body, is fixed to an outside of the rotation body and has a circular plate, and a first outer gear which is installed along an outer circumference of the hub body, extends in an up-down direction and has a projection shape.

The clutch gear is disposed at the clutch hub one after another and fixed to the case part. The clutch gear is installed inside a cover case in a ring shape, and includes a gear body being fixed to the cover case and a second outer gear protruding to an outside of the gear body, engaging with the movement gear part and receiving power.

The driving part is fixed to the case part and supplies power for rotation.

The movement gear part is moved by power of the driving part, and moves in a free wheel mode where the movement gear part engages with the clutch hub and in a non-free wheel mode where the movement gear part engages with the clutch hub and the clutch gear at the same time and transfers power. The movement gear part includes a first movement gear part being disposed outside the clutch hub in a ring shape, receiving power of the driving part and moving linearly, and a second movement gear part being disposed inside the first movement gear part and being provided with a gear that engages with the clutch hub and the clutch gear.

The pedal is detachably disposed at the disc part.

The housing part is disposed at the upper side of the base part in a state where the housing part is spaced from the base part, and is installed in a way that the housing part surrounds outsides of the resistance adjusting part and the support frame part. The housing part includes an upper cover part, a lower cover part, a wheel cover part, and a side frame.

The upper cover part is fixed to an upper side of the support frame part, and covers the upper side of the support frame part and an upper edge of the resistance adjusting part. The lower cover part is fixed to a lower side of the support frame part, and covers the lower side of the support frame part and a lower edge of the resistance adjusting part. The wheel cover part is installed in a way that surrounds the outside of the resistance adjusting part, is fixed to the upper cover part and the lower cover part and bends in a curved surface shape along the outside of the resistance adjusting part. The side frame is provided with a mounting hole part in which the disc part is installed and blocks both sides of the support frame part in a widthwise direction thereof. The side frame includes a first side cover part being disposed at one side of the support frame part in the widthwise direction thereof, blocking the resistance adjusting part and the belt member connecting to the resistance adjusting part and having a plate shape, and a second side cover part being disposed at the other side of the support frame part in the widthwise direction thereof and having a plate shape.

A brake device limiting movement of the rotation case includes a brake lever, a brake cable and a brake holder.

The brake lever is disposed at the support frame part or the housing part.

The brake holder connects to the brake cable that is pulled by the brake lever, and applies magnetic force and frictional force to the rotation case that is provide at the resistance adjusting part and stops the rotation case. The brake holder includes a holder body part, a hinge part, a magnet part and a friction member.

The holder body part connects to the brake cable and is disposed to correspond to the rotation case. The hinge part supports the holder body part rotatably and is fixed to the support frame part. The magnet part is disposed at the holder body part to apply magnetic force to the rotation case. The friction member is disposed at the holder body part to apply frictional force to the rotation case.

Advantageous Effects of Invention

In an exercise bike according to the present disclosure, a resistance adjusting part and a disc part are disposed in the state of floating over a base part, thereby reducing time and costs spent management and repairs of components that are disposed at the lower side of a housing part, and ensuring improvement in aesthetic qualities.

In the exercise bike, a support frame part comprised of a single component supports a seat, the disc part and the resistance adjusting part, thereby ensuring a simplified support structure, a decrease in the weight of a product and a reduction in manufacturing transportation costs.

In the exercise bike, the resistance adjusting part, rotating based on the operation of the pedal, is not exposed outward, thereby preventing an accident such as the jamming of the user's hand into the rotating resistance adjusting part, and the like.

In the exercise bike, instead of a crank arm connecting to a pedal and rotating, the disc part having a circular plate shape is used, thereby preventing an accident such as the jamming of the user's hand and the like.

In the exercise bike, a non-free wheel mode and a free wheel mode switch automatically based on the movement of a movement gear part, thereby ensuring improved convenience of the use of the exercise equipment.

In the exercise bike, the free wheel mode and the non-free wheel mode switch automatically, such that the user does not need to purchase exercise bikes that respectively operate in the free wheel mode and in the non-free wheel mode and saves purchase costs.

In the exercise bike, a brake lever is pulled to stop a rotation case, thereby forcing the rotation case to stop manually even when the exercise bike is not supplied with power or is not used.

In the exercise bike, a brake holder stops the rotation case by using magnetic force and frictional force, thereby reducing time taken to stop the rotation case and ensuring improvement in stopping force.

Specific effects are described along with the above-described effects in the section of detailed description.

BRIEF DESCRIPTION OF DRAWINGS

FIG. 1 is a perspective view showing an exercise bike of one embodiment.

FIG. 2 is a front view showing one side of the exercise bike of one embodiment in a width direction thereof.

FIG. 3 is a front view showing the other side of the exercise bike of one embodiment in the width direction thereof.

FIG. 4 is a plan view showing the exercise bike of one embodiment.

FIG. 5 is a front view showing the inner configuration of the exercise bike of one embodiment.

FIG. 6 is s perspective view showing that a resistance adjusting part separates from a brake device in the exercise bike of one embodiment.

FIG. 7 is a front view showing a support frame part of one embodiment.

FIG. 8 is a perspective view showing the support frame part of one embodiment.

FIG. 9 is a perspective view showing that a brake holder is disposed at the support frame part of one embodiment.

FIG. 10 is a perspective view showing a resistance adjusting part of one embodiment.

FIG. 11 is an exploded perspective view showing the resistance adjusting part of one embodiment.

FIG. 12 is a perspective view showing that a movement gear part of one embodiment connects to a clutch hub.

FIG. 13 is a perspective view showing that the resistance adjusting part of one embodiment operates in a free wheel mode.

FIG. 14 is a perspective view showing that the movement gear part of one embodiment is disposed at the lower side of a clutch gear.

FIG. 15 is a cross-sectional view showing that the resistance adjusting part of one embodiment operates in a free wheel mode.

FIG. 16 is a cross-sectional view showing that the resistance adjusting part of one embodiment is supplied with power in a free wheel mode.

FIG. 17 is a perspective view showing that the resistance adjusting part of one embodiment operates in a non-free wheel mode.

FIG. 18 is a perspective view showing that the movement gear part of one embodiment connects to a clutch gear.

FIG. 19 is a cross-sectional view showing that the resistance adjusting part of one embodiment operates in a non-free wheel mode.

FIG. 20 is a cross-sectional view showing that the resistance adjusting part of one embodiment is supplied with power in a non-free wheel mode.

FIG. 21 is a front view showing that a brake device is disposed at the front of the resistance adjusting part of one embodiment.

FIG. 22 is a front view showing a brake device of one embodiment.

FIG. 23 is an exploded perspective view showing the brake device of on embodiment.

FIG. 24 is a perspective view showing a brake holder of one embodiment.

FIG. 25 is a front view showing that a friction member of one embodiment is spaced from a rotation case.

FIG. 26 is a front view showing the friction member of one embodiment in contact with a rotation case.

FIG. 27 is a perspective view showing that a pedal of one embodiment separates from a disc part.

FIG. 28 is a perspective view showing a housing part of one embodiment.

FIG. 29 is an exploded perspective view showing the exercise bike of one embodiment.

FIG. 30 is a perspective view showing that a side frame separates from the housing part of one embodiment.

FIG. 31 is a perspective view showing that a side frame and an upper cover part separate from the housing part of one embodiment.

FIG. 32 is an exploded perspective view showing the housing part of one embodiment.

FIG. 33 is an exploded perspective view showing a post locking part of one embodiment.

FIG. 34 is a perspective view showing a post locking lever of one embodiment having rotated.

FIG. 35 is a perspective view showing the post locking lever of one embodiment having moved to its initial position.

MODE FOR THE INVENTION

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

When one component is described as being disposed "in the upper portion (or lower portion)" or "on (or under)" another component, one component can be directly on or under another component, and an additional component can be interposed between the two components.

When any one component is described as being "connected", "coupled", or "connected" to another component, any one component can be directly connected or coupled to another component, but an additional component can be "interposed" between the two components or the two components can be "connected", "coupled", or "connected" by an additional component.

Throughout the disclosure, each component can be provided as a single one or a plurality of ones, unless explicitly stated to the contrary.

In the disclosure, the singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereafter, an exercise bike 1 of one embodiment is described.

FIG. 1 is a perspective view showing the exercise bike 1 of one embodiment, FIG. 2 is a front view showing one side of the exercise bike 1 of one embodiment in a width direction thereof W, FIG. 3 is a front view showing the other side of the exercise bike 1 of one embodiment in the width direction thereof W, and FIG. 4 is a plan view showing the exercise bike 1 of one embodiment.

As illustrated in FIGS. 1 to 4, in the exercise bike 1 of one embedment, a housing part 200, having main components therein, floats over a base part 10. Additionally, a resistance adjusting part 300, which is rotated by a pedal 100, is disposed in a second direction T2 that is the rear of the pedal 100.

Directions in the present disclosure are described as follows. A direction toward the front of the base part 10 illustrated in FIG. 1 is defined as a first direction T1. Additionally, a direction toward the rear of the base part 10 is defined as a second direction T2.

For example, an object in the first direction T1 denotes the front of the object. Additionally, an object in the second direction T2 denotes the rear of the object. The front denotes a direction in which a handle 710 is disposed with respect to the center of the exercise bike 1, and the rear denotes a direction in which a wheel cover part 240 is disposed with respect to the center of the exercise bike 1.

Further, a length direction D is a direction that extends in the front-rear direction along the base part 10, and a width direction W is a direction across the length direction D. The width direction W is set to the left-right direction of the base part 10.

In an existing indoor bike, a rotor such as a rotating wheel and the like, and a cover surrounding the rotor are disposed close to the ground, causing deterioration in aesthetic qualities and resulting in an increase in time and costs spent repairing and replacing components installed in the bottom portion of a housing part 200.

However, in the exercise bike 1 according to the present disclosure, the resistance adjusting part 300 corresponding to a wheel is disposed higher than the pedal 100, and the housing part 200 is disposed to float over an installation surface 12. Thus, the exercise bike 1 according to the present disclosure can have more aesthetic qualities than the existing indoor bike and ensure ease of management and repairs of components further than the existing indoor bike.

Additionally, since the exercise bike 1 according to the present disclosure uses a one way clutch bearing 340, the exercise bike 1 delivers power only at a time of a forward rotation. Further, power is delivered by a movement gear part 380 operated by a driving part 370 at a time of a reverse rotation. Thus, the exercise bike 1 operates in a non-free wheel mode.

When the exercise bike 1 operates in a free wheel mode, since power is delivered through the clutch bearing 340, driving can be realized at a low level of noise, and the exercise bike 1 can have a thickness and a size that are much less than those of an existing exercise bike.

When the exercise bike 1 operates in the non-free wheel mode, a gear provided at the movement gear part 380 connects a gear of a clutch hub 350 and a gear of a clutch gear 360 to deliver power. The exercise bike 1 may be modified in various different forms within the technical scope where the exercise bike 1 controls operations in the free wheel mode and the non-free wheel mode since the driving part 370 operates to move the movement gear part 380. The resistance adjusting part 300 is installed inside the exercise bike 1, and the driving part 370 is installed in/disposed at the resistance adjusting part 300.

The movement gear part 380 moves based on the operation of the driving part 370, and the delivery of power is adjusted based on the movement gear part 380's engagement only with the clutch hub 350 or the movement gear part 380's simultaneous engagement with the clutch gear 360 and the clutch hub 350. In the exercise bike 1, the free wheel mode and the non-free wheel mode may be adjusted based on the operation of the driving part 370.

The base part 10 is formed into a plate, and disposed at the lower side of the housing part 200. The base part 10 placed on the installation surface 12 may be installed in contact with the installation surface 12. A base part 10 of one embodiment is formed into a plate and spaced from the housing part 200 forming a body of the exercise bike 1. The base part 10 may have different shapes. A housing part 200 of one embodiment comprises an exterior case 210 and a side frame 270.

FIG. 5 is a front view showing the inner configuration of the exercise bike 1 of one embodiment, FIG. 7 is a front view showing a support frame part 20 of one embodiment, FIG. 8 is a perspective view showing the support frame part 20 of one embodiment, and FIG. 9 is a perspective view showing that a brake holder 530 is disposed at the support frame part 20 of one embodiment.

As illustrated in FIGS. 1, 5, 7 to 9 and 29, the support frame part 20 may be modified in various different forms within the technical scope where the lower portion of the support frame part 20 is fixed to the base part 10 and the upper portion of the support frame part 20 extends upward from the base part 10 and supports the handle 710 and a seat 740.

The support frame part 20 has a structure for reliably supporting the resistance adjusting part 300 in the state in which the resistance adjusting part 300 functioning as a wheel is disposed at the upper side of the base part 10. A post 21 forming the center of the support frame part 20 supports the seat 740, a first frame 23 extending in the first direction T1 of the post 21 supports the handle 710, and a second frame 30 extending in the second direction T2 of the post 21 supports the resistance adjusting part 300.

Additionally, the support frame part 20 may be modified in various different forms within the technical scope where the support frame part 20 is fixed to the upper side of the base part 10 and forms the skeleton of the exercise bike 1. The support frame part 20 of one embodiment comprises a post 21, an extension frame 22, a first frame 23 and a second frame 30. Further, the support frame part 20 may further comprise at least any one of an upper frame 62, a lower frame 60, a reinforcing frame 64, and a holding bracket 66.

The post 21 may be formed into a square pipe, and extend upward from the base part 10 and pass tough the inside of the housing part 200. The lower side of the post 21 is fixed to the base part 10. The post 21 extend in the up-down direction of the frame part and may be disposed at a slant. The lower portion of a post 21 of one embodiment is fixed to the base part 10, and the upper portion extends vertically at a slant in the second direction T2. Additionally, the post 21 may be formed into a polygonal pipe or a circular pipe.

The post 21 may be installed in the form of a pillar having no vacant space therein, as a plurality of members that connect rather than a single member.

The post 21 according to the present disclosure is formed into a bean having a vacant space therein, and weights less than an ordinary steel rod, resulting a reduction in the manufacturing costs and transportation costs. Additionally, the post 21 is formed into a pipe that has an almost rectangular cross section and distributes load more easily than a pipe having a circular cross section, ensuring improve structural rigidity.

The post 21 is formed into a pillar having enough rigidity to support the load of the exercise bike 1 comprising the housing part 200. Additionally, the post 21 supports the lower portion of the seat 740. The post 21 may be inserted into a saddle pillar 742 provided at the seat 740, or the saddle pillar 742 may be inserted into the post 21.

The post 21 connects to the saddle pillar 742 provided at the seat 740 and supports the lower portion of the saddle pillar 742. Additionally, the saddle pillar 742 may slide along the post 21, and adjust the height of the seat 740. The movement of the post 21 is limited, and the post 21 is disposed in a way that the saddle pillar 742 disposed at the upper side of the post 21 can slide vertically along the post 21 at a slant.

The extension frame 22 may be modified in various different forms within the technical scope where the extension frame 22 extend from the post 21 in the first direction T1 and rotatably supports a rotation support shaft 70. An extension frame 22 of one embodiment is installed between the post 21 and the first frame 23. The rotation support shaft 70 is disposed at the extension frame 22 that extends from the post 21 in the first direction T1 where the first frame 23 is disposed.

Since the rotation support shaft 70, which is the rotation center of the pedal 100, is disposed at the extension frame 22 that protrudes to the outside of the post 21, the durability of the post 21 may improve. Stress transferred through the rotation support shaft 70 is transferred to the post 21 through the extension frame 22, ensuring ease of the distribution of the stress and a decrease in the fatigue accumulation of the post 21. Thus, deterioration of the durability of the post 21, caused by fatigue damage may be suppressed.

The first frame 23 extends to the upper side of the extension frame 22 and supports the handle 710. An external case 210 is disposed respectively at the front and rear of the first frame 23. The side frame 270 is disposed at both sides of the first frame 23 in the widthwise direction W thereof.

The second frame 30 may be modified in various different forms within the technical scope where the second frame 30 extends in the second direction T2 of the post 21 and supports the resistance adjusting part 300. In a second frame 30 of one embodiment, a plurality of square pipe-shaped members extends to the other side of the post 21. The second frame 30 of one embodiment comprises a first inner frame 40 and a second inner frame 50. The first inner frame 40 and the second inner frame 50 are symmetrically installed with the resistance adjusting part 300 therebetween.

The first inner frame 40 extends from the post 21 and is disposed at one side of the resistance adjusting part 300 in the widthwise direction W thereof. Additionally, the first inner frame 40 may be modified in various different forms within the technical scope where the first inner frame 40 supports one side of a shaft 320 disposed at the rotation center of the resistance adjusting part 300. The first inner frame 40 supports the housing part 200.

A first inner frame 40 of one embodiment comprises a first support bar 41, a first connection body 45 and a first fixing bracket 48.

The first support bar 41 may be modified in various different forms within the technical scope where the first support bar 41 extends from the post 21, disposed inside the housing part 200, in the second direction T2. A first support bar 41 of one embodiment comprises a first upper support bar 42 and a first lower support bar 43.

The first upper support bar 42 is formed into a pipe or a rectangular pipe that extends at a slant from the upper side of the post 21 to the lower side of the post 21. The first lower support bar 43 is formed into a pipe or a rectangular pipe that extends at a slant from the lower side of the post 21 to the upper side of the post 21.

The first connection body 45 connects to the first support bar 41, and is provided with a first guide hole 46 into which one side of the shaft 320 is inserted. A first connection body 45 of one embodiment connects to the first upper support bar 42 and the first lower support bar 43. Accordingly, since the first upper support bar 42 and the first lower support bar 43 are connected by the first connection body 45, the first upper support bar 42 and the first lower support bar 43 form a structurally reliable triangle structure, ensuring improved durability.

The first fixing bracket 48 extends to the upper side and the lower side of the first connection body 45 respectively and is fixed to the inside of the housing part 200. The first fixing bracket 48, extending upward from the first connection body 45 and being formed into a rod, is fixed to the lower side of the upper frame 62 or the lower side of an upper cover part 220 of the housing part 200. The first fixing bracket 48, extending to the lower side of the first connection body 45 and being formed into a rod, is fixed to the upper side of the lower frame 60 or the upper side of a lower cover part 230 of the housing part 200.

The first inner frame 40 extends from the post 21 and is disposed at one side (the left side in FIG. 29) of the resistance adjusting part 300 in the widthwise direction W thereof, and the second inner frame 50 extends from the post 21 and is disposed at the other side (the right side in FIG. 29) of the resistance adjusting part 300 in the widthwise direction W thereof. Additionally, the second inner frame 50 may be modified in various different forms within the technical scope where the second inner frame 50 supports the shaft 320 provided at the rotation center of the resistance adjusting part 300. Together with the first inner frame 40, the second inner frame 50 also supports the housing part 200.

A second inner frame 50 of one embodiment comprises a second support bar 51, a second connection body 55 and a second fixing bracket 58.

The second support bar 51 may be modified in various different forms within the technical scope where the second support bar 51 extends from the post 21 disposed inside the housing part 200 toward the rear in the second direction T2. A second support bar 51 of one embodiment comprises a second upper support bar 52 and a second lower support bar 53.

The second upper support bar 52 is formed into a pipe or a rectangular pipe that extends at a slant from the upper side of the post 21 to the lower side of the post 21. The second lower support bar 53 is formed into a pipe or a rectangular pipe that extends at a slant from the lower side of the post 21 to the upper side of the post 21.

The second connection body 55 connects to the second support bar 51 and is provided with a second guide hole 56 into which one side of the shaft 320 is inserted. A second connection body 55 of one embodiment connects to the second upper support bar 52 and the second lower support bar 53. Since the second upper support bar 52 and the second lower support bar 53 are connected by the second connection body 55, the second upper support bar 52 and the second lower support bar 53 form a structurally reliable triangle structure, ensuring improved durability.

The second fixing bracket 58 extends to the upper side and the lower side of the second connection body 55 respectively, and is fixed to the inside of the housing part 200. The second fixing bracket 58, extending to the upper side of the second connection body 55 and being formed into a rod, is fixed to the lower side of the upper frame 62 or the lower side of the upper cover part 220 of the housing part 200. The second fixing bracket 58, extending to the lower side of the second connection body 55 and being formed into a rod, is fixed to the upper side of the lower frame 60 or the upper side of the lower cover part 230 of the housing part 200.

The first inner frame 40 and the second inner frame 50 have a "K" shape to enhance their structural reliability. Additionally, together with the resistance adjusting part 300, the first inner frame 40 and the second inner frame 50 support the housing part 200, reducing assembly time and manufacturing costs.

The second frame 30 has a K-shaped frame structure, and the first fixing bracket 48, the first connection body 45, the second fixing bracket 58 and the second connection body 55 serve as a sub frame. Additionally, the first support bar 41 and the second support bar 51 serve as a main frame.

The first support bar 41 and the second support bar 51, serving as a main frame, function as a main structure of the second frame 30, and perform the functions of distributing the weight of the resistance adjusting part 300, avoiding the interference of a belt member 90 and the like.

The first fixing bracket 48 and the second fixing bracket 58, serving as a sub frame, perform the functions of supporting the housing part 200 providing a design function, and guiding a wire.

FIG. 6 is s perspective view showing that a resistance adjusting part 300 separates from a brake device 500 in the exercise bike 1 of one embodiment, and FIG. 29 is an exploded perspective view showing the exercise bike 1 of one embodiment.

As illustrated in FIGS. 6 and 29, the lower frame 60 is disposed between the second frame 30 and the lower cover part 230, and fixed to the lower side of the second frame 30. The lower frame 60 is formed into a plate, and fixed to the lower side of the second frame 30. The below-described lower cover part 230 is disposed under the lower frame 60. The lower cover part 230 may be modified in various different forms in addition to being fixed directly to the lower side of the second frame 30.

The upper frame 62 is formed into a plate that is fixed to the upper side of the extension frame 22, and the below-described upper cover part 220 is disposed at the upper side of the first frame 23. The upper cover part 220 may be modified in various different forms in addition to being fixed directly to the upper side of the first frame 23.

The rotation support shaft 70 may be modified in various different forms within the technical scope where the rotation support shaft 70 passes through the support frame part 20 and is rotatably disposed at the support frame part 20. A rotation support shaft 70 of one embodiment is disposed inside the frame part, and is installed in the horizontal direction. Both sides of the rotation support shaft 70 may connect to a disc part 80. Bothe the sides of the rotation support shaft 70 of one embodiment connect to the central portion of the disc part 80.

The rotation support shaft 70 is installed in a way that passes through the central portion of a first inner disc 83 which is rotated by the pedal 100. The disc part 80 and the resistance adjusting part 300 are connected by a power transfer member such as a belt or a chain and supplied with power. As the user pushes the pedal 100, the disc part 80 rotates, and as the disc part 80 rotates, the belt member 90 rotates, and a rotation case 322 provided at the resistance adjusting part 300 rotates.

Since the disc part 80 shields a hole part provided at the side frame 270, the user or an infant and the like can be prevented from being jammed and injured by an object that rotates together with the pedal 100.

FIG. 30 is a perspective view showing that a side frame 270 separates from the housing part 200 of one embodiment.

As illustrated in FIGS. 29 and 30, the disc part 80 connects to the rotation support shaft 70 that passes through the support frame part 20 and has a pedal 100 detachably mounted outside thereof. The disc part 80 may be modified in various different forms within the technical scope where the disc part 80 is disposed at both sides of the support frame part 20 in the widthwise direction W thereof and formed into a plate-shaped disc that connects to the rotation support shaft 70's both sides respectively. A disc part 80 of one embodiment comprises a first outer disc 81, a first inner disc 83, and a second outer disc 84.

The first outer disc 81 and the second outer disc 84 having a circular plate shape are disposed outside the disc part 80, and the pedal 100 is detachably disposed at the edges of the first outer disc 81 and the second outer disc 84. The pedal 100 is fastened to the first outer disc 81 and the second outer disc 84 while forming a right angle with the first outer disc 81 and the second outer disc 84. As the user pushes the pedal 100, the first outer disc 81 and the second outer disc 84 rotate together with the rotation support shaft 70.

The disc part 80 is formed into a circular panel. The side frame 270 is provided with a circular hole shape for installing the disc part 80. Since the disc part 80 is installed in the circular hole provided at the side frame 270, the disc part 80 may shield components inside the exercise bike 1.

Accordingly, the user, an infant and a companion pet are blocked from approaching the inside of the support frame part 20, and from being jammed into the components inside the support frame part 20 at a time of rotation of the pedal 100.

The first outer disc 81 connects to one side of the rotation support shaft 70, and is installed in the state where the pedal 100 is detachably installed and is inserted into a first mounting hole part 282 provided at the housing part 200. The first outer disc 81 is formed into a circular plate, and the outer surface of the first outer disc 81 may be provided with a reflecting surface like a mirror. Additionally, the first outer disc 81 has a first pedal mounting projection 82 for fixing the pedal 100, on the outer surface thereof.

The first pedal mounting projection 82 protrudes outward from the first outer disc 81, and has a female screw thread, thereinside, to allow a fixing projection 102 of the pedal 100 to be fastened.

The first inner disc 83 is fixed to the inside of the first outer disc 81, and the belt member 90 transferring power to the resistance adjusting part 300 is held on the outer surface of the first inner disc 83. The first inner disc 83 is formed into a circular plate, and fixed to the inside of the first outer disc 81. Accordingly, the rotation centers of the first outer disc 81 and the second inner disc are the rotation support shaft 70, and the rotation support shaft 70 of the first outer disc 81 and the second inner disc rotate together.

The second outer disc 84 connects to the other side of the rotation support shaft 70 and is inserted into a second mounting hole part 292 provided at the housing part 200 in the state where the pedal 100 is detachably installed.

The second outer disc 84 is formed into a circular plate, and has a reflecting surface like a mirror, on the outer surface thereof. Additionally, the second outer disc 84 has a second pedal mounting projection 85 for fixing the pedal 100, on the outer surface thereof.

The second pedal mounting projection 85 protrudes outward from the second outer disc 84, and has a female screw thread, thereinside, to allow the fixing projection 102 of the pedal 100 to be fastened. The outer surface of the disc part 80 and the outer surface of the side frame 270 may form the same flat surface, thereby providing aesthetic qualities.

The belt member 90 is held at the outer edge of the first inner disc 83 provided inside the disc part 80. Since the belt member 90 is held at a rotation gear part 310 of the resistance adjusting part 300, the resistance adjusting part 300 rotates as the disc part 80 rotates.

FIG. 27 is a perspective view showing that a pedal 100 of one embodiment separates from a disc part 80, and FIG. 28 is a perspective view showing a housing part 200 of one embodiment.

As illustrated in FIGS. 27 and 28, the pedal 100 is detachably disposed at the disc part 80. The pedal 100 of one embodiment is rotatably disposed outside the first outer disc 81 and the second outer disc 84. The pedal 100 is coupled to the disc part 80 in a way that the pedal 100 is rotated and coupled to a fastening groove provided at the first pedal mounting projection 82 and the second pedal mounting projection 85. The disc part 80 rotates together with the pedal 100.

FIG. 31 is a perspective view showing that a side frame 270 and an upper cover part 20 separate from the housing part 200 of one embodiment, and FIG. 32 is an exploded perspective view showing the housing part 200 of one embodiment.

As illustrated in FIGS. 29 to 32, the housing part 200 may be modified in various different forms within the technical scope where the housing part 200 is disposed at the upper side of the base part 10 in the state in which the housing part 200 is spaced from the base part 10 and installed in a way that surrounds the outsides of the resistance adjusting part 300 and the support frame part 20. The housing part 200 of one embodiment comprises an external case 210 and a side frame 270.

The external case 210 may be modified in various different forms within the technical scope where the external case 210 is installed in a way that surrounds the lower side of the lower frame 60, the upper side of the upper frame 62 and the outer side of the resistance adjusting part 300. An external case 210 of one embodiment comprises an upper cover part 220, a lower cover part 230, a wheel cover part 240, a front case 250 and a protective case 260.

The external case 210 is installed in a way that surrounds the upper side and the lower side of the support frame part 20 and the outer side of the resistance adjusting part 300, and installed at the upper side, the lower side and the lateral surface with respect to the support frame part 20. The side frame 270 is disposed at both sides of the support frame part 20 in the widthwise direction W thereof.

The upper cover part 220 may be modified in various different forms within the technical scope where the upper cover part 220 is fixed to the upper side of the upper frame 62 and covers the upper side of the support frame part 20 and the upper edge of the resistance adjusting part 300. An upper cover part 220 of one embodiment comprises an upper guide 222 and an upper mounting hole 224.

The upper guide 222 extending from the body of the upper cover part 220 is installed in a way that surrounds the upper edge of the resistance adjusting part 300. The upper guide 222 is comprised of two curved projections forming curved surfaces and has an upper mounting hole 224, thereinside, to allow the edge of the resistance adjusting part 300 to protrude.

The lower cover part 230 is modified in various different forms within the technical scope where the lower cover part 230 is fixed to the lower side of the lower frame 60 and covers the lower side of the support frame part 20 and the lower edge of the resistance adjusting part 300. A lower cover part 230 of one embodiment comprises a lower guide 232 and a lower mounting hole 234.

The lower guide 232 extending from the body of the lower cover part 230 is installed in a way that the lower guide 232 surrounds the lower edge of the resistance adjusting part 300. The lower guide 232 is comprised of two curved projections forming a curved surface, and has the lower mounting hole 234 for allowing the edge of the resistance adjusting part 300 to protrude, thereinside.

The wheel cover part 240 may be modified in various different forms within the technical scope where the wheel cover part 204 is installed in a way that surrounds the outside of the resistance adjusting part 300 and fixed to the upper cover part 220 and the lower cover part 230. A wheel cover part 240 of one embodiment is coupled to the upper cover part 220 and the lower cover part 230, while bending, in the form of a curved surface, along the outside of the resistance adjusting part 300. The wheel cover part 240 is disposed respectively in the upper mounting hole 224 and the lower mounting hole 234.

The lower frame 60 is bolt-fastened to the lower portion of the second frame 30, and the upper frame 62 is bolt-fastened to the upper portion of the first frame 23. Additionally, the upper cover part 220 is bolt-fastened to the upper portion of the upper frame 62, and the lower cover part 230 is bolt-fastened to the lower portion of the lower frame 60.

The wheel cover part 240 is bolt-fastened to the upper cover part 220 and the lower cover part 230, and the front case 250 and the protective case 260 are bolt-fastened to the first frame 23. Additionally, a first side cover part 280 and a second side cover part 290 are respectively attached to one side and the other side of the support frame part 20 and the external case 210 in the widthwise direction W thereof.

The side frame 270 is modified in various different forms within the technical scope where the side frame 270 has a mounting hole part in which the disc part 80 is installed and shields both sides of the support frame part 20 in the widthwise direction W thereof. A side frame 270 of one embodiment is coupled to both of the open lateral surfaces of the support frame part 20. The external case 210 is disposed in the portions of the edges of the upper side, the lower side and the lateral surface of the housing part 200, and the side frame 270 is disposed at both the sides of the housing part 200 in the widthwise direction W thereof.

If a component installed inside the exercise bike 1 fails, the component may be managed and repaired only by disassembling the side frame 270. Additionally, in the exercise bike 1, the disc part 80 connecting the pedal 100 part and the rotation support part 70 is installed in the form of a circular plate, maximizing visual effects.

The side frame 270 is formed into a plate, and detachably disposed at the support frame part 20's both lateral surfaces. The side frame 270 is detachably disposed the support frame part 20's both lateral surfaces, using a fixing method such as a bolt or a fitting method and the like, and the side frame 270 may be easily disassembled from the support frame part 20 only by unfastening a bolt.

Additionally, the support frame part 20 may have various shapes depending on the load distribution and structure of the exercise bike 1.

The side frame 270 has a single panel structure, and is detachably disposed at both the sides of the support frame part 20 in the widthwise direction W thereof. Accordingly, after the side frame 270 is detached, the components of the exercise bike 1 may be easily replaced and repaired.

In the state where the side frame 270 is detached, the adjustment of the tension of the belt member 90 and the wiring of the brake and the like may be readily performed. Further, in the state where the side frame 270 is detached, the controller 700 and the power cables inside the exercise bike 1 may be repaired and organized quickly and readily.

The side frame 270 of one embodiment comprises a first side cover part 280 and a second side cover part 290.

The first side cover part 280 may be modified in various different forms within the technical scope where the first side cover part 280 is disposed at one side of the support frame part 20 in the widthwise direction W thereof and shields the resistance adjusting part 300 and the belt member 90 connecting to the resistance adjusting part 300. A first side cover part 280 of one embodiment is formed into a plate, and comprises a first cover body 281, a first mounting hole part 282 and a first extension panel 283.

The first cover body 281 extends in the lengthwise direction D of the support frame part 20, and is formed into a plate-shaped panel that shields one side of the support frame part 20 in the widthwise direction W thereof. The first cover body 281 shields one side of the exercise bike 1 in the widthwise direction W thereof. The first cover body 281 is detachably disposed at one side of the support frame part 20 or the external case 210 in the widthwise direction W thereof.

The first mounting hole part 282 forms a hole to dispose the disc part 80, at the first cover body 281 facing the disc part 80. The first mounting hole part 282 has an inner diameter greater than or the same as the outer diameter of the first outer disc 81, to disposed the first outer disc 81.

The first extension panel 283 extends upward from the first cover body 281 and shields one side of the first frame 23 in the widthwise direction W thereof. The first extension panel 283 is formed into a plate like the first cover body 281, and integrated with the first cover body 281.

The second side cover part 290 may be modified in various different forms within the technical scope where the second side cover part 290 is disposed at the other side of the support frame part 20 in the widthwise direction W thereof and shields the resistance adjusting part 300 and the components installed inside the exercise bike 1. A second side cover part 290 of one embodiment is formed into a plate and comprises a second cover body 291, a second mounting hole part 292 and a second extension panel 293.

The second cover body 291 extends in the lengthwise direction D of the support frame part 20 and is a plate-shaped panel that shields the other side of the support frame part 20 in the widthwise direction W thereof. The second cover body 291 shields the other side of the exercise bike 1 in the widthwise direction W thereof. The second cover body 291 is detachably disposed at the other side of the support frame part 20 or the external case 210 in the widthwise direction W thereof.

The second mounting hole part 292 forms a hole to dispose the disc part 80, at the second cover body 291 facing the disc part 80. The second mounting hole part 292 has an inner diameter greater than or the same as the outer diameter of the second outer disc 84, to dispose the second outer disc 84.

The second extension panel 293 extends upward from the second cover body 291 and shields the other side of the first frame 23 in the widthwise direction W thereof. The second extension panel 293 is formed into a plate like the second cover body 291, and integrated with the second cover body 291.

As illustrated in FIGS. 2 and 29, the hosing part 200 surrounding the resistance adjusting part 300 and the disc part 80 is supported by the support frame part 20 and floats over the base part 10. The housing part 200 may be installed in a lying "¬" shape.

With respect to the support frame part 20, the hosing part 200, which is disposed in the second direction T2 that is the rear of the support frame part 20, comprises a wheel cover part 240. Additionally, the housing part 200 at the rear of the support frame part 20 extends toward the first direction T1 that is the front of the support frame part 20. Since the hosing part 200 at the rear of the support frame part 20 inclines downward toward the first direction T1, a distance between the lower portion of the housing 200 and the base part 10 gradually decreases along the first direction T1.

A point at which the distance between the housing part 100 and the base part 10 is shortest is at the front of the support frame part 20. The point at which the distance between the housing part 100 and the base part 10 is shortest is at the lower side of the disc part 80. That is, the lowermost end of the housing part 200 is disposed at a position overlapping the position of the post 21 or disposed in the first direction T1 of the post 21.

The housing part 200 at the front of the disc part 80 extends upward at a slant and supports the handle 710.

The housing part 200 extends respectively in the first direction T1 and the second direction T2 that are the front and the rear with respect to the portion where the disc part 80 is installed, and the center of gravity of the hosing part 200 is aligned to the support frame part 20 or placed near the support frame part 20.

Since the center of gravity of the support frame part 20 and the center of gravity of the housing part 200 are aligned to the support frame part 20 or placed near the support frame part 20, an inner support part and the housing part 200 are reliably supported by the support frame part 20, in the state of floating in the air.

The center of the resistance adjusting part 300 is disposed higher than the center of the disc part 80, and since the disc part 80 is disposed in the first direction T1 with respect to the post 21 while the resistance adjusting part 300 is disposed in the second direction T2, the exercise bike 1 has a stable structure.

Since the disc part 80 rotating together with the pedal 100 is supported by the rotation support shaft 70 as the pedal 100 rotates, a large amount of force is given to the rotation support shaft 70 disposed in the first direction T1 of the post 21.

Additionally, since the resistance adjusting part 300 weighing more than the other components is disposed in the second direction T2, proper weight distribution is ensured at both the front and rear sides with respect to the post 21.

Further, the housing part 200 forming the exterior of the exercise bike 1 also inclines downward from the resistance adjusting part 300 to the disc part 80, and the housing part 200 for supporting the handle 710 inclines upward. Accordingly, the center of gravity of the housing part 200 is aligned to the post 21 or placed near the post 21.

When the housing part 200 is supported by the support frame part 20 comprising the post 21, in the state of floating in the air, the housing part 200 has a stable structure without an additional reinforcing member.

FIG. 10 is a perspective view showing a resistance adjusting part 300 of one embodiment, and FIG. 11 is an exploded perspective view showing the resistance adjusting part 300 of one embodiment.

As illustrated in FIGS. 10 and 11, the resistance adjusting part 300 may be modified in various different forms within the technical scope where the resistance adjusting part 300 receives the rotation of the disc part 80 through the belt member 90 and is supported by the support frame part 20.

The resistance adjusting part 300 adjusts resistance that is generated as the resistance adjusting part 300 rotates the pedal 100 by itself. The resistance adjusting part 300 may be modified in various different forms within the technical scope where the resistance adjusting part 300 is disposed inside the side frame 270 and rotatably disposed at the second frame 30 of the support frame part 20. The resistance adjusting part 300 rotates together with the disc part 80.

The resistance adjusting part 300 rotates as the pedal 100 rotates, and has an electromagnet thereinside. As the intensity of the electromagnet provided in the resistance adjusting part 300 is adjusted, the magnitude of force required for the rotation of the resistance adjusting part 300 may be adjusted. Thus, the exercise intensity of the exercise bike 1 may be adjusted.

The resistance adjusting part 300 provided in the exercise bike 1 may operate in a free wheel mode and a non-free wheel mode. The operation mode of the resistance adjusting part 300 changes to the free wheel mode and the non-free wheel mode, based on the operation of the driving part 370 using a motor.

The resistance adjusting part 300 of the exercise bike 1 uses a one way clutch bearing 340, and transfers power only at a time of a forward rotation. Additionally, since a gear transferring power moves as the driving part 370 provided in the resistance adjusting part 300 operates, power is transferred even at a time of a reverse rotation of the pedal 100, and the resistance adjusting part 300 may operate in the non-free wheel mode in which the resistance adjusting part 300 rotates in a reverse direction.

The exterior of the resistance adjusting part 300 is formed into a circular plate, and is rotatably supported by the second frame 30.

The rotation gear part 310 rotates in connection with the belt member 90, and is provided with a gear, along the outer circumference thereof. The rotation gear part 310 is supplied with power of the pedal 100 part through the belt member 90 to rotate, and the shaft 320 passes through the center of the rotation gear part 310 and is supported by the second frame 30. A rotation gear part 310 of one embodiment comprises a pulley member 312 and a rotation body 314.

The pulley member 312 connects to the belt member 90 and receives power of the pedal 100 part to rotate. Since a gear is provided along the outer circumference of the pulley member 312, the slip of the pulley member 312 held at the outside of the pulley member 312 may decrease. The pulley member 312 is disposed outside a case part 330 and receives power of the pedal 100 part through the belt member 90.

The rotation body 314 extends from the pulley member 312 to the inside of the case part 330 and rotates together with the pulley member 312. A rotation body 314 of one embodiment is formed into a pipe.

The rotation gear part 310 is installed at the case part 330, and receives power of the pedal 100 member and rotates. The shaft 320 is installed in the rotation gear part 310. Both sides of the shaft 320 are coupled to an inner frame in a way that the shaft 320 does not rotate. The rotation gear part 310 is fitted to the outside of the shaft 320. The rotation gear part 310 is installed in a way that the rotation gear part 310 and the shaft 20 form a concentric circle. A shaft bearing 424 is installed between the shaft 320 and the rotation gear part 310. Accordingly, when the rotation gear part 310 is rotated by the belt member 90, the shaft 320 does not rotate.

The shaft 320 passes through the rotation gear part 310 and is installed in the horizontal direction and is fixed to the housing part 200. A shaft 320 of one embodiment is formed into a rod, and installed in a way that penetrates the rotation center of the case part 330.

FIG. 21 is a front view showing that a brake device 500 is disposed at the front of the resistance adjusting part 300 of one embodiment.

As illustrated in FIG. 21, the post 21 is disposed between the rotation support shaft 70 and the shaft 320 that is provided at the rotation center of the resistance adjusting part 300. Since the rotation support shaft 70 and the shaft 320 are installed with the post 21 therebetween, the housing part 200, the disc part 80, the resistance adjusting part 300 and the seat 740 are supported by the post 21 in the state of floating at the upper side spaced from the base part 10.

If the rotation support shaft 70 and the shaft 320 are disposed at one side of the post 21 or at the other side of the post 21, the center of gravity of the exercise bike 1 is biased toward one side or the other side of the post 21. Accordingly, the disc part 80, the resistance adjusting part 300 and the like, comprising the housing 200, may not be supported only by the post 21, and an additional reinforcing member needs to be installed, causing an increase in manufacturing costs and an increase in the weight and transportation costs of a product.

Additionally, since the resistance adjusting part 300 serving as a wheel is disposed higher than the disc part 80 connecting to the pedal 100 and rotating, the structural reliability of the exercise bike 1 improves.

Suppose that a distance between the shaft 320 and the base part 10 is referred to as L2 and that a distance between the rotation support shaft 70 and the base part 10 is referred to as L1. Distance L2 is greater than distance L1. As a result, the shaft 320 is disposed higher than the rotation support shaft 70. Thus, the resistance adjusting part 300 rotating around the shaft 320 is disposed higher than the disc part 80 rotating around the rotation support shaft 70.

Additionally, a virtual line connecting the shaft 320 and the rotation support shaft 70 is across the post 21 forming a support pillar. The shaft 320 is disposed higher than the rotation support shaft 70. With respect to the post 21, the rotation support shaft 70 and the handle 710 are installed in the first direction T1, and the resistance adjusting part 300 comprising the shaft 320 is installed in the second direction T2. The post 21 supports the lower portion of the seat 740, in the state of inclining toward the second direction T2, and the housing part 200 surrounding the resistance adjusting part 300, the disc part 80 and the like is fixed to the support frame part 20 comprising the post 21, in the state of inclining downward toward the first direction T1. Since the exercise bike having the above structure is supported by the post 21 that serves as one support pillar, main components such as the resistance adjusting part 300, the disc part 80 and the like are installed in the state of floating in the air.

As illustrated in FIG. 11, the case part 330 may be modified in various different forms within the technical scope where the case part 330 rotatably supports the rotation gear part 310 and is installed inside the housing part 200. A case part 330 of one embodiment comprises a rotation case 332 and a fixation case 334.

The rotation case 332 rotates together with the clutch gear 360, and is supplied with power for rotation based on a forward rotation through the clutch bearing 340. The rotation case 332 comprises a rotation case 332 that rotates, and a fixation case 334 that is fixed to the support frame part 20. The rotation case 332 may be modified in various different forms within the technical scope where the rotation case 332 is installed in a way that the rotation case 332 surrounds the clutch bearing 340 and the movement gear part 380.

The rotation case 332 may be installed in a way that surrounds the outer edge of the fixation case 334, and the rotation of a projection, protruding outward along the outer circumference of the rotation case 332, may be limited by the brake device 500.

The rotation case 332 is installed in a way that the rotation gear part 310 and the shaft 320 pass through the center of the rotation case 332 and installed rotatably. The rotation case 332 is shaft-coupled to the rotation gear part 310 and rotates in the free wheel mode and the non-free wheel mode. The rotation gear part 310 is coupled to the rotation center of the rotation case 332.

When the rotation gear part 310 rotates forward in the free wheel mode, the rotation case 332 rotates forward, and when the rotation gear part 310 rotates reversely, the rotation case 332 does not rotate. When the rotation gear part 310 rotates reversely in the free wheel mode, the rotation case 332 does not rotate, and the rotation gear part 310 idles at the rotation case 332.

When the rotation gear part 310 rotates forward or reversely in the non-free wheel mode, the rotation case 332 rotates. In the non-free wheel mode, since power input through the rotation gear part 310 is transferred to the rotation case 332 through the movement gear part 380, the rotation case 332 rotates together with the rotation gear part 310.

The fixation case 334 supports the driving part 370 and is installed in an open portion of the rotation case 332. The fixation case 334 may be modified in various different forms within the technical scope where the fixation case 334 is installed in a way that shields the open portion of the rotation case 332, and is fixed to the second frame 30 such that the rotation of the fixation case 332 is limited.

A rotation case 332 of one embodiment comprises an outer case 333 and an inner rib 336. The rotation gear part 310 is rotatably coupled to the rotation case 332. The rotation case 332 may be entirely formed into a circular plate. The rotation gear part 310 passes through the central portion of the rotation case 332. The outer case 333 is formed in the circumferential portion of the rotation case 332 to surround a stator 410 described below.

The outer case 333, protruding from the edge of the rotation case 332 perpendicularly, is installed in a ring shape, and faces the outer side of the edge of the fixation case 334.

The inner rib 336 is installed inside the outer case 333. The inner rib 336 and the outer case 333 are installed in a ring form, and the diameter of the inner rib 336 is less than the diameter of the outer case 333. Additionally, the stator 410 and a wheel bearing part 422 are installed between the outer case 333 and the inner rib 336. The inner rib 336 protrudes from the inside of the rotation case 332 toward the fixation case 334.

The wheel bearing part 422 is installed between an inner case 335 of the below-described fixation case 334 and the inner rib 336.

The fixation case 334 is formed into a circular plate, and the inner case 335 extends from the fixation case 334 in a ring shape. The diameter of the inner case 335 is greater than the diameter of the inner rib 336 and less than the diameter of the outer case 333.

Accordingly, the stator 410 is disposed between the outer case 333 and the inner case 335, and the wheel bearing part 422 is disposed between the inner case 335 and the inner rib 336. As the rotation case 332 rotates in the state where the rotation of the fixation case 334 is limited, friction is reduced by the wheel bearing part 422 installed between the rotation case 332 and the fixation case 334.

The clutch bearing 340 may be modified in various different forms within the technical scope where the clutch bearing 340 is installed between the rotation gear part 310 and the case part 330, and delivers power to the case part 330 as the rotation gear part 310 rotates forward.

The clutch bearing 340 is disposed between the rotation case 332 and the rotation gear part 310. The rotation case 332 may have a ring-shaped mounting groove on which the clutch bearing 340 is mounted, in the central portion thereof. The mounting groove forms a concentric circle together with the rotation gear part 310 and the rotation case 332. The clutch bearing 340 is a one way bearing that allows a one way rotation of the rotation gear part 310. The clutch bearing 340 delivers power to allow the rotation gear part 310 and the rotation case 332 to rotate together as the rotation gear part 310 rotates forward. As the rotation gear part 310 rotates reversely, the rotation gear part 310 only rotates and delivers no power to the rotation case 332.

The clutch bearing 340 rotates the rotation case 332 and allows of the free wheel mode of the rotation case 332 only when the rotation gear part 310 rotates forward. The clutch bearing 340 is formed in a way that a bearing (not illustrated) is interposed between an inner wheel (not illustrated) and an outer wheel (not illustrated). As the clutch bearing 340 rotates forward, the bearing limits the inner wheel and the outer wheel and rotates together with the inner wheel and the outer wheel integrally. As the clutch bearing 340 rotates reversely, the inner wheel and the outer wheel are released from the bearing's limit. The bearing may have various shapes such as a sphere, a circular rod and the like. The clutch bearing 340 may be modified in various different forms within the technical scope where the clutch bearing 340 rotates the rotation case 332 only when the rotation gear part 310 rotates forward.

The clutch hub 350 may be modified in various different forms within the technical scope where the clutch hub 350 is fixed to the outside of the rotation gear part 310 and rotates together with the rotation gear part 310. The clutch hub 350 is coupled to the outside of the rotation gear part 310. The clutch hub 350 is installed in a way that the clutch hub 350 forms a concentric circle together with the rotation gear part 310. The clutch hub 350 has a first outer gear 354, in the circumferential portion thereof.

The first outer gear 354 is an external gear that is formed along the outer circumferential surface of the clutch hub 350. The clutch hub 350 rotates around the center of the rotation gear part 310 together with the rotation gear part 310 but is fixed to the rotation gear part 310 not to move in the axial direction of the rotation gear part 310. At this time, the rotation gear part 310 is press-fitted to the central portion of the clutch hub 350 or gear-coupled to the central portion of the clutch hub 350. The clutch hub 350 may be formed into a circular disc.

A clutch hub 350 of one embodiment comprises a hub body 352 and a first outer gear 354. The center of the hub body 352 is aligned with the center of the rotation body 314, and is formed into a circular plate and fixed to the outside of the rotation body 314.

The first outer gear 354 is disposed along the outer circumference of the hub body 352 and is a projection-shaped gear that extends in the up-down direction.

The clutch gear 360 may be modified in various different forms within the technical scope where the clutch gear 360 is disposed at the clutch hub 350 one after another and fixed to the case part 330. A clutch gear 360 of one embodiment is fixed to the rotation case 332 and rotates together with the rotation case 332. The clutch gear 360 is disposed in a ring shape, and the clutch gear 360 and the rotation gear part 310 have the same center. Additionally, the clutch gear 360 and the rotation case 332 have the same center. The clutch gear 360 of one embodiment comprises a gear body 362 and a second outer gear 364.

The gear body 362 is installed inside the rotation case 332 in a ring shape and fixed to the rotation case 332. The gear body 362 rotates together with the rotation case 332 in the state of being fixed to the rotation case 332.

The second outer gear 364 protrudes outward from the gear body 362, and engages with the movement gear part 380 and receives power. The second outer gear 364 is provided with a gear that has an inclined surface in a direction toward the clutch hub 350 to engage with a second movement gear part 400 provided at the movement gear part 380.

As illustrated in FIG. 12, a second outer gear 364 of one embodiment comprises a first linear gear 366 and a first inclined gear 368. The first linear gear 366 protrudes along the circumference of the gear body 362 that extends in a ring shape, and extends in the up-down direction.

The first inclined gear 368 is an inclined surface that is formed in the end portion of the first linear gear 366. When the first outer gear 354 of the clutch hub 350 is disposed at the lower side of the second outer gear 364, the first inclined gear 368 connects to the lower side of the first linear gear 366.

The first inclined gear 368 has a longitudinal cross section of a right-angled triangle. The first inclined gear 368 forms an inclined surface that is inclined toward the clutch hub 350. A plurality of first inclined gears 368 is disposed along the circumference of the gear body 362, and has the same slant angle.

The second outer gear 364 having the above-described shape engages with an inner gear 406 that is described below, and delivers power.

As illustrated in FIG. 11, the driving part 370 may be modified in various different forms within the technical scope where the driving part 370 is fixed to the case part 330 and supplies power for rotation to move the movement gear part 380. A driving part 370 of one embodiment comprises a driving body 372 and an output shaft 374. The driving part 370 may further comprise a motor bracket 376 and a motor case 378.

The driving body 372 is fixed to the fixation case 334 and supplies power for rotation. The driving body 372 may be directly fixed to the fixation case 334, or fixed to the fixation case 334 by using the motor bracket 376 and the motor case 378. The motor bracket 376 is fixed to the fixation case 334 while surrounding one side of the driving body 372. The motor case 378 forms an inner space for inserting the driving body 372 and is fixed to the fixation case 334.

The driving body 372 uses a motor, and the output shaft 374 protruding outward from the driving body 372 rotates as the driving body 372 operates. The output shaft 374 protrudes outward from the driving body 372, rotates based on the operation of the driving body 372, and connects to the movement gear part 380 to move the movement gear part 380. An output shaft 374 of one embodiment is formed into a ball screw bar and gear-coupled to the movement gear part 380. Since the movement gear part 380 is installed in the state where the rotation of the movement gear part 380 is limited, the movement gear part 380 moves linearly as the output shaft 374 rotates.

The movement gear part 380 is moved by power of the driving part 370, and moved in the free wheel mode where the movement gear part 380 engages with the clutch hub 350 and in the non-free wheel mode where the movement gear part 380 engages with the clutch hub 350 and the clutch gear 360 at the same time and delivers power.

The movement gear part 380 is disposed outside the clutch hub 350, and delivers power by engaging only with the clutch hub 350 or engaging with the clutch hub 350 and the clutch gear 360 at the same time.

FIG. 12 is a perspective view showing that a movement gear part 380 of one embodiment connects to a clutch hub 350, FIG. 13 is a perspective view showing that the resistance adjusting part 300 of one embodiment operates in a free wheel mode, FIG. 14 is a perspective view showing that the movement gear part 380 of one embodiment is disposed at the lower side of a clutch gear 360, FIG. 15 is a cross-sectional view showing that the resistance adjusting part 300 of one embodiment operates in a free wheel mode, and FIG. 16 is a cross-sectional view showing that the resistance adjusting part 300 of one embodiment is supplied with power in a free wheel mode.

As illustrated in FIGS. 12 to 16, as the movement gear part 380 engages only with the clutch hub 350, power for rotating the pedal 100 forward is delivered to the rotation case 332 through the rotation gear part 310 and the clutch bearing 340, and the rotation case 332 rotates. Additionally, since power for rotating the pedal 100 reversely rotates the rotation gear part 310, the clutch hub 350, and the second movement gear part 400 of the movement gear part 380 only, power for rotation is not delivered to the rotation case 332. Thus, only when the rotation gear part 310 rotates forward, the rotation of the clutch bearing 340 and the rotation of the rotation case 332 are synchronized, and the resistance adjusting part 300 operates in the free wheel mode.

FIG. 17 is a perspective view showing that the resistance adjusting part 300 of one embodiment operates in a non-free wheel mode, FIG. 18 is a perspective view showing that the movement gear part 380 of one embodiment connects to a clutch gear 360, FIG. 19 is a cross-sectional view showing that the resistance adjusting part 300 of one embodiment operates in a non-free wheel mode, and FIG. 20 is a cross-sectional view showing that the resistance adjusting part 300 of one embodiment is supplied with power in a non-free wheel mode.

As illustrated in FIGS. 17 to 20, when the movement gear part 380 engages with the clutch hub 350 and the clutch gear 360 at the same time and synchronizes the rotation of the clutch hub 350 and the rotation of the clutch gear 360, the movement gear part 380 operates in the non-free wheel mode. The pedal 100's power in the non-free wheel mode is delivered to the rotation gear part 310, the clutch hub 350, the second movement gear part 400 and the clutch gear 360 consecutively. Additionally, in relation to power for forward rotation, the pedal 100's power may be delivered to the rotation gear part 310, the clutch bearing 340, and the rotation case 332 consecutively. The second movement gear part 400, engaging with the clutch hub 350 and the clutch gear 360 at the same time, delivers power for reverse rotation as well as power for forward rotation and operates in the non-free wheel mode.

As illustrated in FIG. 11, the movement gear part 380 of one embodiment comprises a first movement gear part 390 and a second movement gear part 400. The first movement gear part 390 may be modified in various different forms within the technical scope where the first movement gear part 390 is disposed outside the clutch hub 350 in a ring shape, and is supplied with power of the driving part 370 and moves linearly. A first movement gear part 390 of one embodiment comprises a first assembly gear 392 and a second assembly gear 396.

The first assembly gear 392 and the second assembly gear 396 are assembled mutually in a ring shape. The first assembly gear 392 is disposed at one side of the clutch hub 350 and moves as the driving part 370 operates. The first assembly gear 392 extends in a curved line shape, and has a first coupling projection 394 that is inserted into a coupling groove part 404 provided outside the second movement gear part 400, thereinside.

Additionally, an extension member 395, protruding outward from the first assembly gear 392, is provided with a female screw hole, and the output shaft 374 provided at the driving part 370 is inserted into the female screw hole provided at the extension member 395 and gear-connected to the extension member 395. Thus, the first assembly gear 392 comprising the extension member 392 moves upward or downward depending on a direction of the rotation of the output shaft 374.

The second assembly gear 396 is disposed at the other side of the clutch hub 350, and connects to the first assembly gear 392. The second assembly gear 396 extends in a curved line shape, and has a second coupling projection 398 that is inserted into the coupling groove part 404, thereinside.

The first assembly gear 392 and the second assembly gear 396 are coupled to form the first movement gear part 390, and the first movement gear part 390 is moved by the driving part 370's power to the position where the first movement gear part 390 faces the clutch hub or the position where the first movement gear part 390 engages with the clutch hub 350 and the clutch gear 360.

Additionally, the first coupling projection 394 protruding to the inside of the first assembly gear 392, and the second coupling projection 398 protruding to the inside of the second assembly gear 396 are inserted into the coupling groove part 4040 formed outside the second movement gear part 400. Thus, the second movement gear part 400 moves together with the first movement gear part 390 as the first movement gear part 390 operates.

The second movement gear part 400 is disposed inside the first movement gear part 390 and provided with a gear that engages with the clutch hub 350 and the clutch gear 360.

The second movement gear part 400 is formed in a ring shape to form a concentric circle together with the clutch gear 360 and the clutch hub 350. The second movement gear part 400 has an inner gear 406, on the inner circumferential surface thereof, and the inner gear 406 is formed into an internal gear to engage with the clutch hub 350 and the clutch gear 360.

The inner gear 406 moves to one side along the axial direction of the rotation gear part 310 and engages only with the clutch hub 350, or move to the other side along the axial direction of the rotation gear part 310 and engages with the clutch hub 350 and the clutch gear 360 at the same time.

A second movement gear part 400 of one embodiment comprises a second movement gear body 402, a coupling groove part 404 and an inner gear 406.

The second movement gear body 402 is installed in a ring shape. The outer diameter of the second movement gear body 402 is greater than the outer diameter of the clutch hub 350. The second movement gear body 402 is disposed between the clutch hub 350 and the first movement gear part 390.

The coupling groove part 404 may be modified in various different forms within the technical scope where the coupling groove part 404 is coupled to a projection protruding inward from the movement gear part 380. A coupling groove part 404 of one embodiment forms a groove in a ring shape along the outer circumference of the second movement gear body 402. The coupling groove part 404 is coupled to the first coupling projection 394 and the second coupling projection 398 that are a projection protruding to the inside of the first movement gear part 390. The coupling groove part 404 forms a groove in a circular arc shape, and the first coupling projection 394 and the second coupling projection 398, fitted-coupled to the coupling groove part 404, are installed in a circular arc shape. Thus, the second movement gear part 400 may rotate inside the first movement gear part 390. However, in the state where the first movement gear part 390 is not moved along the axial direction of the rotation gear part 310, the second movement gear part 400 is prevented from solely moving along the axial/shaft direction of the rotation gear part 310.

The inner gear 406 may be modified in various different forms within the technical scope where a plurality of inner gears 406 protrudes along the inner circumference of the second movement gear body 402, and the inner gear 406 engages with the gear provided at the clutch gear 360 and the gear provided at the clutch hub 350. An inner gear 406 of one embodiment comprises a second linear gear 408 and a second inclined gear 409.

The second linear gear 408 is a gear that protrudes along the inner circumference of the second movement gear body 402 and extends in the up-down direction.

The second inclined gear 409 is an inclined surface that is formed in the end portion of the second linear gear 408. When the clutch gear 360 is disposed at the upper side of the clutch hub 350, the second inclined gear 409 is disposed at the upper side of the second linear gear 408.

The inclined surface of the second inclined gear 409 is disposed at an angle corresponding to the angle of the inclined surface of the first inclined gear 368. The second inclined gear 409 has a right-angled triangle shape. The second inclined gear 409 forms an inclined surface facing the inclined surface of the first inclined gear 368. A plurality of second inclined gears 409 is installed along the inner circumference of the second movement gear part 400, and has the same slant angle.

One side of the second outer gear 364 provided at the clutch gear 360 has an angle, and one side of the inner gear 406, facing the angled one side of the second outer gear 364, has an angle. Accordingly, when the movement gear part 380 moves upward, the inner gear 406 moves linearly in the up-own direction while rotating in one direction. As a result, the inner gear 406 moving engages with the second outer gear 364 fixed, thereby ensuring a rapid and accurate transfer of power.

The stator 410 is fixed to the fixation case 334 and installed in a ring shape along the edge of the fixation case 334. The stator 410 applies magnetic force to the rotation case 332, and adjusts the rotation load of the rotation case 332. The stator 410 is fixed to the fixation case 334, and the rotation of the stator 410 is limited. The stator 410 is an electromagnet where a coil is wound around a metal pin. As power is supplied to the coil, magnetic force is generated in the stator 410. Electric current supplied to the coil of the stator 410 may be adjusted to adjust the intensity of the magnetic force of the stator 410.

An increase in the intensity of the magnetic force of the stator 410 leads to an increase in the rotation load of the rotation case 332, causing an increase in the pedal effort of pushing the pedal 100. A decrease in the intensity of the magnetic force of the stator 410 leads to a decrease in the rotation load of the rotation case 332, causing a decrease in the pedal effort of pushing the pedal 100. The intensity of the magnetic force of the stator 410 and the rotation load of the rotation case 332 may be adjusted to adjust the user's pedal effort.

The user may adjust friction that is generated as the rotation case 332 rotates, by adjusting the intensity of the magnetic force of the stator 410. When the user adjusts the intensity of exercise or exercises on an upward slope or a downward slope, the user may adjust the intensity of the magnetic force of the stator 410.

The stator 410 is fixed to the fixation case 334 not to rotate together with the rotation case 332, and the fixation case 334 is fixed to the second frame 30 of the support frame part 20. The fixation case 334 may be fixed to the support frame part 20 by a fastening member such as a bolt, a rivet and the like. The rotation gear part 310 and the shaft 320 are formed in the central portion of the fixation case 334 in a way that the rotation gear part 310 and the shaft 320 penetrate the central portion of the fixation case 334.

Since the stator 410 is disposed in a ring shape in the circumferential portion of the fixation case 334, as the radius of the stator 410 increases to a maximum level, the size of the stator may increase to a maximum level. Additionally, as the stator 410 is scaled up, a maximum magnetic force generated in the stator 410 may increase. Accordingly, the range in which rotation load applied to the rotation case 332 is adjusted may increase.

When the stator 410 is disposed in the radial direction of the movement gear part 380 and the clutch hub 350, the thickness at which the rotation case 332 and the stator 410 are installed may significantly decrease. Accordingly, the rotation case 332 of the exercise bike 1 may be relatively thin, and a gap between the pedals 100 on both sides may decrease, the design freedom of the exercise bike 1 may improve significantly.

Further, a plurality of bearing parts 420 rotatably supporting components, which rotates in the resistance adjusting part 300, is provided. A bearing part 420 of one embodiment comprises a wheel bearing part 422 and a shaft bearing 424.

The wheel bearing part 422 is installed between the inner rib 336 of the rotation case 332 and the inner case 335 of the fixation case 334, and reduces friction generated between the fixation case 334 which does not rotate and the rotation case 332 which rotates.

The shaft 320 bearing is installed between the shaft 320 and the rotation gear part 310, and reduces friction that is generated when the shaft 320 rotates.

FIG. 22 is a front view showing a brake device 500 of one embodiment, FIG. 23 is an exploded perspective view showing the brake device 500 of on embodiment, FIG. 24 is a perspective view showing a brake holder 530 of one embodiment, FIG. 25 is a front view showing that a friction member 538 of one embodiment is spaced from a rotation case 332, and FIG. 26 is a front view showing the friction member 538 of one embodiment in contact with a rotation case 332.

As illustrated in FIGS. 22 to 26, the exercise bike 1 of the embodiment in the present disclosure comprises a brake device 500 that forces the rotation case 332 to stop physically without an additional power supply. The brake device 500 forces the rotation case 332 to stop when power is not supplied or the exercise bike 1 is not used.

The brake device 500 of one embodiment comprises a brake lever 510, a brake cable 520 and a brake holder 530. The brake device 500 may further comprise a roller part 540 and a return part 550.

The brake lever 510 is disposed at the support frame part 20 or the housing part 200. The brake lever 510 may be disposed in various positions as long as the user sitting on the seat 740 reaches the brake lever 510. Additionally, the brake lever 510 may be disposed in a position where the user rapidly recognizes the brake lever 510. During exercise, the user can quickly pull the brake lever 510 to stop the rotation case 332 forcibly.

The brake lever 510 may be rotatably hinge-coupled to the housing part 200 or the support frame part 20. Thus, the user may pull and rotate the brake lever 510 during exercise to stop the rotation case 332 quickly.

The brake cable 520 connects to the brake lever 510 such that the brake cable 520 is pulled by the brake lever 510. The brake lever 510 connects to one side of the brake cable 520, and the brake holder 530 connects to the other side of the brake cable 520. At this time, the brake cable 520 may connect to the brake holder 530 and the brake lever 510 such that the brake holder 530 rotates at an angle proportional to an angle of the rotation of the brake lever 510 as the brake lever 510 rotates at a predetermined angle. Additionally, the angle of the rotation of the brake holder 530 may be adjusted depending on the angle at which the brake cable 520 connects to the brake holder 530.

The brake cable 520 may be disposed at the roller part 540 in a movable manner. The position and number of the roller parts 540 may vary depending on the positions or structures of the components in the housing part 200. For example, the number or position of the roller parts 540 may change such that the brake cable 520 avoids the components comprising the disc part 80 and the belt member 90.

The return part 550 may be disposed at the brake cable 520 to return the brake cable 520 to its original position when the external force of the brake lever 510 is not applied to the brake cable 520. The return part 550 may connect to any one of the brake holder 530, the brake cable 520 and the brake lever 510. A compression spring may be used as the return part 550.

When the brake cable 520 is pulled by the same amount of force, the force of rotating the holder body part 531 increases as the brake cable 520 connects to the holder body part 531 far from the hinge shaft part 535.

The brake holder 530 connects to the brake cable 520, which is pulled by the brake lever 510, and applies magnetic force and frictional force to the rotation case 332 provided at the resistance adjusting part 300, to stop the rotation case 332. When the brake lever 510 is disposed at the housing part 200 or the support frame part 20, the brake holder 530 may be disposed in the first direction T1 that is the front side of the rotation case 332. The rotation speed of the rotation case 332 may decrease with magnetic force until the brake holder 530 in the state of being spaced from the rotation case 332 contacts the rotation case 332.

After the brake holder 530 contacts the rotation case 332, the brake holder 530 stops the rotation case 332 by using frictional force and magnetic force. Accordingly, time for stopping the rotation case 332 may decrease when the brake holder 530 moves the same distance to stop the rotation case 332. Further, the brake holder 530's stopping force may increase by a total of the magnetic force and the frictional force. Furthermore, since the brake holder 530 stops the rotation case 332 by using the magnetic force before the brake holder 530 contacts the rotation case 332, the rotation case 332's response to the brake holder 530's stopping force may improve significantly.

A brake holder 530 of one embodiment comprises a holder body part 531, a hinge part 534, a magnet part 537 and a friction member 538.

The holder body part 531 connects to the brake cable 520 and is disposed to correspond to the rotation case 332. The holder body part 531 is disposed at the lower side of the front of the rotation case 332. The holder body part 531 may be spaced from the outer circumferential surface of the rotation case 332.

A holder body part 531 of one embodiment comprises a holder head part 532 and a pair of first retainer parts 533.

The holder head part 532 is rotatably disposed at the hinge part 534, and corresponds to the outer circumferential surface of a rim portion of the rotation case 332. The holder head part 532 is disposed at the lower side of the front of the rim portion.

The pair of first retainer parts 533 extends from the holder body part 531 to correspond to both lateral surfaces of the rim portion. The pair of first retainer parts 533 having the same size may be formed at the holder body part 531's both sides. The holder head part 532 and the pair of first retainer parts 533 may have an approximate "∩" structure.

The hinge part 534 may be modified in various different forms within the technical scope where the hinge part 534 supports the holder body part 531 rotatably and is fixed to the support frame part 20. A hinge part 534 of one embodiment comprises a hinge shaft part 535 and a hinge supporter part 536. The hinge part 534 is disposed at the second frame 30 of the support frame part 20 to support the holder body part 531 rotatably.

The hinge shaft part 535 passes through the holder body part 531 and is disposed in a direction perpendicular to the direction in which the brake cable 520 is pulled. The hinge shaft part 535 may be disposed in parallel with a rotation shaft part. The hinge supporter part 536 supports the hinge shaft part 535's both sides. The hinge supporter part 536 is fastened to the support frame part 20. The hinge supporter part 536 may be disposed to be perpendicular to the holder head part 532's both sides. The hinge part 534 may have various structures as long as the hinge part 534 rotates the holder body part 531 as the brake cable 520 is pulled.

The magnet part 537 is disposed at the holder body part 531 to apply magnetic force to the rotation case 332. The magnet part 537 may be disposed to face the circumferential portion of the rotation case 332. A permanent magnet may be used as the magnet part 537. Accordingly, the magnet part 537 may apply magnetic force to the rotation case 332 without an additional power supply.

The magnet part 537 reduces the rotation speed of the rotation case 332 by using magnetic force until the magnet part 537 contacts the rotation case 332 in the state where the magnet part 537 is spaced from the rotation case 332. After the friction member 538 contacts the rotation case 332, the friction member 538 applies frictional force to the rotation case 332, and the magnet part 537 applies magnetic force to the rotation case 332. The force of stopping the rotation case 332 is a total of the magnetic force and the frictional force. Thus, time taken to stop the rotation case 332 may decrease, and the brake holder 530's stopping force may increase. Additionally, since the magnet part 537 stops the rotation case 332 by using magnetic force before contacting the rotation case 332, the rotation case 332's response to a stop (speed of a response to a stop) may improve significantly.

The magnet part 537 may be respectively disposed at the pair of first retainer parts 533. The first retainer part 533 may have a fixation boss 533*a* thereinside, and the fixation boss 533*a* may protrude to fix the magnet part 537. Thus, the pair of magnet parts 537 applies magnetic force to both lateral surfaces of the rim portion to stop the rotation case 332.

The magnet part 537 may be disposed to protrude from the first retainer part 533. The magnet part 537 may be formed into a circular pillar, a polygonal pillar or a flat plate. Since the magnet part 537 is disposed to protrude, the magnet part 537 may become closer to the rim portion of the rotation case 332.

The magnet part 537 may be buried into the first retainer part 533. At this time, a pair of first retainer parts 533 in which the magnet part 537 is buried has a narrower gap therebetween than a pair of first retainer parts 533 from which the magnet part 537 protrude.

The magnet part 537 may press-fitted to the first retainer part 533 or fixed to the first retainer part 533 by an adhesive or a fixing structure. Additionally, the magnet part 537 and the holder body part 531 may be integrally manufactured in the insert injection molding process.

The magnet part 537 may be formed in a way that the first retainer part 533 is magnetized. At this time, a portion or all of the first retainer part 533 may be magnetized. Further, the first retainer part 533 and the holder head part 532 may be made of a magnet material entirely.

The magnet part 537 may comprise a first magnet part 537*a* disposed at one first retainer part 533, and a second magnet part 537*b* disposed at the other first retainer part 533. The first magnet part 537*a* and the second magnet part 537*b* may have the same size and the same magnitude of magnetic force. Additionally, the first magnet part 537*a* and the second magnet part 537*b* may be disposed to face each other or to be misaligned with each other. When the first magnet part 537*a* and the second magnet part 537*b* apply the same magnitude of magnetic force to the rotation case 332, the rotation case 332 may be prevented from being deformed to one side by magnetic force.

The first magnet part 537*a* and the second magnet part 537*b* may have the same polarity. Accordingly, the first magnet part 537*a* and the second magnet part 537*b* may stop the rotation case 332 by using repulsive force.

The first magnet part 537*a* and the second magnet part 537*b* may have opposite polarity. Accordingly, the first magnet part 537*a* and the second magnet part 537*b* may stop the rotation case 332 based on attractive force.

A portion of the first magnet part 537*a* may have an anode, and the remaining portion of the first magnet part 537*a* may have a cathode. A portion of the second magnet part 537*b* may have an anode, and the remaining portion of the second magnet part 537*b* may have a cathode.

The friction member 538 may be disposed at the holder body part 531, to apply frictional force to the rotation case 332. The friction member 538 applies frictional force to the circumferential portion of the holder body part 531.

The friction member 538 is disposed inside the holder head part 532. At this time, an inclined part 532*a* is formed inside the holder head part 532, and the friction member 538 is disposed at a slant at the inclined part 532*a*. The friction member 538 may be attached to the inclined part 532*a* by an adhesive or fastened to the inclined part 532*a* by a fastening member. The friction member may have the same curvature as the outer circumferential surface of the rim portion. The friction member 538 may be detachably disposed at the inclined part 532*a*. Accordingly, when the friction member 538 wears, the friction member 538 is replaced with a new one and the new friction member is disposed at the inclined part 532*a*.

As the holder body part 531 rotates downward around the hinge part 534, the magnet part 537 and the friction member 538 are spaced from the rotation case 332. As the holder body part 531 rotates upward around the hinge part 534, the magnet part 537 faces the rotation case 332, and the friction member 538 is pressed against the rotation case 332 and applies frictional force.

FIG. 33 is an exploded perspective view showing a post locking part 600 of one embodiment, FIG. 34 is a perspective view showing a post locking lever 610 of one embodiment having rotated, and FIG. 35 is a perspective view showing the post locking lever 610 of one embodiment having moved to its initial position.

As illustrated in FIGS. 33 to 35, the exercise bike 1 according to the present disclosure comprises a post locking part 600 that is a locking device for fixing the seat 740 at a predetermined height when the height of the seat 740 is adjusted.

A saddle pillar 742 extending downward from a saddle part 741 of the seat 740 is coupled to the post 21 in a way that the height of the saddle pillar 742 is adjusted. The post 21 has a holding groove part. A plurality of holding groove parts is arranged along the lengthwise direction D of the post 21. Additionally, the holding groove parts may be a plurality of holes or holding jaws that are arranged along the lengthwise direction D of the saddle pillar 742. The holding groove part may have various structures as long as the position of the holding groove part is limited and fixed by the post locking part 600.

The support frame part 20 has an upper frame 62, at the upper side thereof. The upper frame 62 is disposed at the lower side of the upper cover part 220. The saddle pillar 742 is installed in a way that penetrates the upper frame 62. The upper frame 62 may be formed into a rectangular plate to cover a portion of the upper side of the first frame 23.

The post locking part 600 is inserted into the holding groove part, fixes the position of the saddle pillar 742, and presses the saddle pillar 74 against the post 21. Since the post locking part 600 is inserted into the holding groove part of the post 21, limits the movement of the saddle pillar 742 and presses the saddle pillar 742, the release of the post locking part 600's limiting and pressing force may be prevented even if external force or an external impact is applied to the saddle pillar 742. Thus, the adjusted height of the saddle pillar 742 is prevented from changing.

Additionally, when the post locking part 600 presses the saddle pillar 742 even if the post locking part 600's inserting and limiting force is released, the adjusted height of the saddle pillar 742 may be maintained.

As long as any one of the post locking part 600's limiting force and pressing force is applied to the saddle pillar 742, the height of the saddle pillar 742 does not change. The configuration where the post locking part 600 applies limiting force and pressing force to the saddle pillar 742 at the same time may be modified in various different forms.

The post locking part 600 of one embodiment comprises a post locking lever 610, a wire part 620, a post limiting part 630, a post push part 640, a fixing bracket 650 and a pulley part 660.

The post locking lever 610 is rotatably disposed at the support frame part 20. The post locking lever 610 may be rotatably hinge-coupled to the support frame part 20 or the housing part 200. The post locking lever 610 of one embodiment is installed in a protective case 260 and exposed outward.

The post locking lever 610 may have a press projection part 611 to press the post push part 640. The press projection part 611 protrudes from the post locking lever 610 toward the post push part 640. Accordingly, when the post locking lever 610 is closed horizontally, the press projection part 611 presses the post push part 640, and the post push part 640 presses the saddle pillar 742 against the post 21. When the post locking lever 610 is open upward, the press projection part 611 rotates downward to escape from the post push part 640 and does not press the post push part 640. The press projection part 611 presses the post push part 640 only when the seat 740 locking lever is closed, and presses the saddle pillar 742 against the post 21. Alternatively, the press projection part 611 presses the post push part 640 and presses the post 21 against the saddle pillar 742.

The wire part 620 connects to the post locking lever 610. The wire part 620 may be disposed at the lower side of the post locking lever 610. The wire part 620 is not stretched in the lengthwise direction D and made of a material that bends softly.

The wire part 620 connects the post locking lever 610 and the post limiting part 630, and the pulley part 660 supports the wire part 620. Thus, as the post locking lever 610 rotates, the post limiting part 630 is inserted into the holding groove part or taken out of the holding groove part.

The post limiting part 60 connects to the wire part 620 in a way that the post limiting part 630 is pulled by the wire part 620, and is fitted into the holding groove part and fixes the position of the saddle pillar 742. The post limiting part 630 may be disposed at the lower side of the post locking lever 610. As the post locking lever 610 rotates, the post limiting part 630 moves. Accordingly, the post limiting part 630 is fitted into the holding groove part and prevents the position of the saddle pillar 742 from changing.

The post limiting part 630 comprises a second retainer part 631, a fixation rod part and a post elastic member 635.

The second retainer part 631 is fixed to the post 21. The second retainer part 631 may be formed into a circular container or a polygonal container. The second retainer part 631 is fastened to the post 21 or the saddle pillar 742. The second retainer part 631 is disposed to face the holding groove part of the post 21.

A post fixation rod part 632 is installed in the second retainer part 631 in a movable manner, and is fitted into the holding groove part and fixes the position of the saddle pillar 742. The post fixation rod part 632 is fitted into the holding groove part 21*a* formed at the post 21. The post fixation rod part 632 may move in a direction perpendicular to the direction where the height of the saddle pillar 742 is adjusted.

The post elastic member 635 applies elastic force to press the post fixation rod part 632 toward the holding groove part. The post elastic member 635 applies elastic force to the post fixation rod part 632 in the direction in which the post fixation rod part 632 is fitted into the holding groove part. A coil spring may be used as the post elastic member 635. Accordingly, when external force is not applied to the post locking lever 610, the post elastic member 635 applies elastic force such that the post fixation rod part 632 does not escape from the holding groove part.

The post fixation rod part 632 has a stopper 633 to limit a range of the movement of the post fixation rod part 632, on the outer surface thereof. The stopper 633 may contact the inner surface of the second retainer part 631 in a slidable manner. As the post fixation rod part 632 is fitted into the holding groove part, the stopper 633 contacts the outer surface of the holding grove part 21*a*. Accordingly, the depth at which the post fixation rod part 632 is inserted into the holding groove part may be limited.

The post push part 640 is coupled to the post 21 in a movable manner, and is pressed by the post locking lever 610 and presses the saddle pillar 742 against the post 21. The post push part 640 is disposed at the upper frame 62 in a movable manner. Accordingly, the position of the saddle pillar 742 may be prevented from changing in the up-down direction. Further, since the saddle pillar 742 is pressed against the post 21, the saddle pillar 742 may be prevented from escaping from the post 21 when the exercise bike 1 operates.

The post push part 640 may comprise a pressed part 642 and a pressing part 644. The pressed part 642 is pressed by the post locking lever 610. The pressing part 644 may extend from the pressed part at a slant, and surface-contact the saddle pillar 742. The pressing part 644 may be formed into a flat plate to increase a press surface where the pressing part 644 contacts the saddle pillar 742. As the exercise bike 1 operates in the state where the pressing part 644 is pressed against the saddle pillar 742, the saddle pillar 742 may be prevented from escaping from the post 21.

The pulley part 660 is disposed at one side in the direction where the post limiting part 630 moves, and the wire part 620 connects to the post limiting part 630 past the pulley part 660. At this time, both sides of the pulley part 660 connect to the fixing bracket 650, and the fixing bracket 650 is fixed to a casing. The position and number of the pulley parts 660 may vary depending on the positions or surrounding structures of the post limiting part 630 and the post locking lever 610.

The controller 700 is provided with control devices for controlling the operation of the exercise bike 1. The controller 700 is installed between the reinforcing frame 64 and the holding bracket 66 that are provided at the support frame part 20. The controller 700 is detachably disposed at the support frame part 20.

The controller 700 is disposed at the upper side of the extension frame 22, and as long as the side frame 270 is detached from the external case 210 or from the support frame part 20, management and repairs may be performed.

The handle 710 supported by the first frame 23 of the support frame part 20 is gripped by the user. The handle 710 may be fixed directly to the first frame 23, and in the state where the handle 710 connects to a handle frame 720, the handle frame 720 is supported by the first frame 23.

The handle frame 720 may have a "¬" shape, and a portion of the handle frame 720 extending downward connects to the first frame 23. Additionally, the height of the handle frame 720 may be adjusted with an additional locking device.

A display part 730 that allows the user to easily see the operation state of the exercise bike 1 and exercise records is disposed at the handle frame 720 adjacent to the handle 710. The display part 730 may output exercise information such as the speed of the exercise bike 1, a rotation load and the like on the screen.

The saddle pillar 742 supporting the lower side of the seat 740 is disposed at the upper side of the post 21. The saddle pillar 74 may be installed in the post 21 in a way that the height of the saddle pillar 742 is adjusted. Certainly, the saddle pillar 742 may be fixed to the inside or the outside of the post 21. The cross section of the saddle pillar 742 may vary depending on the shape of the post 21.

The saddle pillar 742 is installed inside the post 21 in a way that the height of the saddle pillar 742 is adjusted. Accordingly, the height of the seat 740 may be properly adjusted considering the user's physical features such as the height and exercise tendency.

The above-described exercise bike 1 has no vacant space between the side frame 270 and the disc part 80, reducing the risk of an accident where an infant's hand or a foreign substance is jammed into the surrounding area of the rotating disc part 80.

When the components installed inside the exercise bike 1 need to be repaired and exchanged, the detachable structure of the side frame 270 may lead to a reduction in the time and costs required for managing and repairing the components disposed inside the side frame 270.

Hereafter, the operation state of the exercise bike 1 of one embodiment is described with reference to the accompanying drawings.

As the user pushes and rotates the pedal 100, the disc part 80 rotates together with the pedal 100. When the pedal 100 member connecting to the disc part 80 transfers power for rotation to the resistance adjusting part 300, the rotation case 332 rotates.

The intensity of magnetic force of the stator 410 provided at the resistance adjusting part 300 is adjusted to adjust friction that is generated when the rotation case 332 rotates. The adjustment of the intensity of magnetic force of the stator 410 may result in the adjustment of a pedal effort at a time of pushing the pedal 100.

The resistance adjusting part 300 corresponding to a wheel is reliably supported by the second frame 30, and the center of the resistance adjusting part 300 is placed higher than the center of the disc part 80 with the post 21 between the resistance adjusting part 300 and the disc part 80. Since the center of gravity of the exercise bike 1 comprising the resistance adjusting part 300 is aligned with the position of the support frame part 20 or is placed near the support frame part 300, the resistance adjusting part 300 is stably held, and the reliability in the operation of the exercise bike 1 and the durability of the exercise bike 1 may improve.

The rotation support shaft 70, which is the rotation center of the disc part 80 being rotated by the pedal 100, is disposed at the front of the post 21, and the shaft 320, which is the rotation center of the resistance adjusting part 300, is disposed at the rear of the post 21. Accordingly, the center of gravity of the entire exercise bike 1 is placed at the post 21, and an additional support structure for supporting the housing part 200 is not required, allowing of a reduction in manufacturing costs.

The resistance adjusting part 300, being rotated by the wheel cover part 240 that is installed in a way that surrounds the outside of the resistance adjusting part 300, is prevented from being exposed outward, allowing of a reduction in the risk of accidents. In the case of a wheel cover part 240 made of a transparent material, the user may easily observe the rotation of the resistance adjusting part 300 corresponding to a wheel, and a convenient environment for the use of the exercise bike 1 may be created.

Additionally, since the pedal 100 connects to the disc part 80 formed into a circular plate and rotates without connecting to a rotating crank arm, accidents caused by the rotating crank arm may be prevented.

In the exercise bike 1 of one embodiment, the housing part 200 surrounding the resistance adjusting part 300 and the disc part 80 is supported by the post 21 and is installed to float in the air. Accordingly, the lower portion of the housing part 200 may be readily cleaned, and the housing part 200 may be readily managed and repaired.

Further, since the support frame part 20 having a single structure supports the resistance adjusting part 300, the disc part 80, the handle 710 and the seat 740 at the same time, costs of manufacturing the exercise bike 1 may be less than costs of manufacturing a bike provided with an additional frame for supporting a disc part 80, a resistance adjusting part 300 and the like.

In the state where the exercise bike 1 is supplied with power as illustrated in FIGS. 6 and 23, as the brake lever 510 is manipulated manually, the rotation case 443 may be stopped by the magnetic force of the stator 410. At this time, the magnetic force of the magnet part 537, the frictional force of the friction member 538 and the magnetic force of the stator 410 may be together applied to the rotation case 332 and stop the rotation case 332 more quickly.

Further, in the state where the exercise bike 1 is not supplied with power, as the brake lever 510 is manipulated manually, the rotation of the rotation case 332 is limited. At this time, the magnetic force of the magnet part 537 and the frictional force of the friction member 538 may only be applied to the rotation case 332 and may stop the rotation case 332.

When the second movement gear part 400 engages only with the clutch hub 350 as illustrated in FIGS. 15 and 16, power for rotating the clutch hub 350 is not transferred to the rotation case 332. Additionally, as the pedal 100 rotates forward, the rotation gear part 310 rotates forward. As the rotation gear part 310 rotates forward, power for rotating the rotation gear part 310 is transferred to the rotation case 332 through the clutch bearing 340, and the rotation case 332 rotates forward. Thus, the resistance adjusting part 300, and the exercise bike 1 provided with the resistance adjusting part 300 operate in the free wheel mode.

When the second movement gear part 400 engages with the clutch hub 350 and the clutch gear 360 as illustrated in FIGS. 19 and 20, the second movement gear part 400 rotates the clutch gear 360 by using power for rotating the clutch hub 350. Since the clutch gear 360 is fixed to the rotation case 332, the rotation case 332 rotates together with the clutch gear 360.

Accordingly, as the pedal 100 rotates forward or reversely, the rotation gear part 310 also rotates forward or reversely. Thus, the resistance adjusting part 300 and the exercise bike 1 provided with the resistance adjusting part 300 operate in the non-free wheel mode.

The resistance adjusting part 300 and the exercise bike 1 provided with the resistance adjusting part 300 may make no noise, based on the operation of the clutch bearing 340, in the free wheel mode.

When the resistance adjusting part 300 and the exercise bike 1 provided with the resistance adjusting part 300 are in the free wheel mode, the clutch hub 350 and the clutch gear 360 are rotated together by the second movement gear part 400. Accordingly, the rotation case 332 rotates together with the rotation gear part 310.

Further, since the movement gear part 380 comprising the second movement gear part 400, and the driving part 370 moving the movement gear part 380 are installed inside the case part 330 in a single tier, the size and thickness of the case part 330 may decrease, ensuring improvement in the design freedom of the resistance adjusting part 300.

Furthermore, since the driving part 370 using a motor is installed inside the resistance adjusting part 300, the user may change the mode of the exercise bike 1 to the free wheel mode and the non-free wheel mode without getting off the exercise bike 1. Depending on the forward rotation and reverse rotation of the pedal 100, the non-free wheel mode in which the rotation case 332 of the resistance adjusting part 300 rotates in the same direction as the pedal 100, and the free wheel mode in which the rotation case 332 rotates forward only when the pedal 100 rotates forward may automatically change. Thus, the exercise bike 1 according to the present disclosure helps to enhance user convenience, and a free wheel mode bike and a non-free wheel mode bike do not need to be purchased individually, allowing of a reduction in installation costs.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

The invention claimed is:

1. An exercise bike, comprising:

a base part being placed on an installation surface;

a support frame part having a lower portion that is fixed to the base part and an upper portion that extends to an upper side of the base part and supports a handle and a seat;

a disc part connecting to a rotation support shaft that passes through the support frame part;

a pedal being detachably disposed at the disc part;

a resistance adjusting part receiving a rotation of the disc part through a belt member, being supported by the support frame part, and adjusting resistance at a time when the pedal is rotated by magnetic force; and a housing part being disposed at the upper side of the base part in a state where the housing part is spaced from the base part, and being installed in a way that the housing part surrounds outsides of the resistance adjusting part and the support frame part.

2. The exercise bike of claim 1, wherein the base part has a plate shape and surface-contacts the installation surface.

3. The exercise bike of claim 1, the support frame part, comprising:

a post extending to the upper side of the base part and having a pillar shape;

an extension frame extending in a first direction of the post, and supporting the rotation support shaft rotatably;

a first frame extending to an upper side of the extension frame and supporting the handle; and a second frame extending in a second direction of the post and supporting the resistance adjusting part.

4. The exercise bike of claim 3, wherein the post connects to a saddle pillar provided at the seat and supports a lower portion of the saddle pillar.

5. The exercise bike of claim 3, wherein a lower portion of the post is fixed to the base part, and an upper portion of the post extends upward at a slant in the second direction.

6. The exercise bike of claim 3, wherein the post is disposed between the rotation support shaft and a shaft that is provided at a rotation center of the resistance adjusting part, and under the assumption that a distance between the shaft and the base part is L2 and that a distance between the rotation support shaft and the base part is L1, L2 is greater than L1.

7. The exercise bike of claim 3, the second frame, comprising:

a first inner frame extending from the post, being disposed at one side in a widthwise direction of the resistance adjusting part, and supporting one side of a shaft that is provided at a rotation center of the resistance adjusting part; and a second inner frame extending from the post, being disposed at the other side in the widthwise direction of the resistance adjusting part, and supporting the other side of the shaft.

8. The exercise bike of claim 7, the first inner frame, comprising:

a first support bar extending from the post that is disposed inside the housing part, in the second direction;

a first connection body connecting to the first support bar, and being provided with a first guide hole for inserting one side of the shaft; and a first fixing bracket extending to an upper side and a lower side of the first connection body and being fixed to an inside of the housing part.

9. The exercise bike of claim 7, the second inner frame, comprising:

a second support bar extending from the post that is disposed inside the housing part, in the second direction;

a second connection body connecting to the second support bar, and being provided with a second guide hole for inserting the other side of the shaft; and a second fixing bracket extending to an upper side and a lower side of the second connection body and being fixed to an inside of the housing part.

10. The exercise bike of claim 1, the disc part, comprising:

a first outer disc connecting to one side of the rotation support shaft, and being inserted into a first mounting hole part that is provided at the housing part, in a state where the pedal is detachably installed; and a first inner disc being fixed to an inside of the first outer disc and having an outer surface that holds the belt member transferring power to the resistance adjusting part.

11. The exercise bike of claim 10, the disc part, further comprising:

a second outer disc connecting to the other side of the rotation support shaft, and being inserted into a second mounting hole part that is provided at the housing part, in a state where the pedal is detachably installed.

12. The exercise bike of claim 1, the resistance adjusting part, comprising:

a rotation gear part connecting to the belt member and rotating, and having a gear along an outer circumference thereof;

a case part supporting the rotation gear part rotatably;

a clutch bearing being disposed between the rotation gear part and the case part, and as the rotation gear part rotates forward, transferring power to the case part;

a clutch hub being fixed to an outside of the rotation gear part, and rotating together with the rotation gear part;

a clutch gear being disposed at the clutch hub one after another and being fixed to the case part;

a driving part being fixed to the case part, and supplying power for rotation; and a movement gear part being moved by power of the driving part, and moving in a free wheel mode where the movement gear part engages with the clutch hub and in a non-free wheel mode where the movement gear part engages with the clutch hub and the clutch gear at the same time and transfers power.

13. An exercise bike, comprising:

a base part having a plate shape;

a support frame part having a lower portion that is fixed to the base part and an upper portion that extends to an upper side of the base part and supports a handle and a seat;

a disc part connecting to a rotation support shaft that passes through the support frame part and having a pedal mounted outside the disc part;

a resistance adjusting part receiving a rotation of the disc part through a belt member, being supported by the support frame part, and adjusting resistance at a time when the pedal is rotated;

a housing part being disposed at the upper side of the base part in a state where the housing part is spaced from the base part, and being installed in a way that the housing part surrounds outsides of the resistance adjusting part and the support frame part;

a brake lever being disposed at the support frame par or the housing part; and a brake holder connecting to a brake cable that is pulled by the brake lever, and applying magnetic force and frictional force to a rotation case that is provide at the resistance adjusting part and stopping the rotation case.

14. The exercise bike of claim 13, the brake holder, comprising:

a holder body part connecting to the brake cable, and being disposed to correspond to the rotation case;

a hinge part supporting the holder body part rotatably and being fixed to the support frame part;

a magnet part being disposed at the holder body part to apply magnetic force to the rotation case; and a friction member being disposed at the holder body part to apply frictional force to the rotation case.

15. The exercise bike of claim 13, the support frame part, comprising:

a post extending to the upper side of the base part and having a pillar shape;

an extension frame extending in a first direction of the post, and supporting the rotation support shaft rotatably;

a first frame extending to an upper side of the extension frame and supporting the handle; and a second frame extending in a second direction of the post and supporting the resistance adjusting part.

16. The exercise bike of claim 15, wherein a lower portion of the post is fixed to the base part, and an upper portion of the post extends upward at a slant in the second direction.

17. The exercise bike of claim 15, wherein the post is disposed between the rotation support shaft and a shaft that is provided at a rotation center of the resistance adjusting part, and under the assumption that a distance between the shaft and the base part is L2 and that a distance between the rotation support shaft and the base part is L1, L2 is greater than L1.

18. The exercise bike of claim 13, the housing part, comprising:

an upper cover part being fixed to an upper side of the support frame part, and covering the upper side of the support frame part and an upper edge of the resistance adjusting part;

a lower cover part being fixed to a lower side of the support frame part, and covering the lower side of the support frame part and a lower edge of the resistance adjusting part; and a wheel cover part being installed in a way that surrounds the outside of the resistance adjusting part, being fixed to the upper cover part and the lower cover part, and bending in a curved surface shape along the outside of the resistance adjusting part.

19. The exercise bike of claim 18, wherein the housing part further comprises a side frame being provided with a mounting hole part in which the disc part is installed and blocking both sides of the support frame part in a widthwise direction thereof.

20. The exercise bike of claim 19, the side frame, comprising:

a first side cover part being disposed at one side of the support frame part in the widthwise direction thereof, blocking the resistance adjusting part and the belt member connecting to the resistance adjusting part, and having a plate shape; and a second side cover part being disposed at the other side of the support frame part in the widthwise direction thereof, and having a plate shape.

* * * * *